US011235442B2

(12) United States Patent
Coffland

(10) Patent No.: US 11,235,442 B2
(45) **Date of Patent: *Feb. 1, 2022**

(54) WRENCH HEAD

(71) Applicant: The Boeing Company, Chicago, IL (US)

(72) Inventor: Donald W. Coffland, Seattle, WA (US)

(73) Assignee: The Boeing Company, Chicago, IL (US)

( * ) Notice: Subject to any disclaimer, the term of this patent is extended or adjusted under 35 U.S.C. 154(b) by 148 days.

This patent is subject to a terminal disclaimer.

(21) Appl. No.: 16/659,961

(22) Filed: Oct. 22, 2019

(65) Prior Publication Data

US 2021/0114184 A1 Apr. 22, 2021

(51) Int. Cl.
*B25B 13/48* (2006.01)
*B25B 13/46* (2006.01)

(52) U.S. Cl.
CPC ..... *B25B 13/481* (2013.01); *B25B 13/46* (2013.01)

(58) Field of Classification Search
CPC ..... B25B 13/46; B25B 13/481
USPC ..... 81/90.1, 90.3, 90.7, 90.8, 120, 65.2
See application file for complete search history.

(56) References Cited

U.S. PATENT DOCUMENTS

| | | | | |
|---|---|---|---|---|
| 1,030,881 | A | 7/1912 | Hummel | |
| 1,593,000 | A | 7/1926 | Wilson | |
| 2,154,531 | A | 4/1939 | Roche | |
| 5,831,554 | A | 11/1998 | Hedayat et al. | |
| 6,736,580 | B2 | 5/2004 | Schultz | |
| 7,721,628 | B2 | 5/2010 | Lorger et al. | |
| 7,819,025 | B2 | 10/2010 | Coffland | |
| 8,250,948 | B1 | 8/2012 | Coffland | |
| 8,408,102 | B2 | 4/2013 | Coffland | |
| 8,806,993 | B2 | 8/2014 | Coffland | |
| 8,973,470 | B1 | 3/2015 | Coffland | |
| 9,855,643 | B2 | 1/2018 | Coffland | |
| 2005/0150332 | A1 | 7/2005 | Russell | |
| 2006/0266164 | A1 * | 11/2006 | Gao | B25B 13/28 81/128 |
| 2010/0122610 | A1 | 5/2010 | Chen | |

(Continued)

FOREIGN PATENT DOCUMENTS

| | | | |
|---|---|---|---|
| WO | 0058057 | 10/2000 | |
| WO | WO-0058057 A1 * | 10/2000 | B25B 13/52 |

OTHER PUBLICATIONS

"Arcuate" Merriam-Webster.com Dictionary, Merriam-Webster,https://www.merriam-webster.com/dictionary/arcuate. Accessed Jul. 6, 2021. (Year:2021).

(Continued)

*Primary Examiner* — Michael D Jennings
*Assistant Examiner* — Abbie E Quann
(74) *Attorney, Agent, or Firm* — Perman & Green, LLP

(57) ABSTRACT

A wrench head comprises a working axis, a first jaw, a second jaw, and a third jaw. The first jaw comprises a first-jaw arcuate convex contact surface, a second first-jaw arcuate convex contact surface, a third first-jaw arcuate convex contact surface, and a first-jaw planar contact surface. The second jaw is coupled with and pivotable relative to the first jaw and comprises a second-jaw arcuate convex contact surface and a second-jaw planar contact surface. The third jaw is coupled with and pivotable relative to the second jaw and comprises third-jaw arcuate convex contact surfaces.

20 Claims, 48 Drawing Sheets

(56) References Cited

U.S. PATENT DOCUMENTS

| | | | |
|---|---|---|---|
| 2014/0209444 | A1 | 10/2014 | Kundracik et al. |
| 2021/0122012 | A1 | 4/2021 | Buchanan |

OTHER PUBLICATIONS

MIT, 18.013 a Online Textbook, 15.3 Curvature and Radius of Curvature, https://math.mit.edu/classes/18.013A/HTML/chapter15/section03.html(Year:2005).

* cited by examiner

WRENCH HEAD

CROSS-REFERENCE TO RELATED APPLICATIONS

This application is related to the following U.S. patent application Ser. Nos.: Ser. No. 16/659,928 filed on Oct. 22, 2019 (and titled "Wrench Head"); Ser. No. 16/659,931 filed on Oct. 22, 2019 (and titled "Wrench Head"); Ser. No. 16/659,935 filed on Oct. 22, 2019 (and titled "Wrench Head"); Ser. No. 16/659,939 filed on Oct. 22, 2019 (and titled "Wrench Head"); Ser. No. 16/659,944 filed on Oct. 22, 2019 (and titled "Wrench Head"); Ser. No. 16/659,949 filed on Oct. 22, 2019 (and titled "Wrench Head"); Ser. No. 16/659,957 filed on Oct. 22, 2019 (and titled "Wrench Head"); and Ser. No. 16/660,030 filed on Oct. 22, 2019 (and titled "Wrench Head"), the disclosures of which are incorporated herein by reference in their entireties.

TECHNICAL FIELD

The present disclosure relates to wrench heads.

BACKGROUND

During assembly of a structure, such as an aircraft, tube-nuts are employed for securing various tube fittings. To ensure accuracy of assembly operations, torque wrenches with crow's-foot extensions are utilized. However, in some cases, it is difficult to properly engage tube-nuts in confined spaces within the structure using torque wrenches with crow's-foot extensions and/or obtain accurate torque measurements using the same.

SUMMARY

Accordingly, apparatuses and methods, intended to address at least the above-identified concerns, would find utility.

The following is a non-exhaustive list of examples, which may or may not be claimed, of the subject matter, disclosed herein.

Disclosed herein is a wrench head, comprising a working axis, a first jaw, a second jaw, and a third jaw. The first jaw comprises a first-jaw arcuate convex contact surface, a second first-jaw arcuate convex contact surface, a third first-jaw arcuate convex contact surface, and a first-jaw planar contact surface, located between the second first-jaw arcuate convex contact surface and the third first-jaw arcuate convex contact surface. The second jaw is coupled with the first jaw, is pivotable relative to the first jaw, and comprises a second-jaw arcuate convex contact surface and a second-jaw planar contact surface. The third jaw is coupled with the second jaw, is pivotable relative to the second jaw, and comprises a third-jaw arcuate convex contact surfaces. A first-jaw virtual circle is perpendicular to the first-jaw arcuate convex contact surface, to the second first-jaw arcuate convex contact surface, and to the third first-jaw arcuate convex contact surface, has a single point contact with each one of the first-jaw arcuate convex contact surface, the second first-jaw arcuate convex contact surface, and the third first-jaw arcuate convex contact surface, is centered about the working axis, and is perpendicular to the working axis. When the second jaw is in a closed second-jaw orientation relative to the first jaw, the first-jaw virtual circle is perpendicular to the second-jaw arcuate convex contact surface and to the second-jaw planar contact surface, has a single point contact with the second-jaw arcuate convex contact surface, and intersects the second-jaw planar contact surface at only two points. When the second jaw is in the closed second-jaw orientation relative to the first jaw and the third jaw is in a closed third-jaw orientation relative to the second jaw, the first-jaw virtual circle is perpendicular to the third-jaw arcuate convex contact surfaces and a single point contact with each of the third-jaw arcuate convex contact surfaces.

Serial coupling of first jaw, second jaw, and third jaw provide for placement of wrench head over head of a fastener, e.g., hexagonal fastener from a lateral direction relative to the rotational axis of hexagonal fastener. First-jaw arcuate convex contact surface, second first-jaw arcuate convex contact surface, third first-jaw arcuate convex contact surface, first-jaw planar contact surface, second-jaw arcuate convex contact surface, second-jaw planar contact surface, and third-jaw arcuate convex contact surfaces provide at least six regions of contact with fastener. Second-jaw planar contact surface prevents, through contact with fastener, closing of wrench head during a ratcheting motion of wrench head.

BRIEF DESCRIPTION OF THE DRAWINGS

Figures 1, 1A:
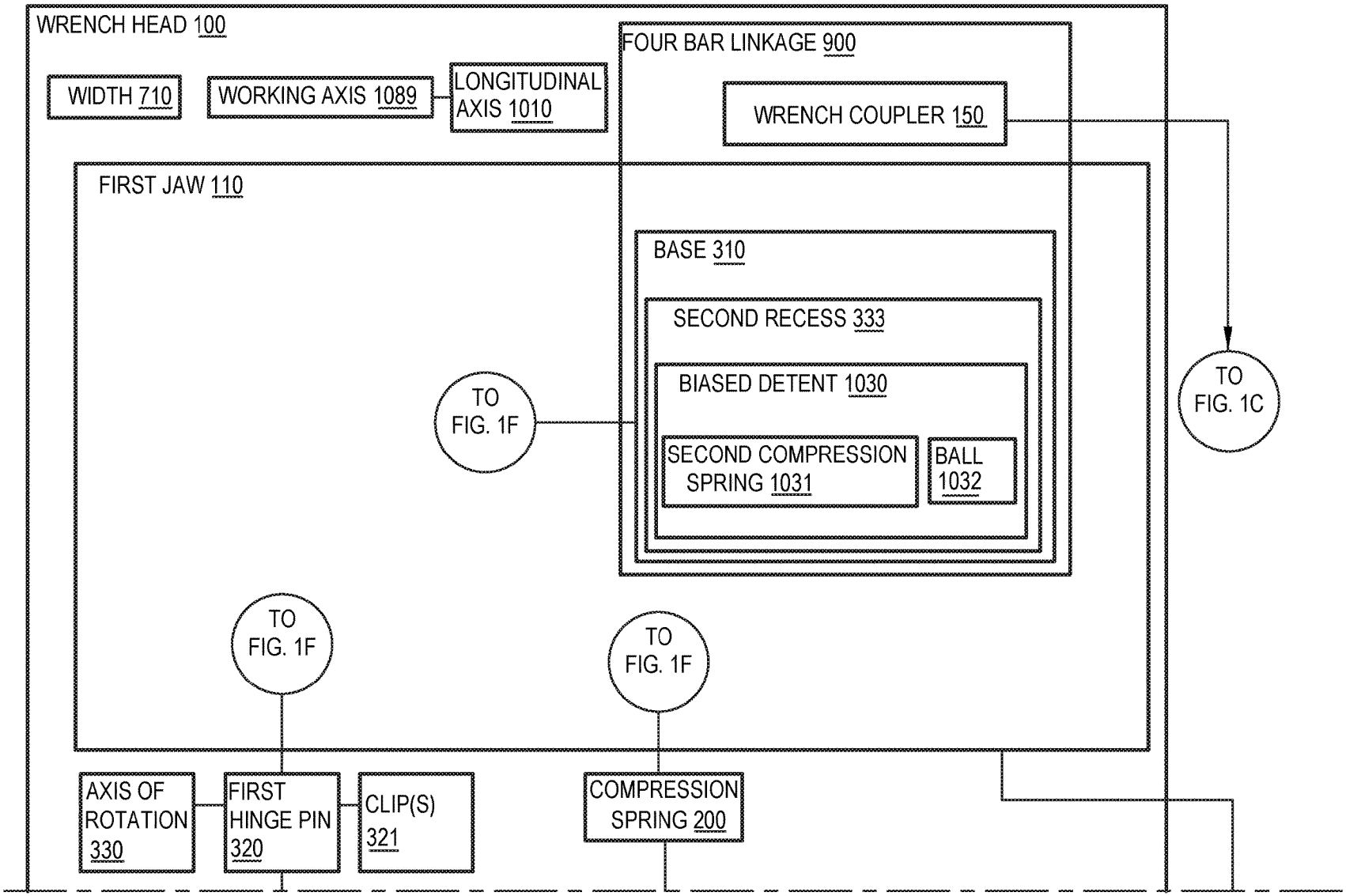
Figures 1, 1A, 2:
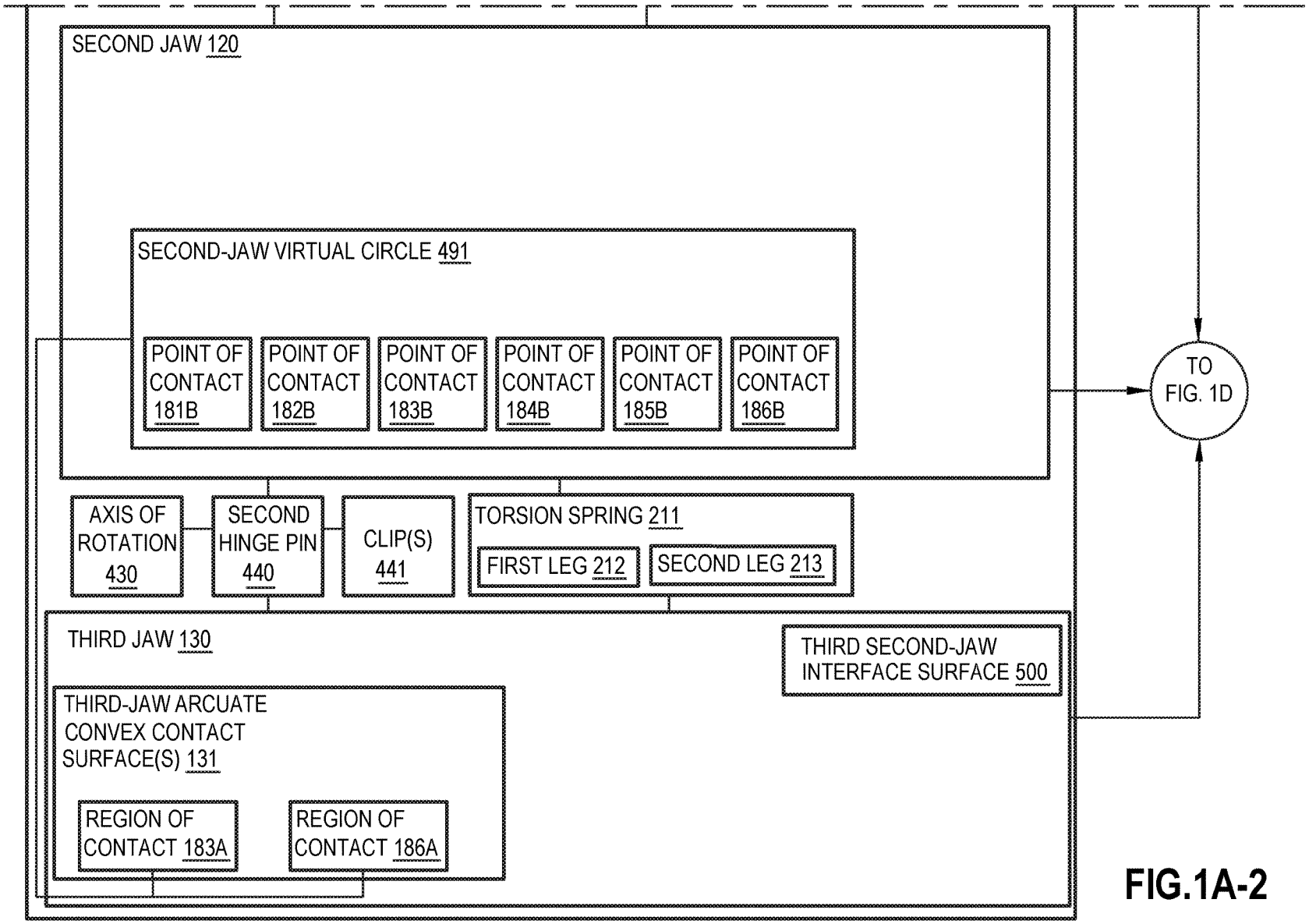
Figure 1B:
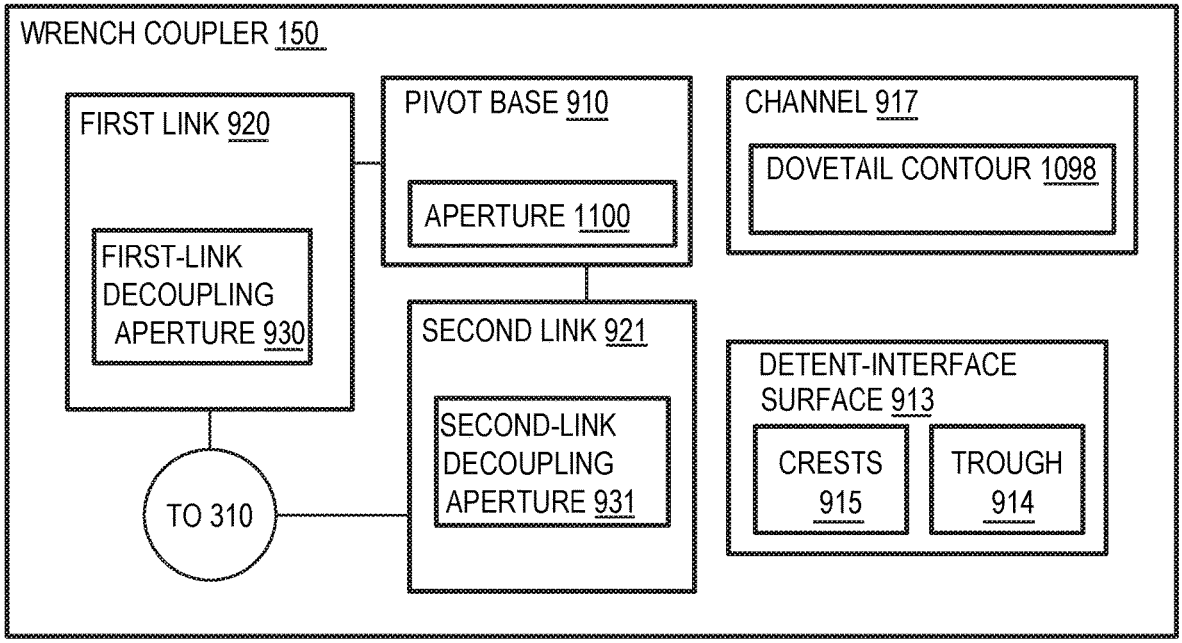
Figure 1C:
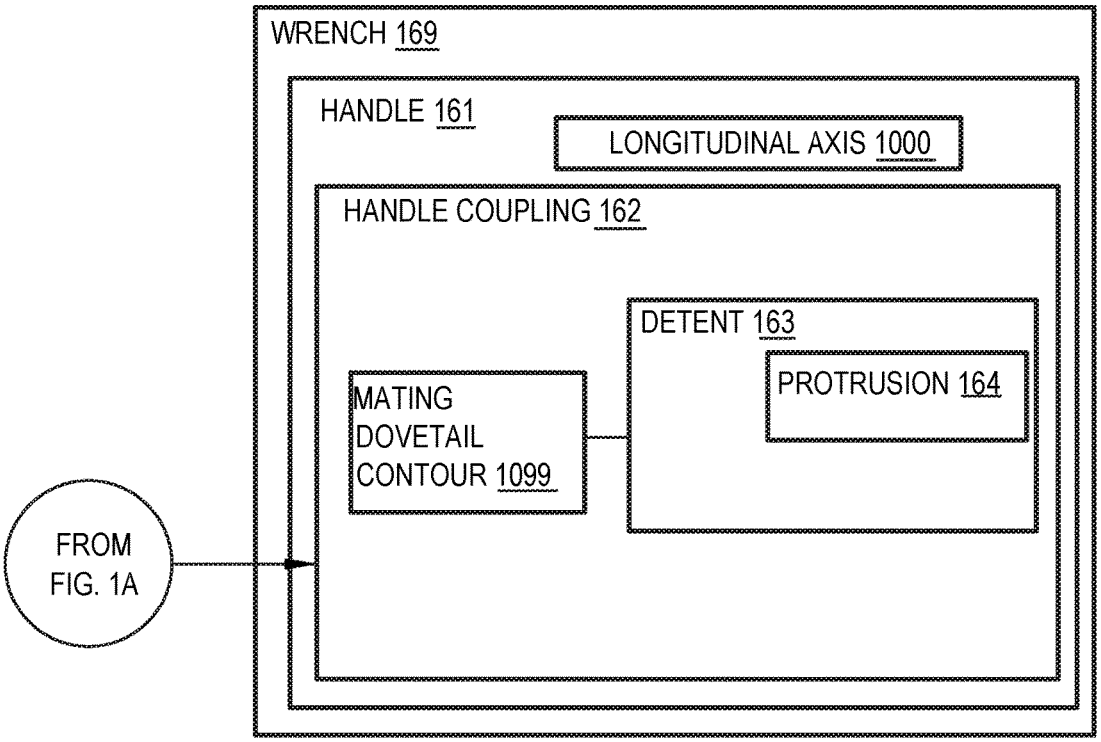
Figure 1D:
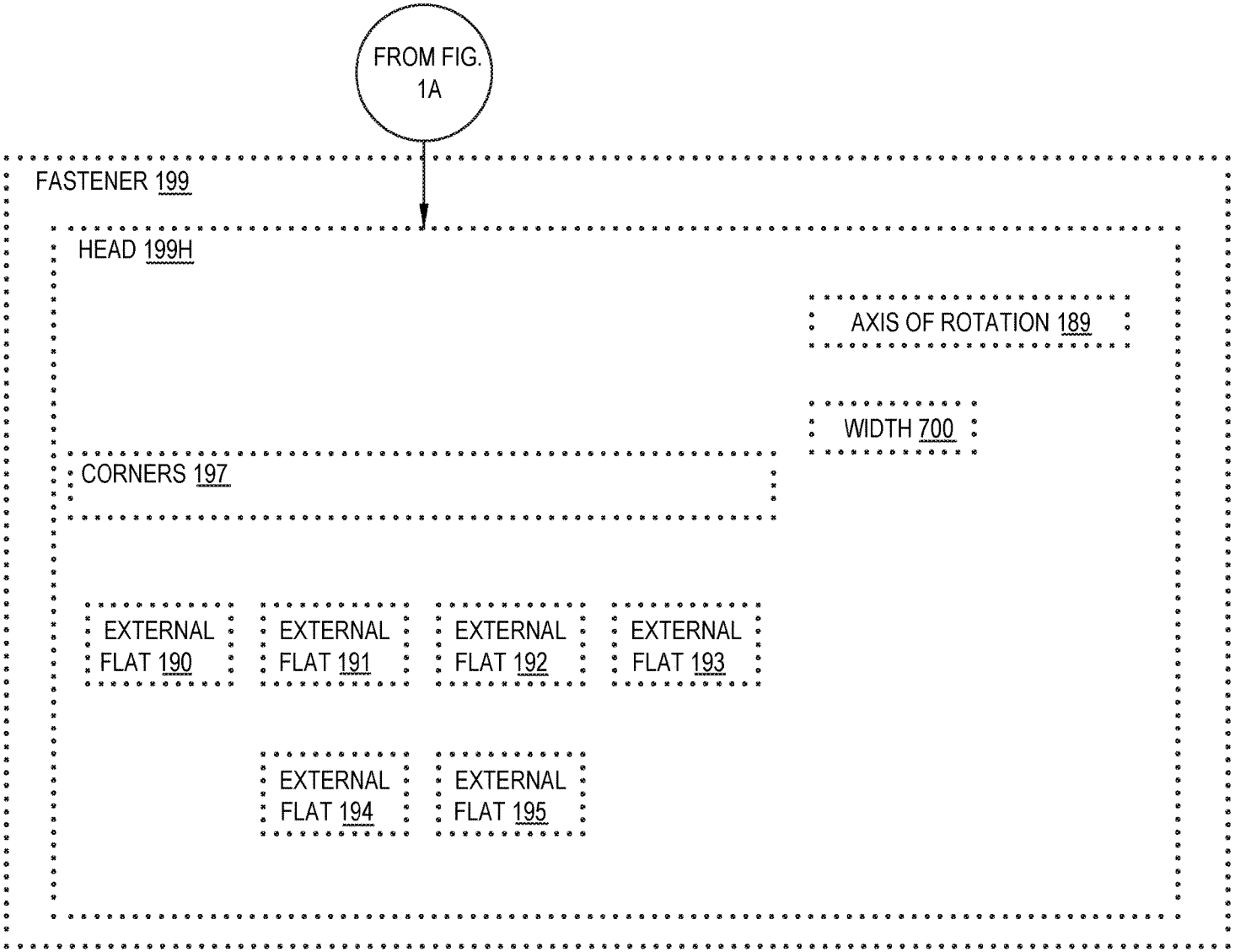
Figure 1E:
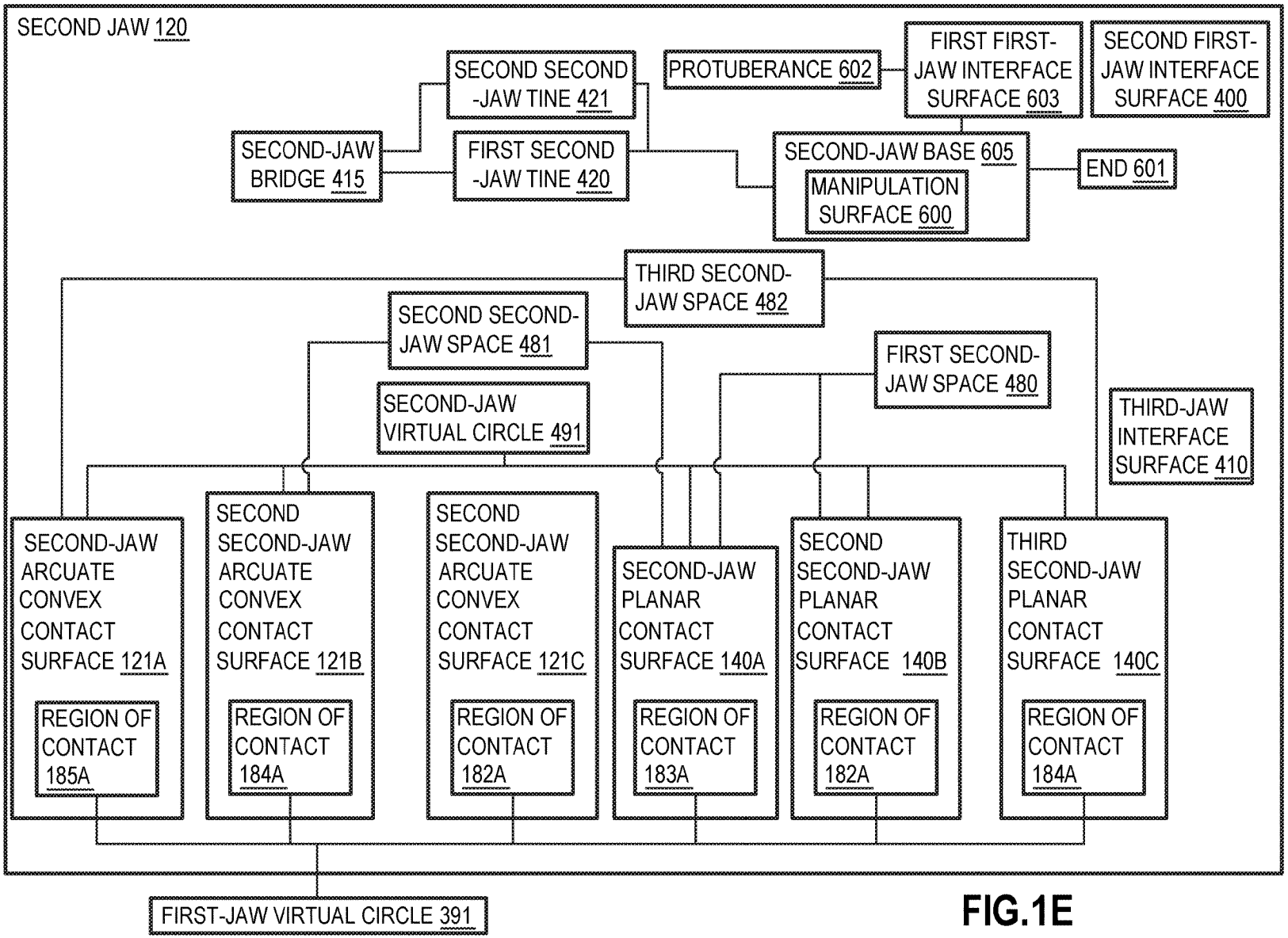
Figure 1F:
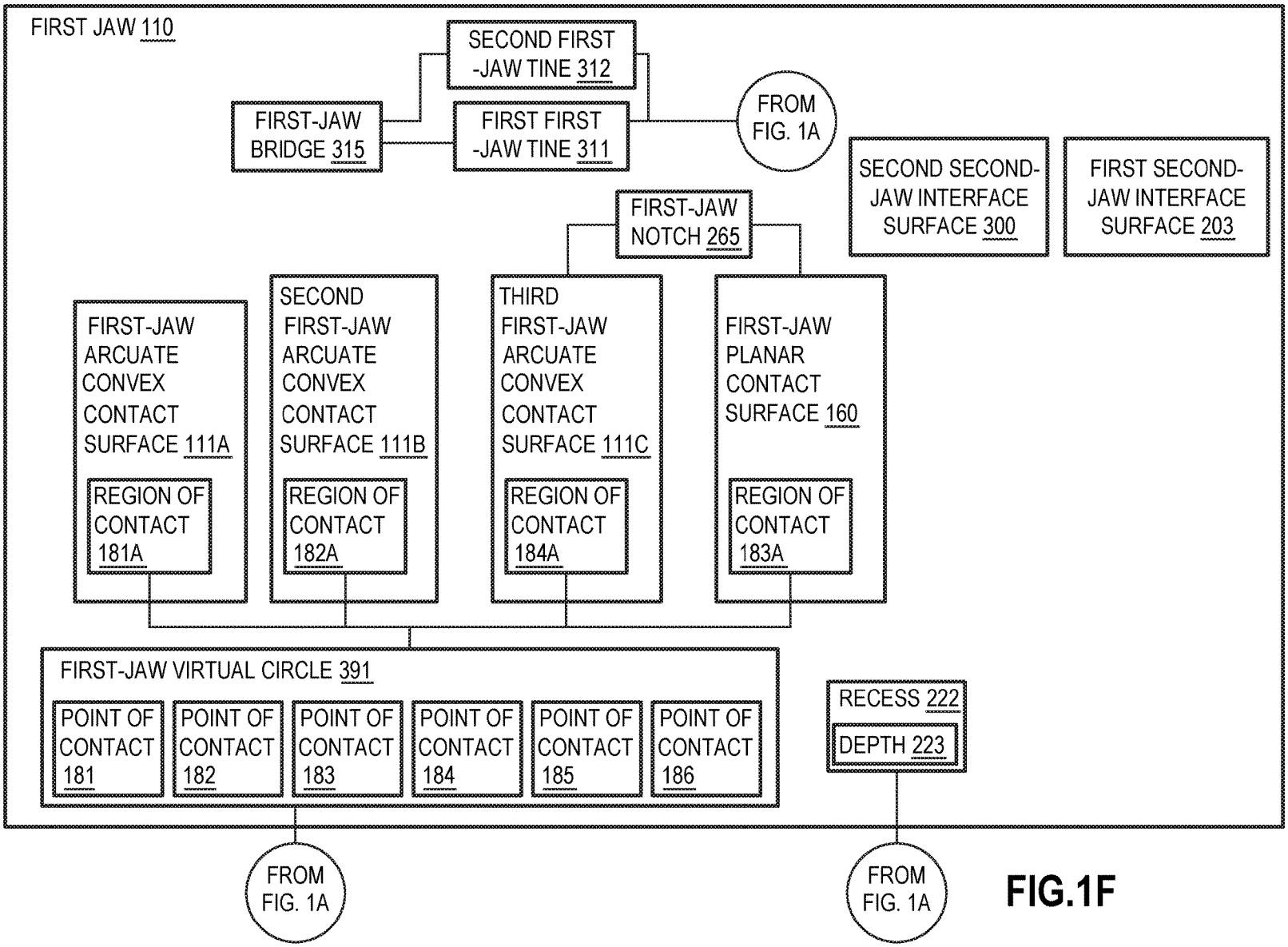
Figure 2A:
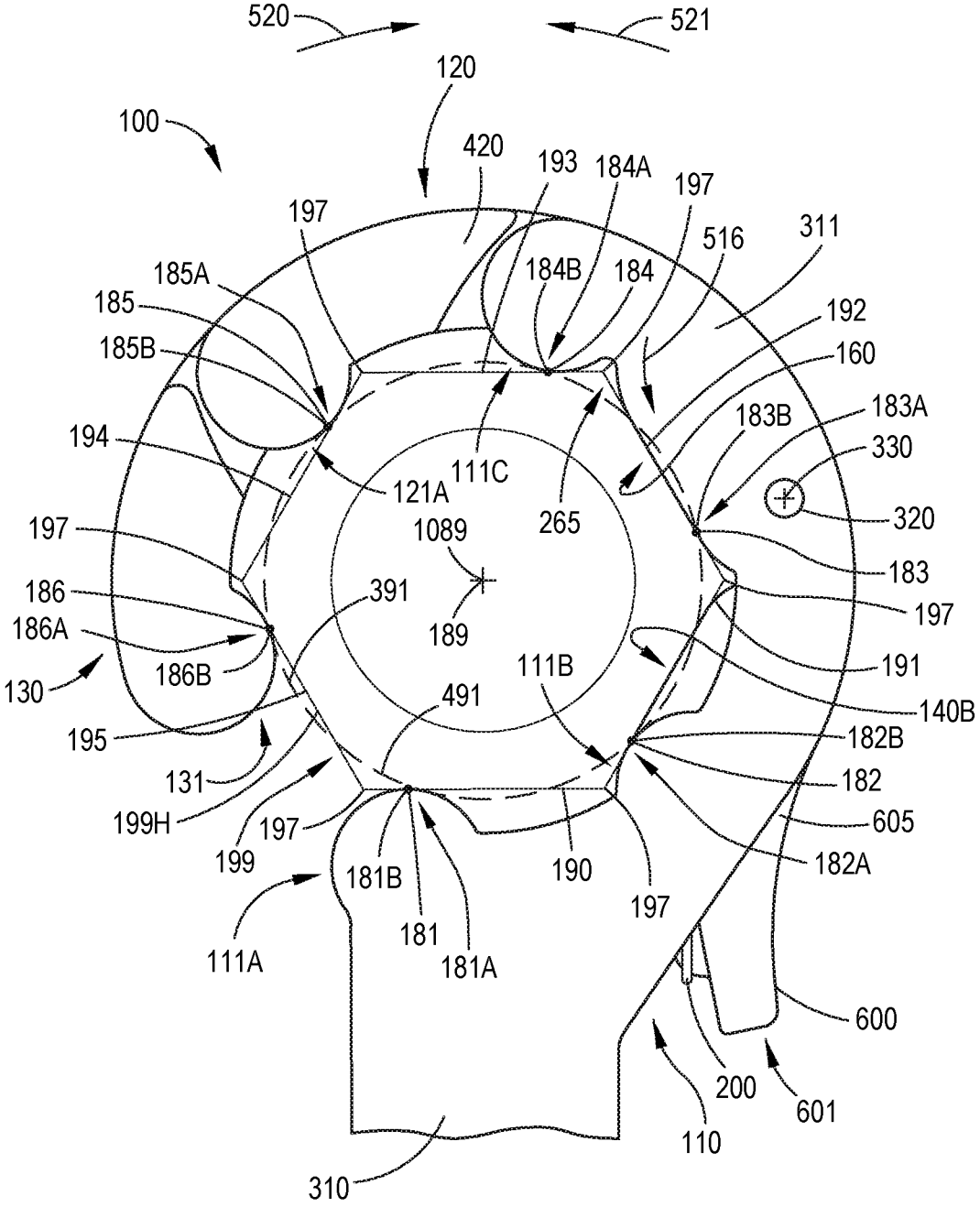
Figure 2B:
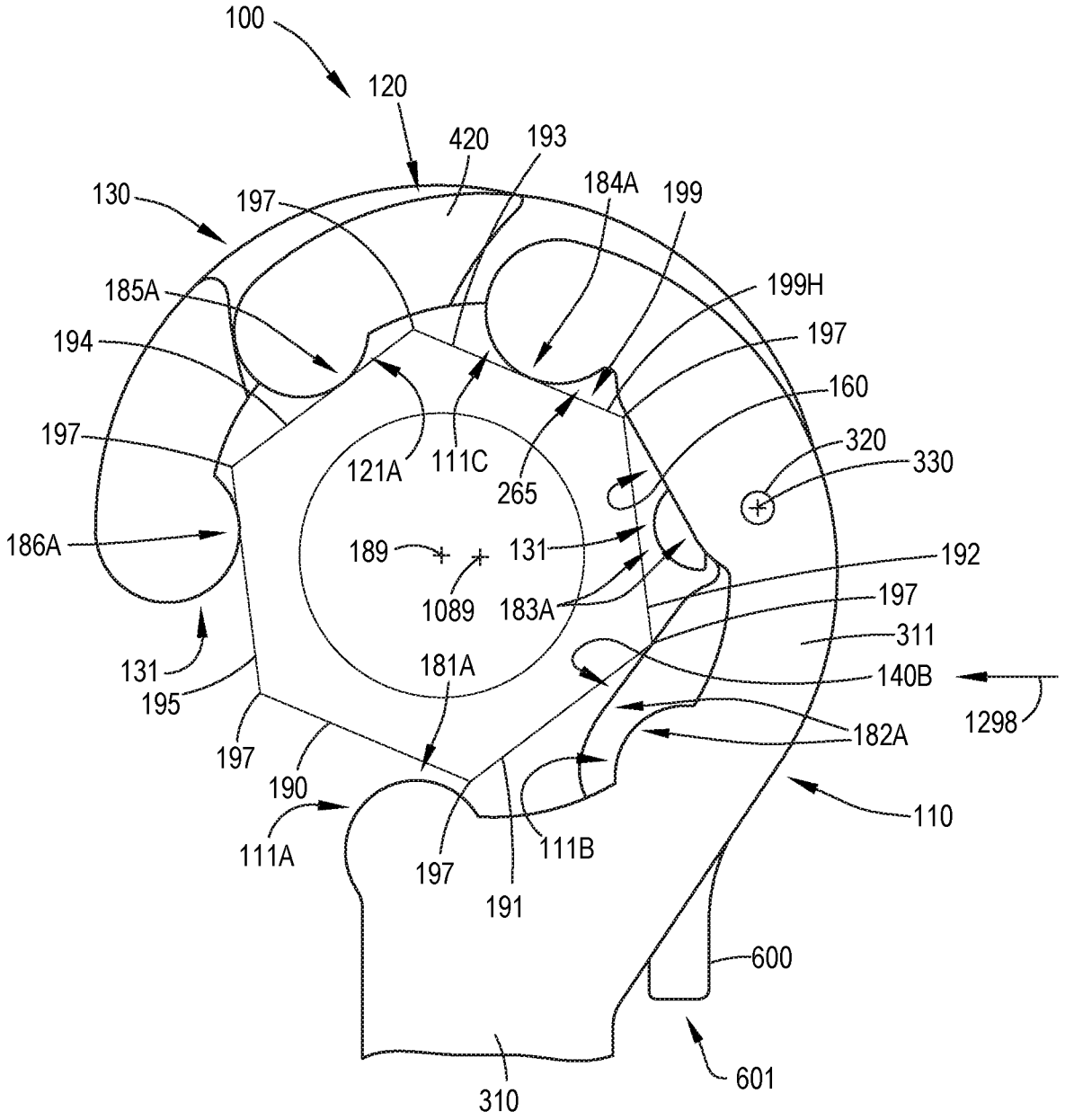
Figure 2C:
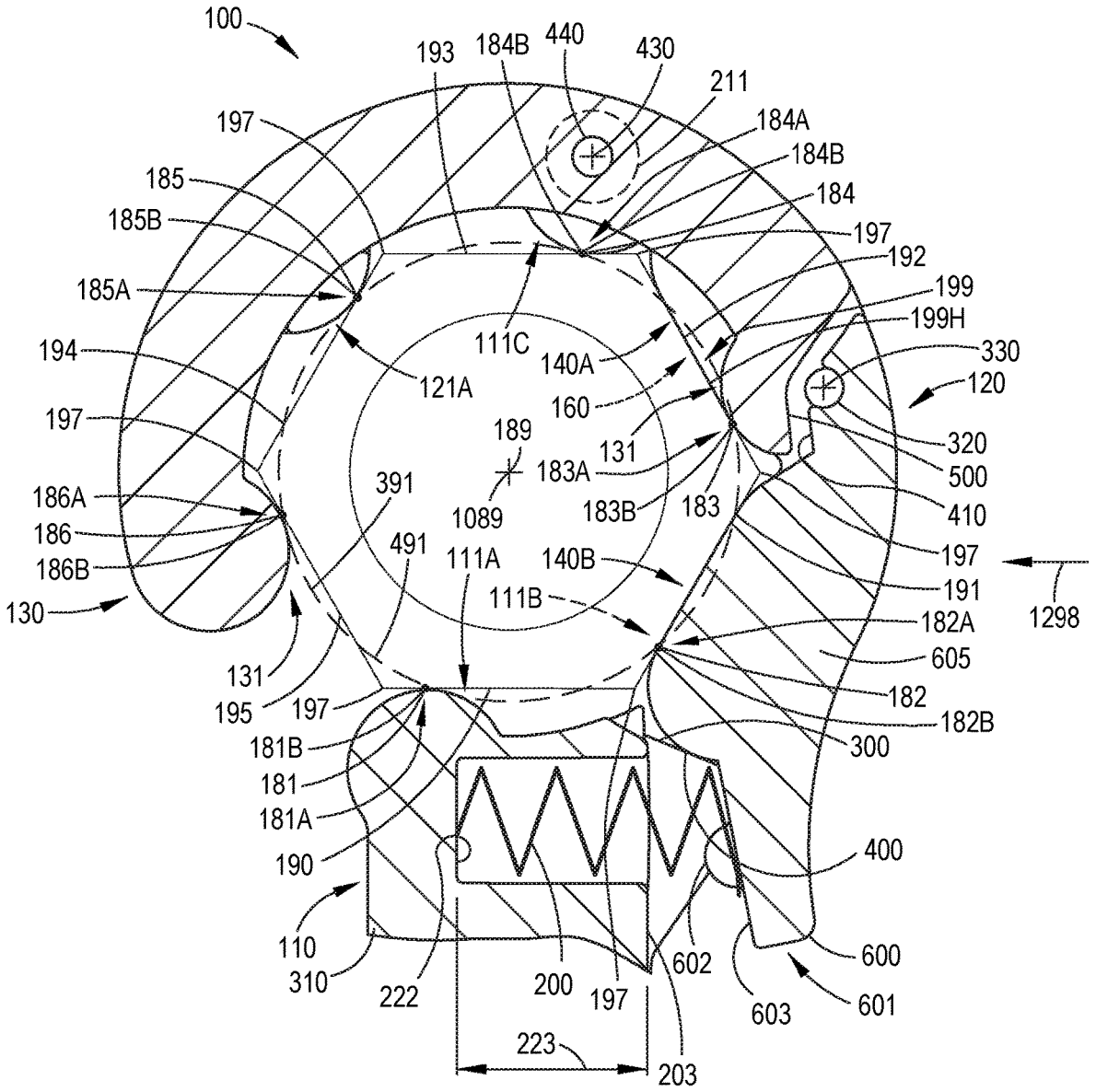
Figure 2D:
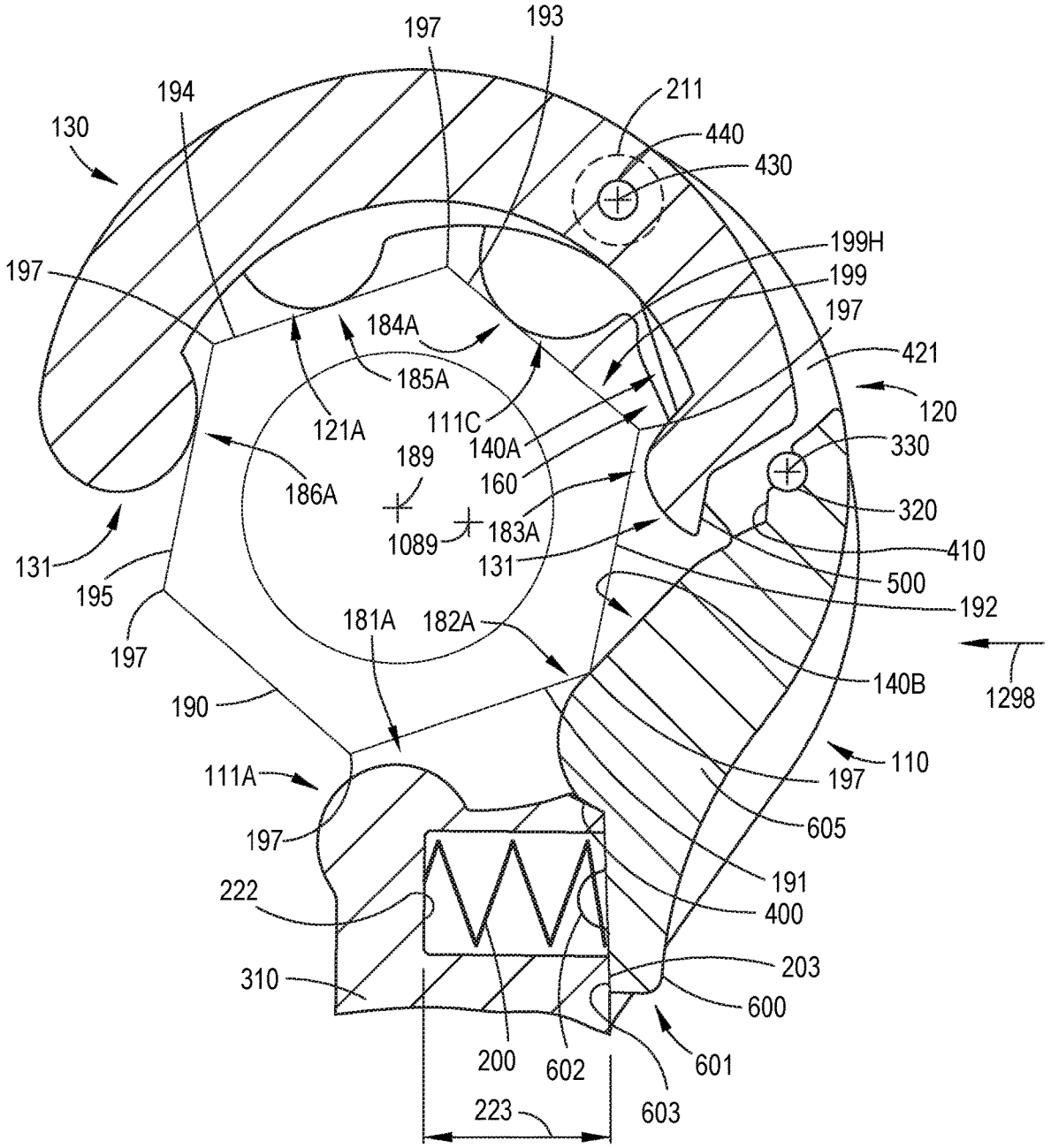
Figure 2F:
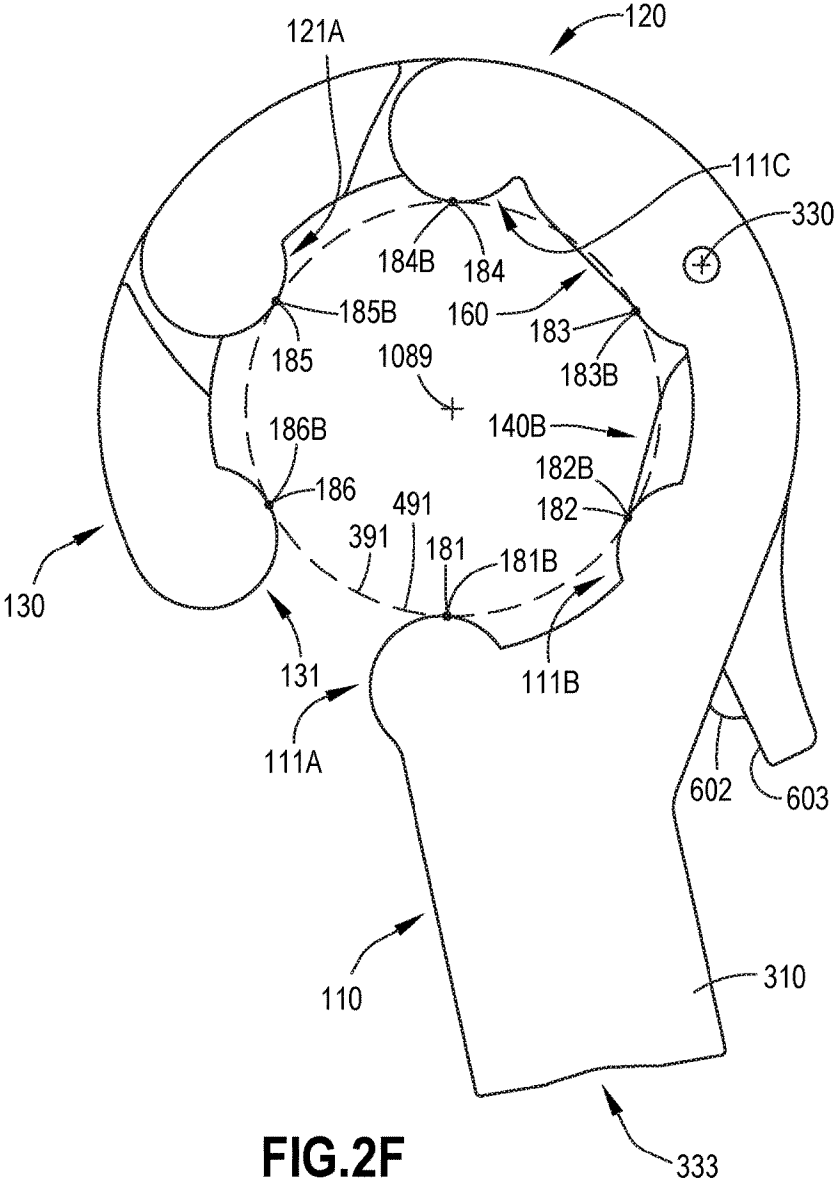
Figure 2E:
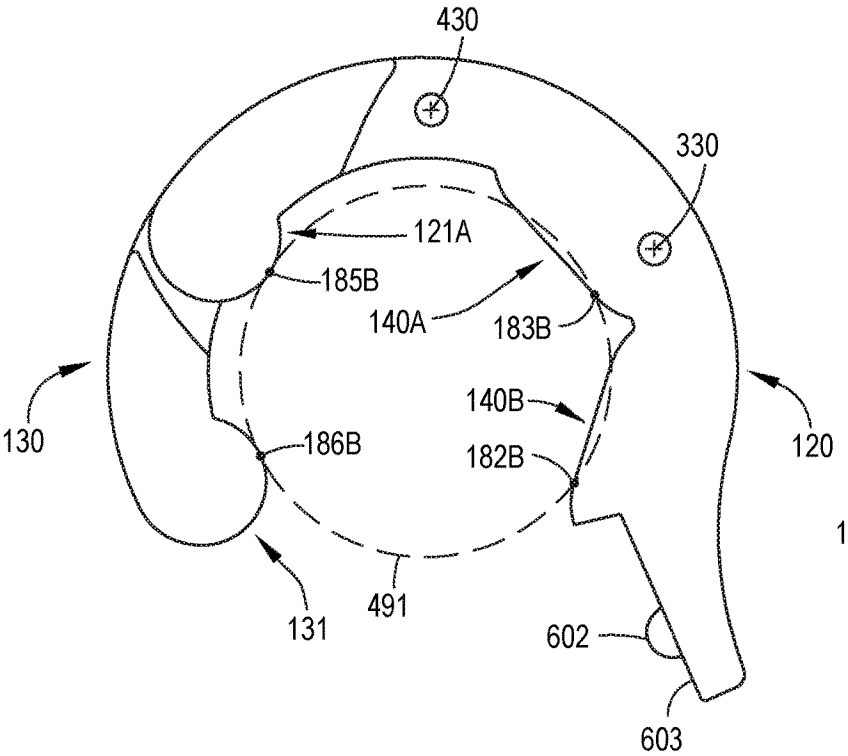
Figure 2G:
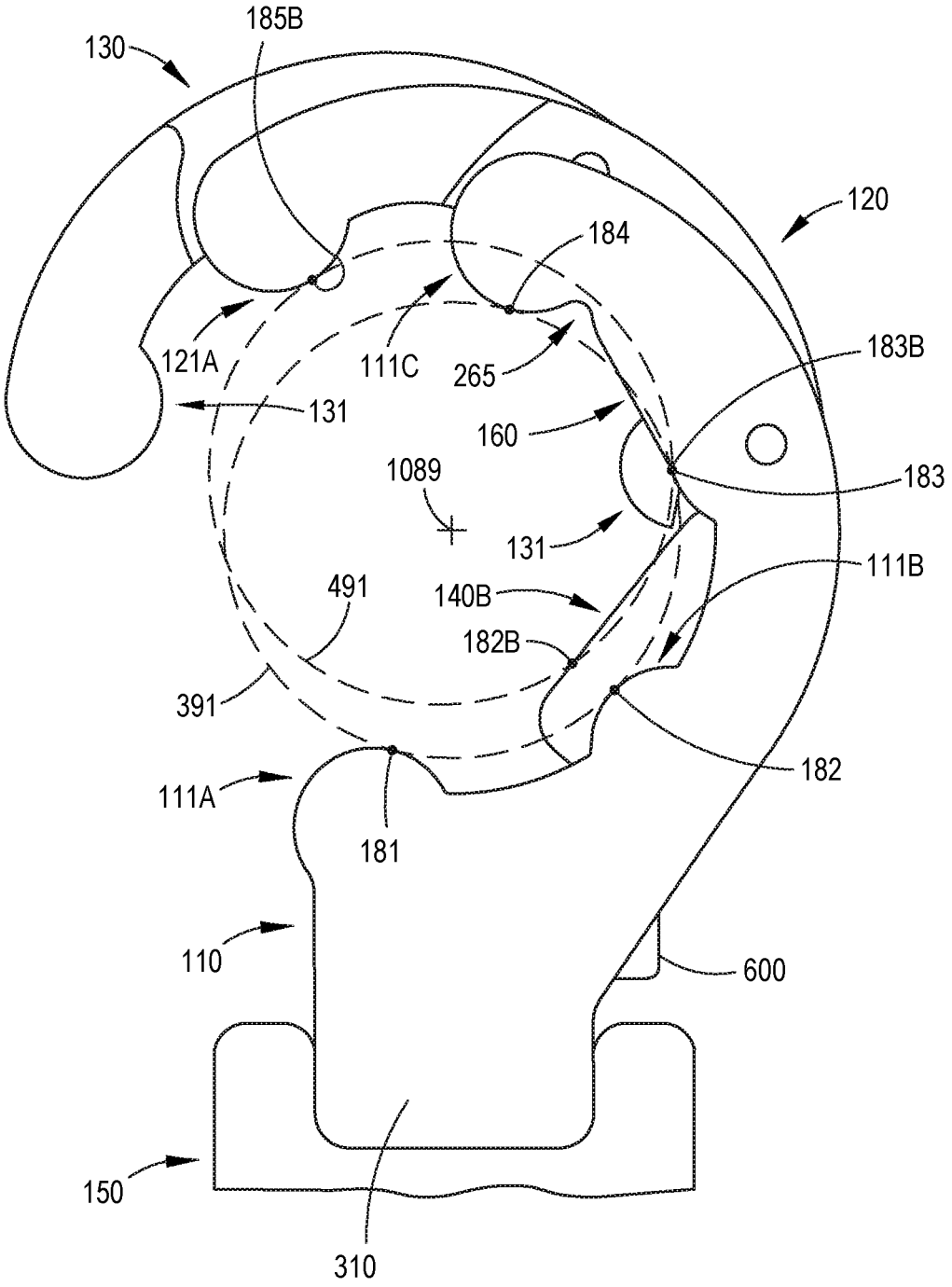

Having thus described one or more examples of the subject matter, disclosed herein, in general terms, reference will now be made to the accompanying drawings, which are not necessarily drawn to scale, and wherein like reference characters designate the same or similar parts throughout the several views, and wherein:

FIGS. 1A-1, 1A-2, 1B, 1C, 1E, and 1F, collectively, are a block diagram of a wrench head and a wrench to which the wrench head is coupled, according to one or more examples of the subject matter, disclosed herein;

FIG. 1D is a block diagram of an exemplary fastener to which the wrench head of FIGS. 1A-1, 1A-2, 1B, 1C, 1E, and 1F, according to one or more examples of the subject matter, disclosed herein, can be applied;

FIG. 2A is a schematic, plan view of a first jaw, a second jaw, and a third jaw of the wrench head of FIGS. 1A-1, 1A-2, 1B, 1C, 1E, and 1F in a closed orientation, according to one or more examples of the subject matter, disclosed herein;

FIG. 2B is a schematic, plan view of the first jaw, the second jaw, and the third jaw of the wrench head of FIGS. 1A-1, 1A-2, 1B, 1C, 1E, and 1F in an open orientation, according to one or more examples of the subject matter, disclosed herein;

FIG. 2C is a schematic, sectional view of the wrench head of FIG. 2A with the first jaw, the second jaw, and the third jaw in a closed orientation, according to one or more examples of the subject matter, disclosed herein;

FIG. 2D is a schematic, sectional view of the wrench head of FIG. 2B with the first jaw, the second jaw, and the third jaw in an open orientation, according to one or more examples of the subject matter, disclosed herein;

FIG. 2E is a schematic, plan view of the second jaw and the third jaw of the wrench head of FIGS. 1A-1, 1A-2, 1B, 1C, 1E, and 1F, according to one or more examples of the subject matter, disclosed herein;

FIG. 2F is a schematic, plan view of the first jaw, the second jaw, and the third jaw of the wrench head of FIGS. 1A-1, 1A-2, 1B, 1C, 1E, and 1F in a closed orientation, according to one or more examples of the subject matter, disclosed herein;

FIG. 2G is a schematic, plan view of the first jaw, the second jaw, and the third jaw of the wrench head of FIGS.

Figure 2I:
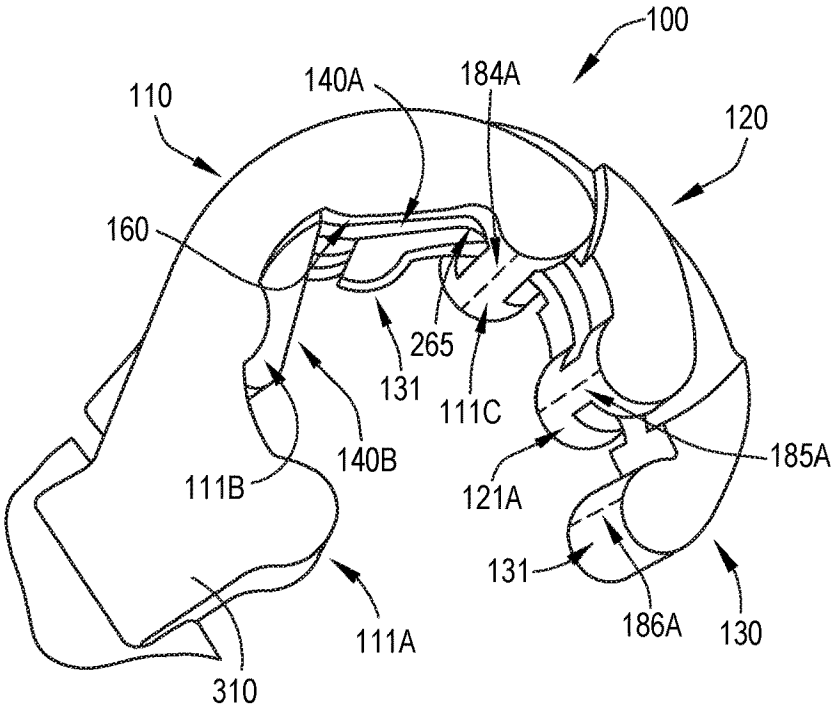
Figure 2H:
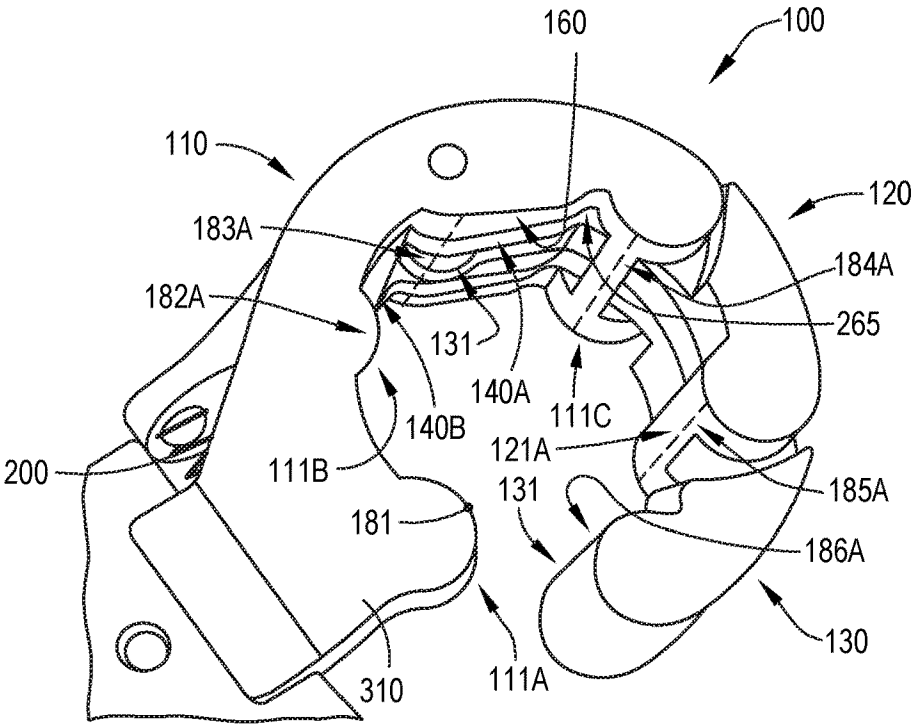
Figure 2J:
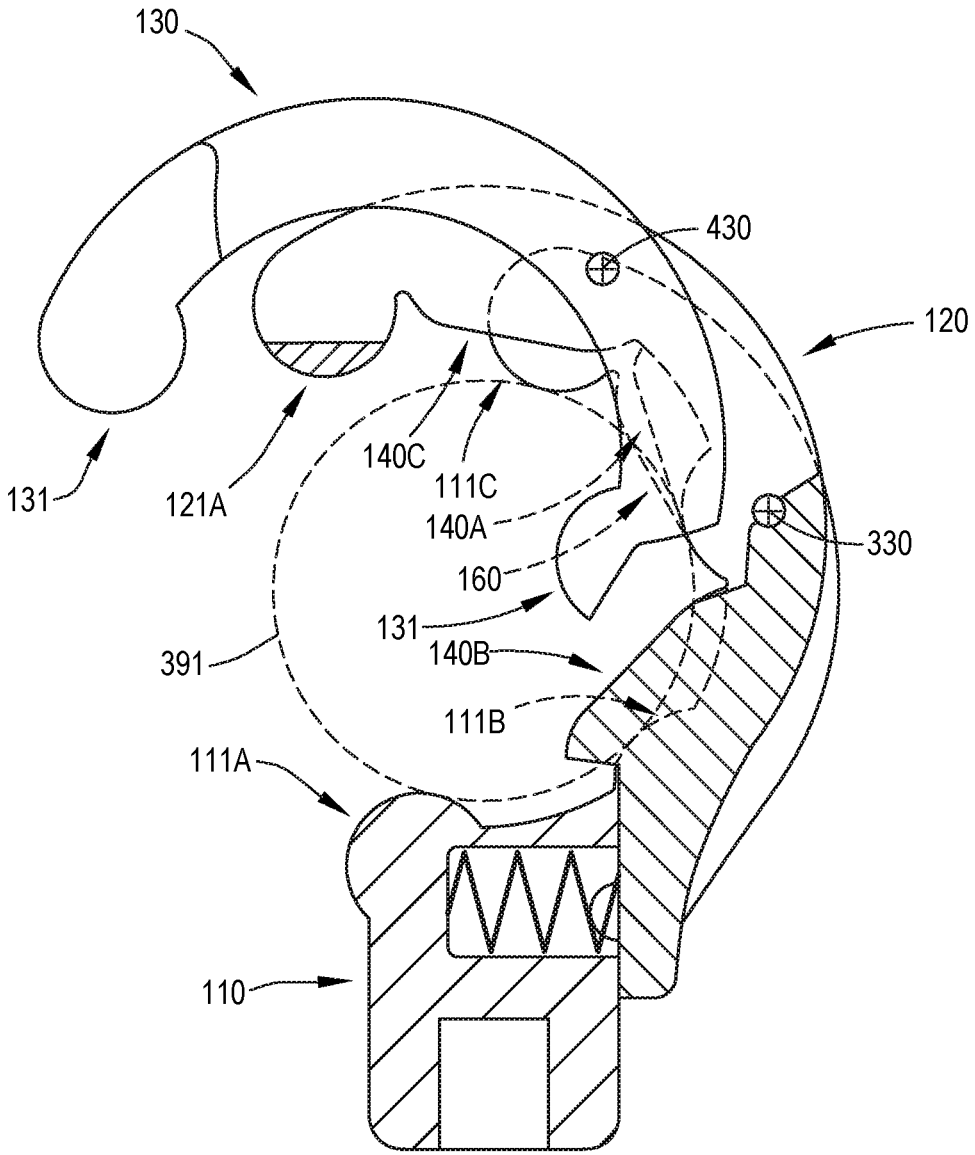
Figure 2K:
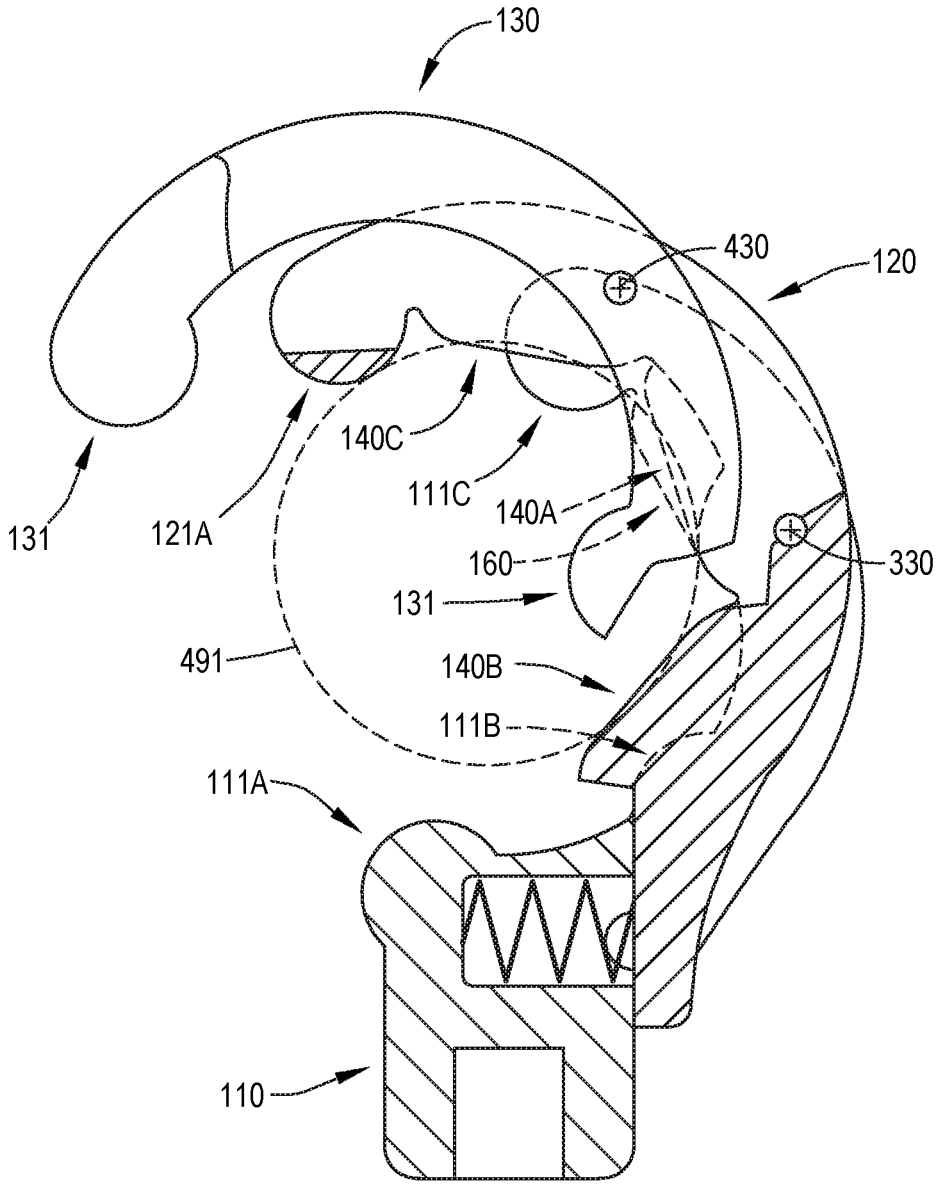
Figure 2L:
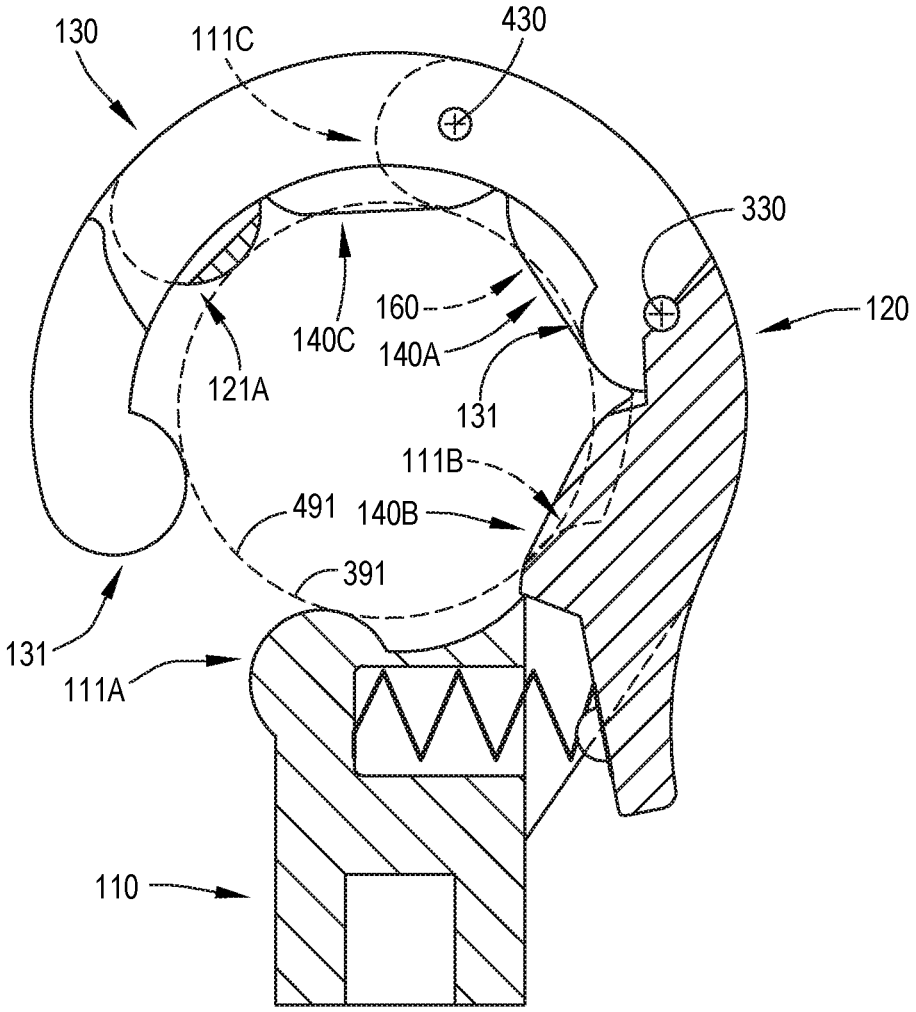
Figure 3A:
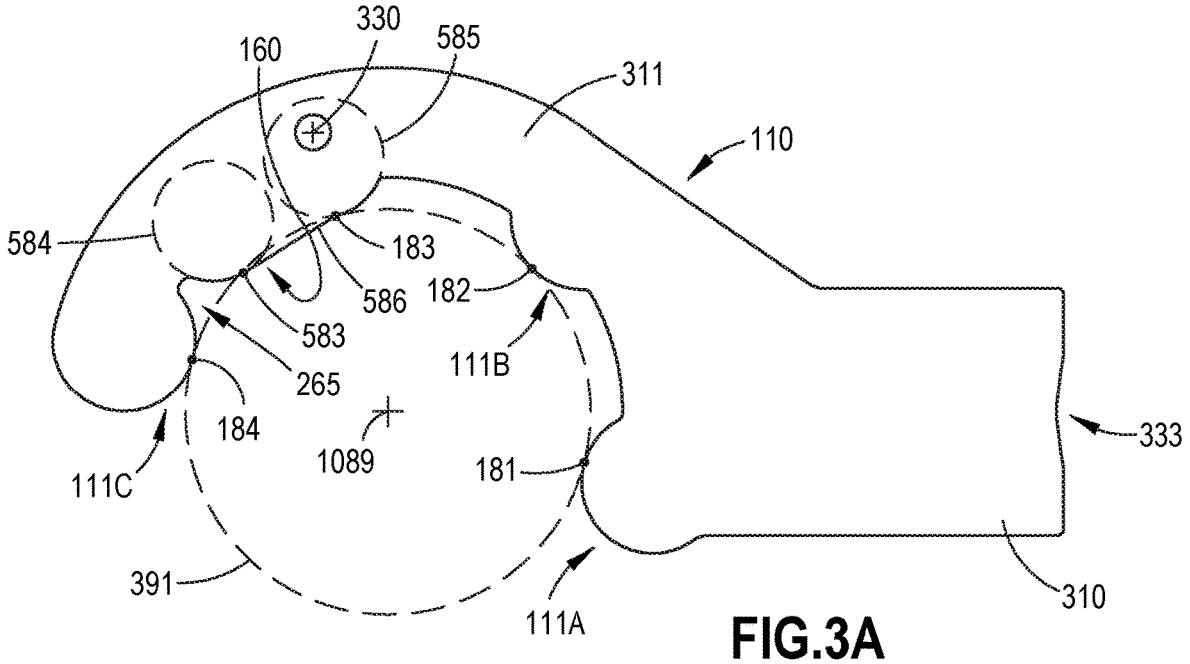
Figure 3B:
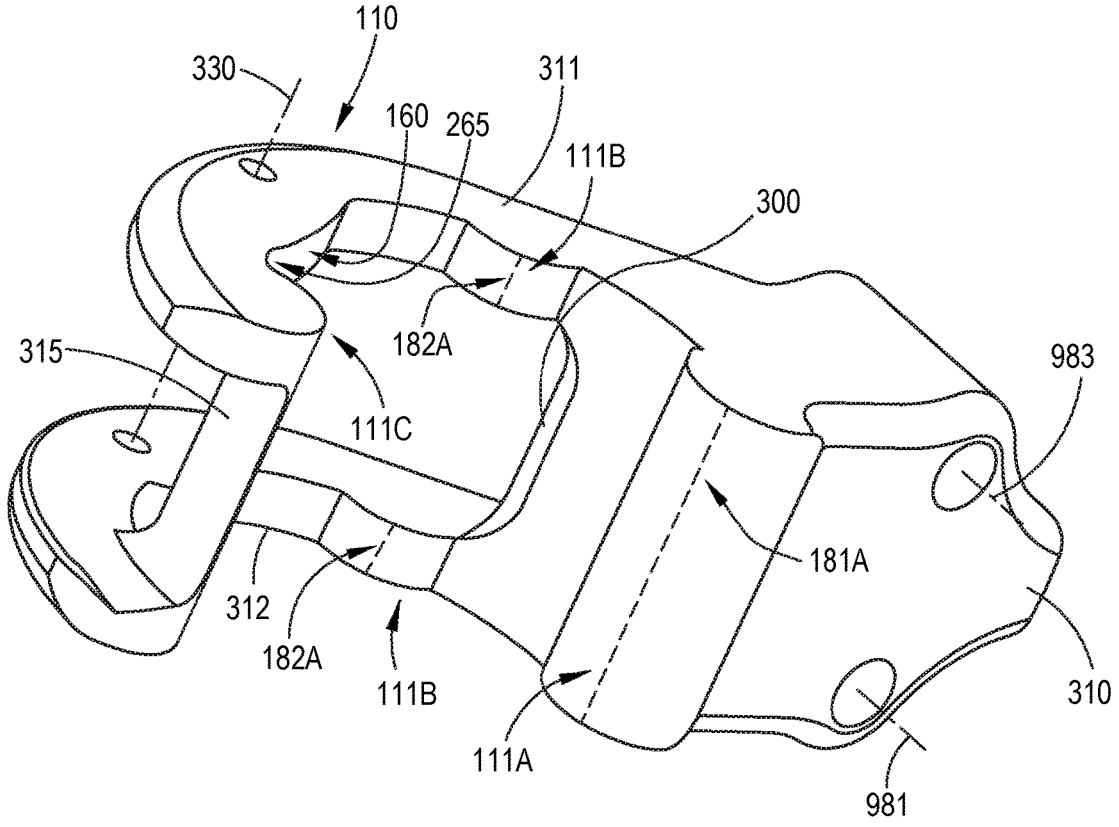
Figure 3C:
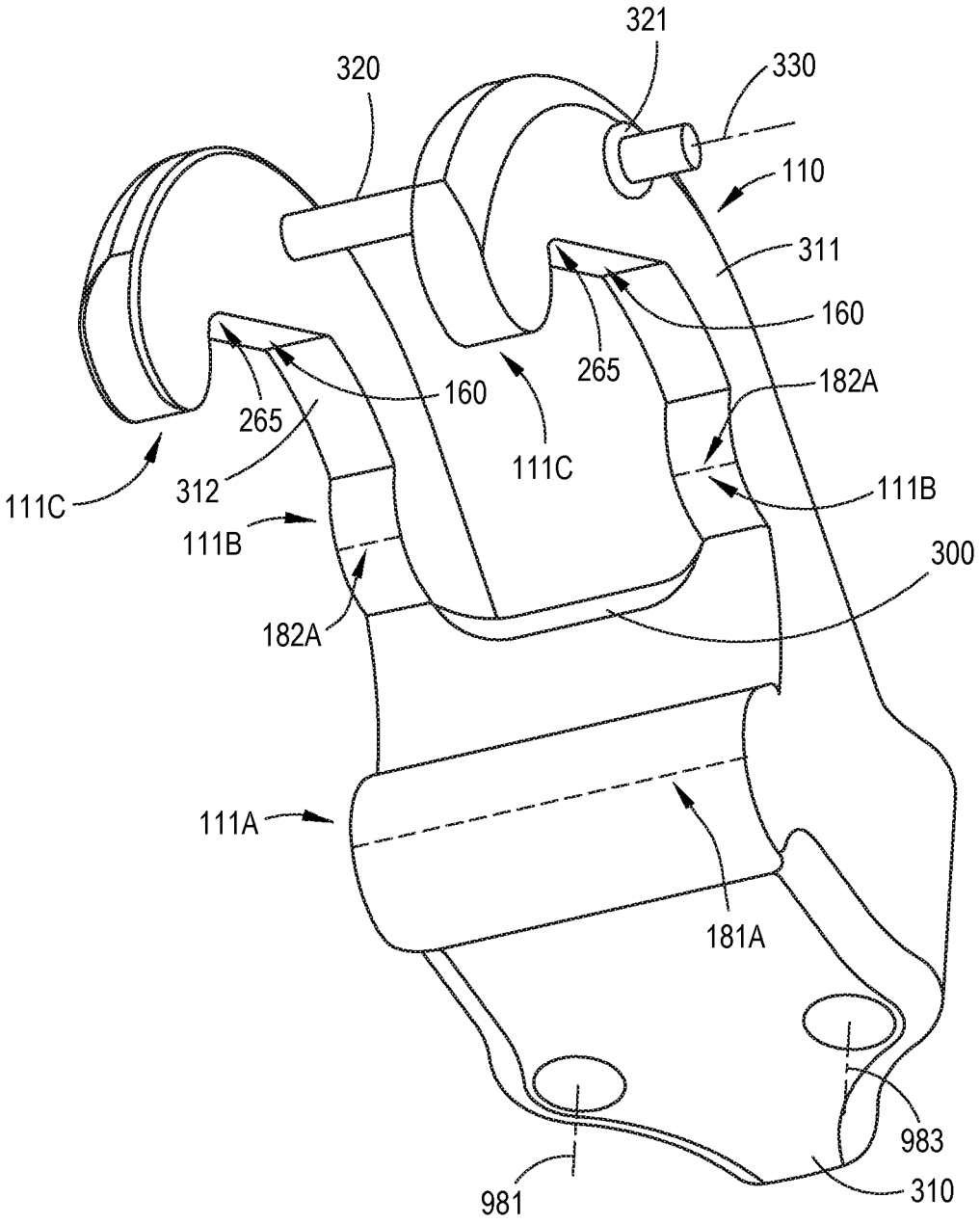
Figure 3D:
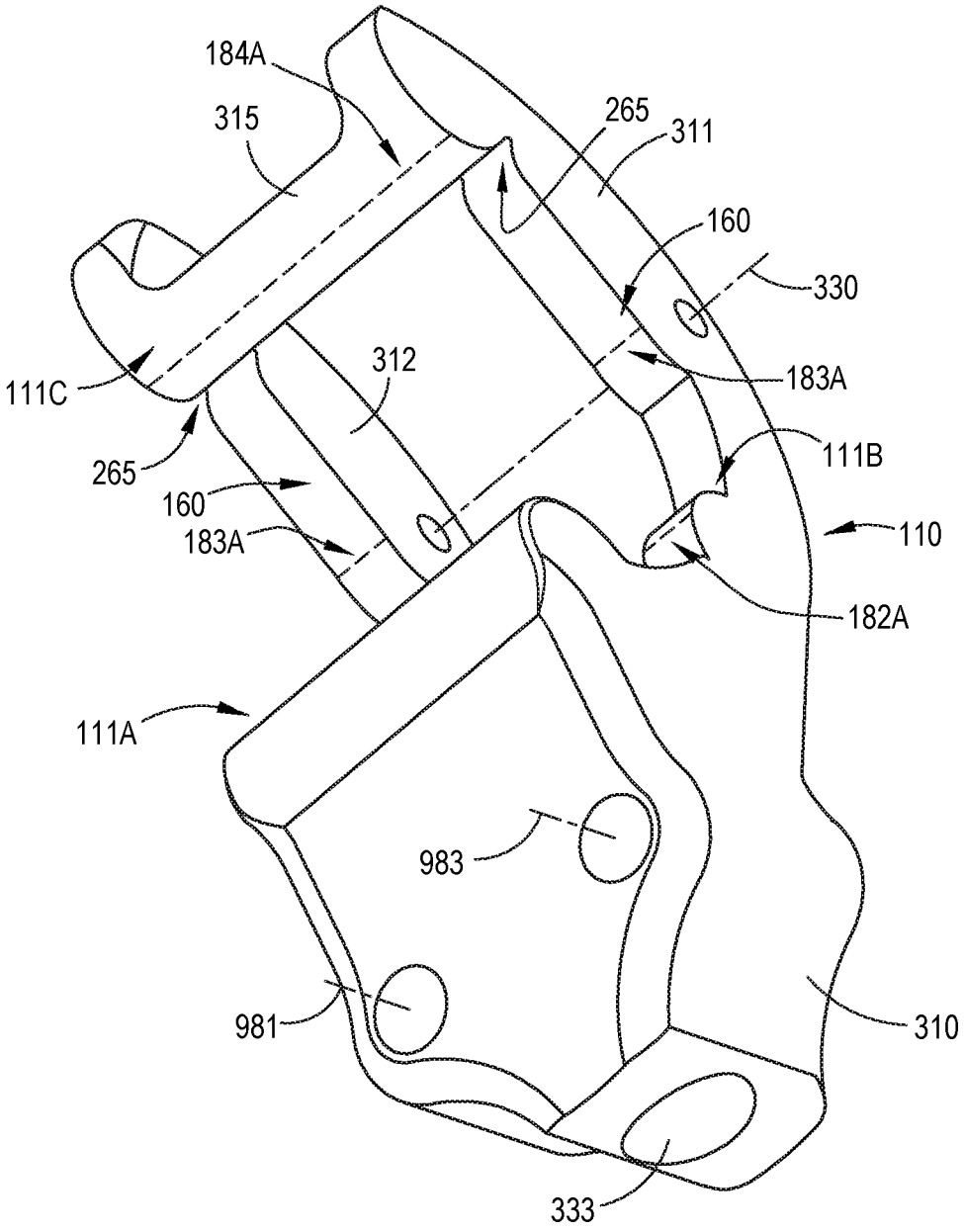
Figure 4A:
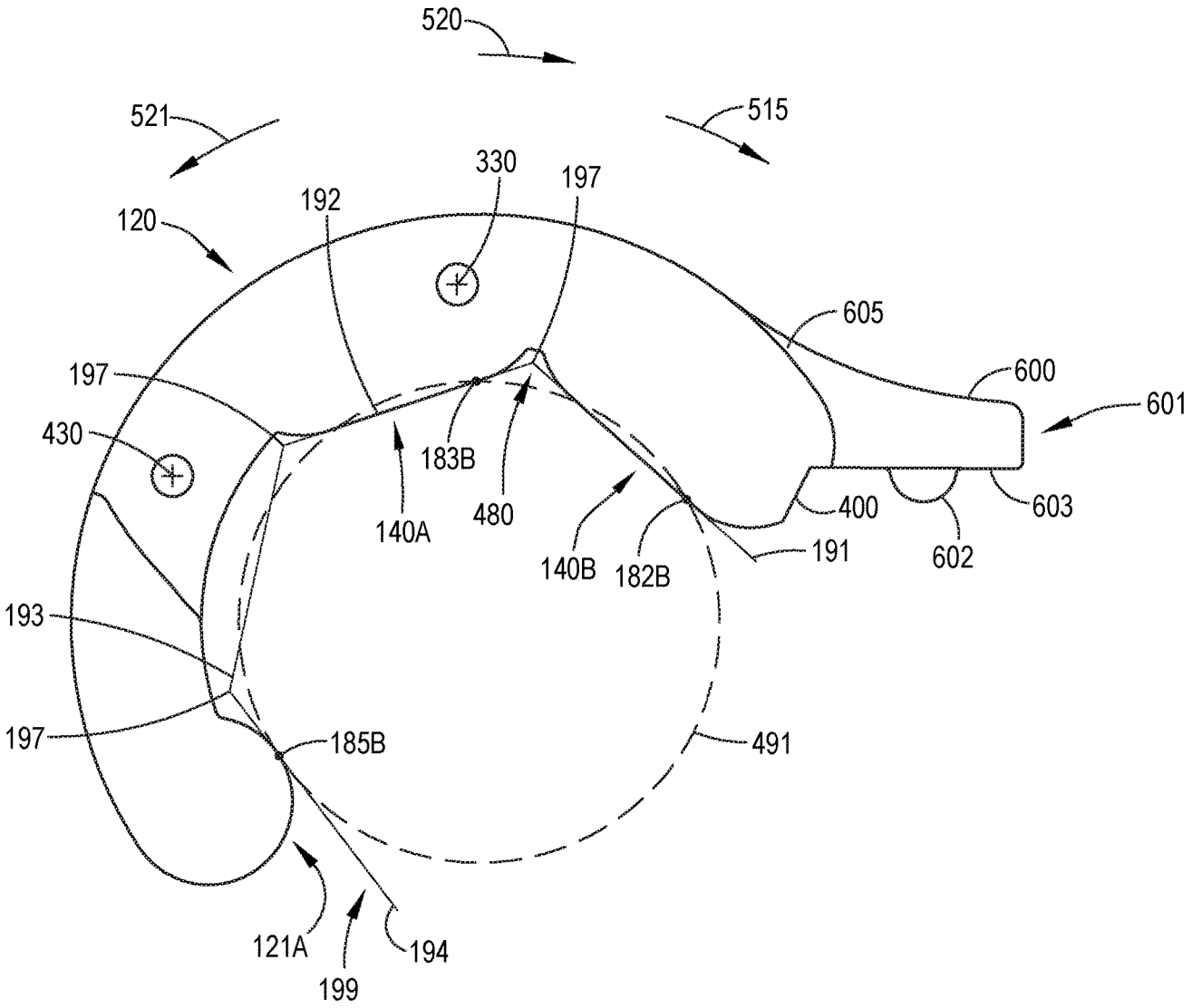
Figure 4B:
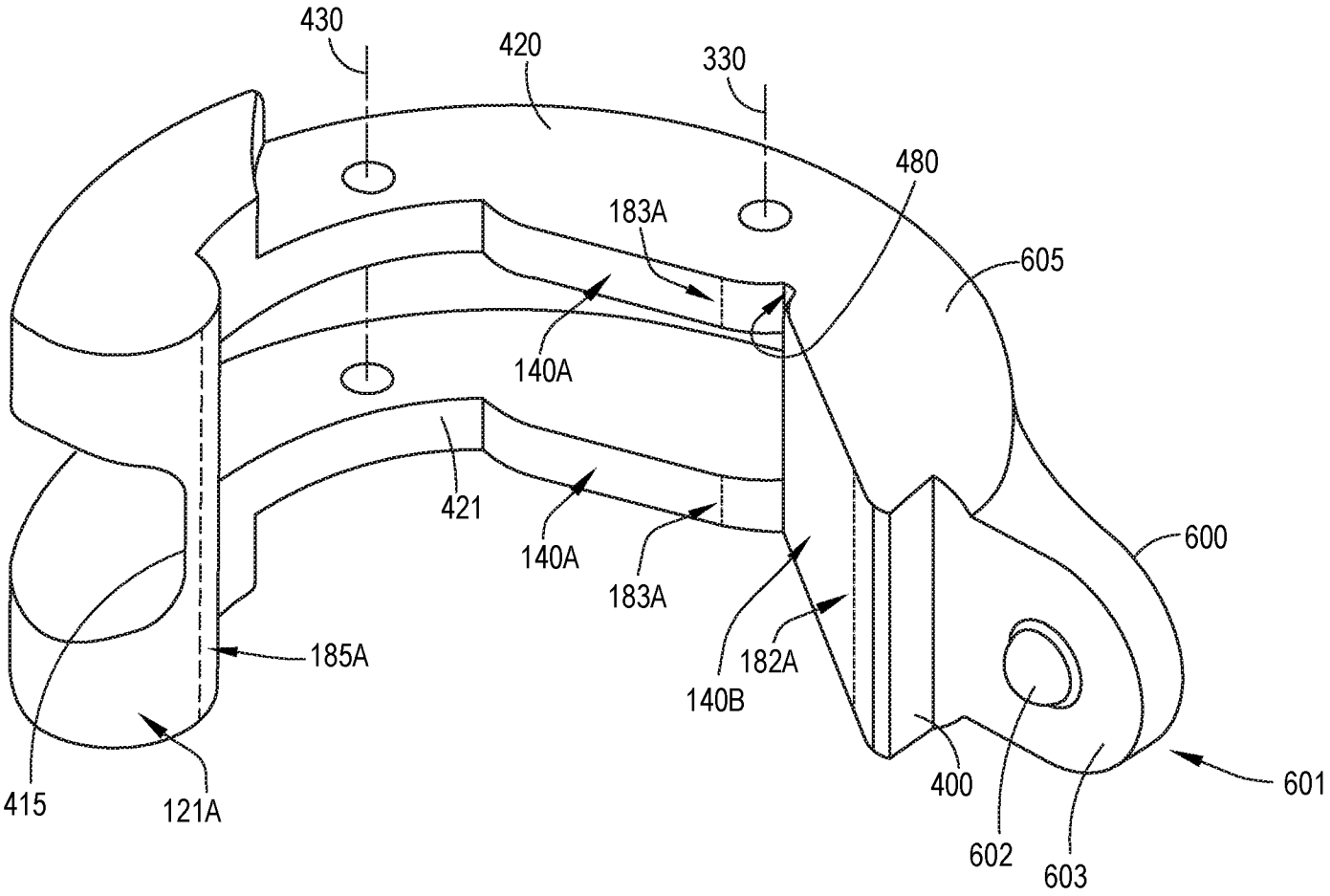
Figure 4C:
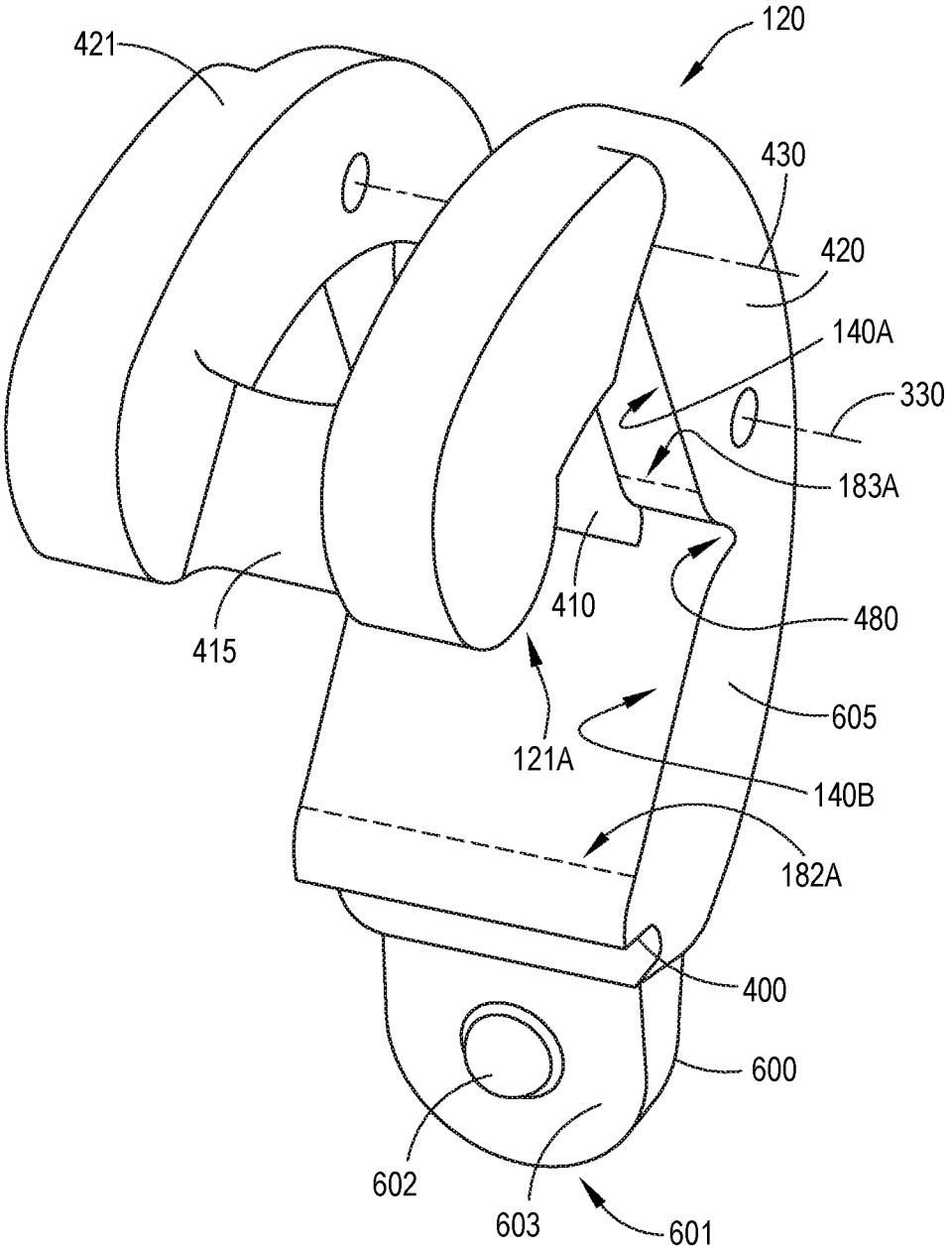
Figure 4D:
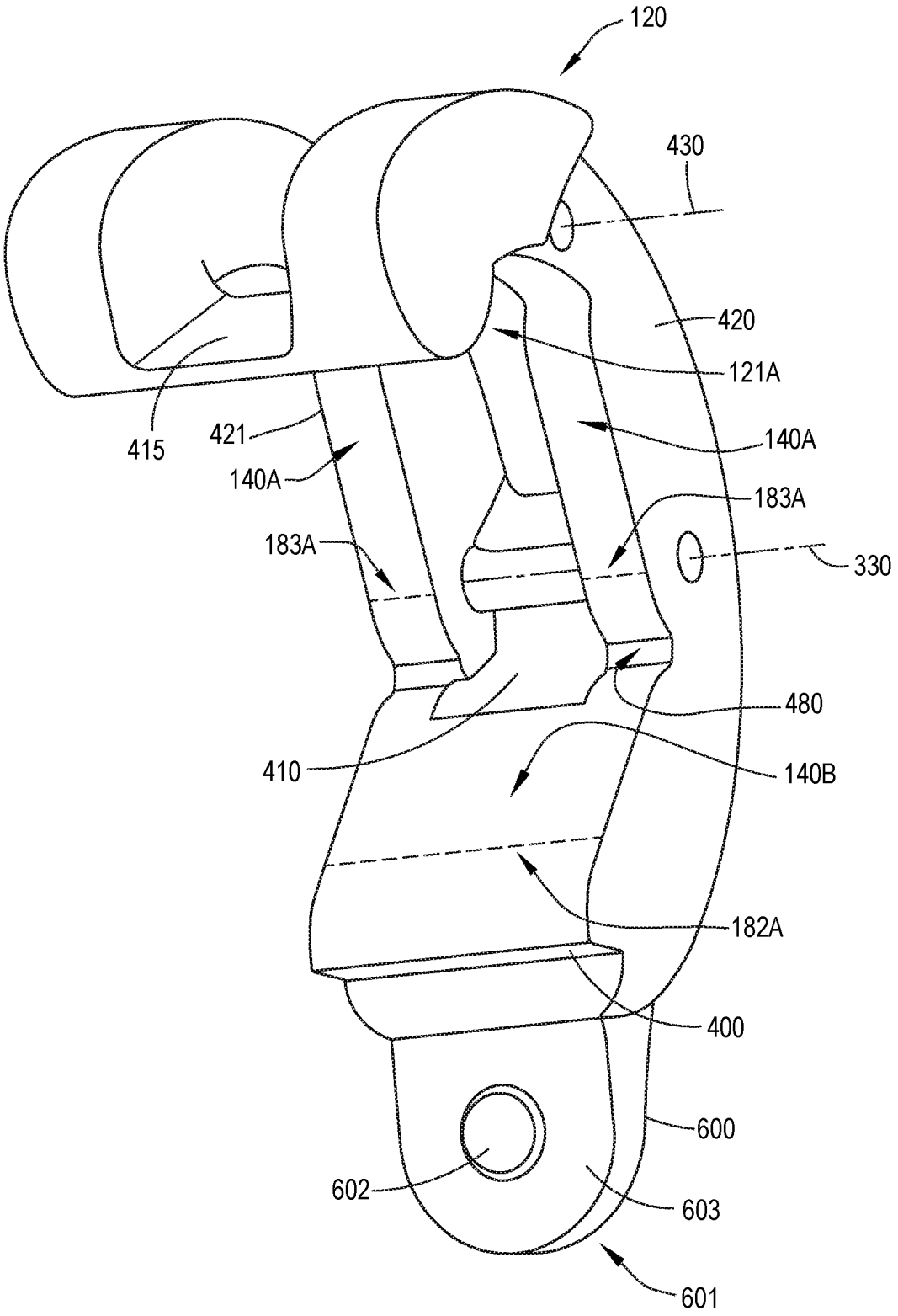
Figure 4E:
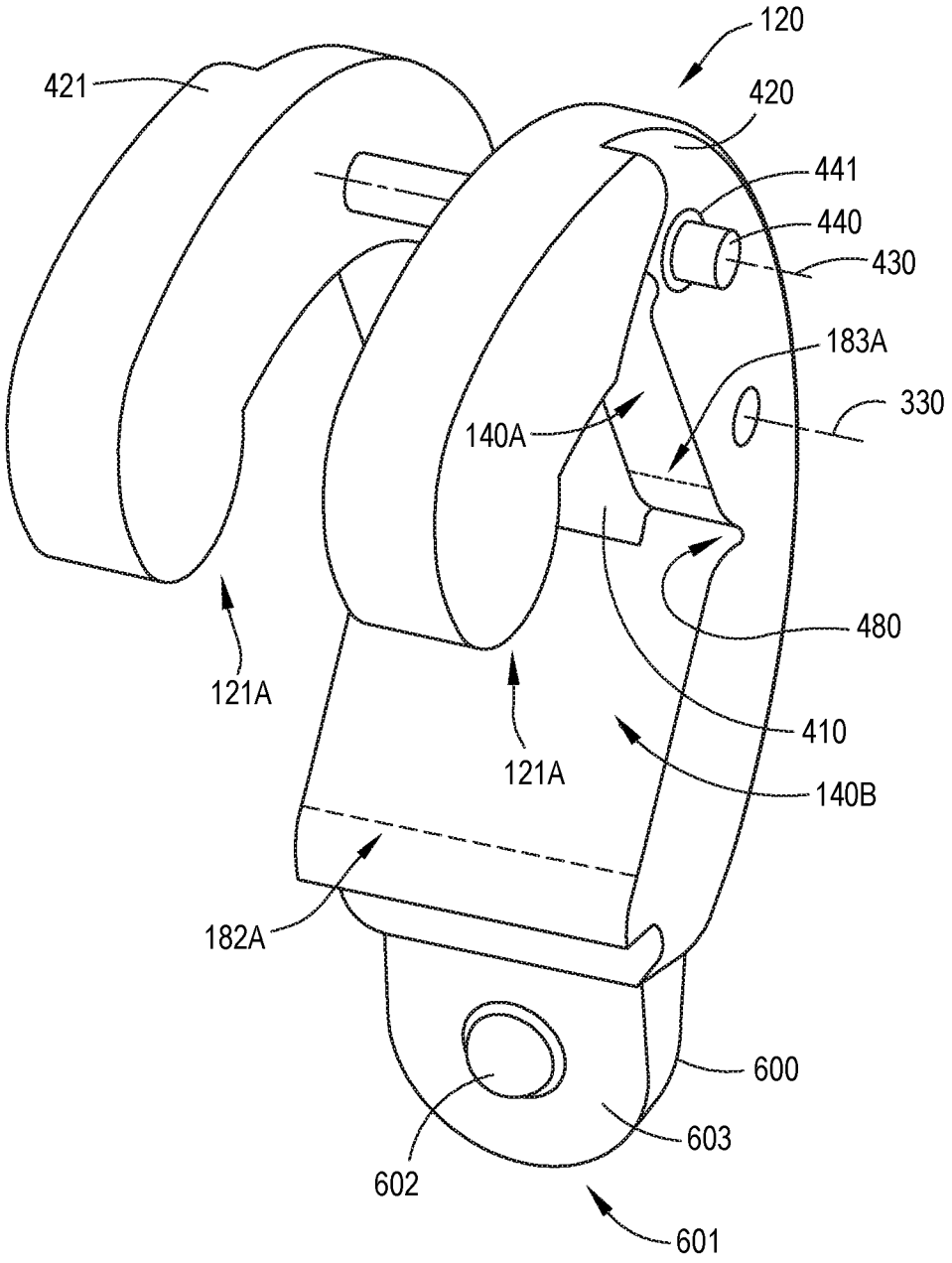
Figure 4F:
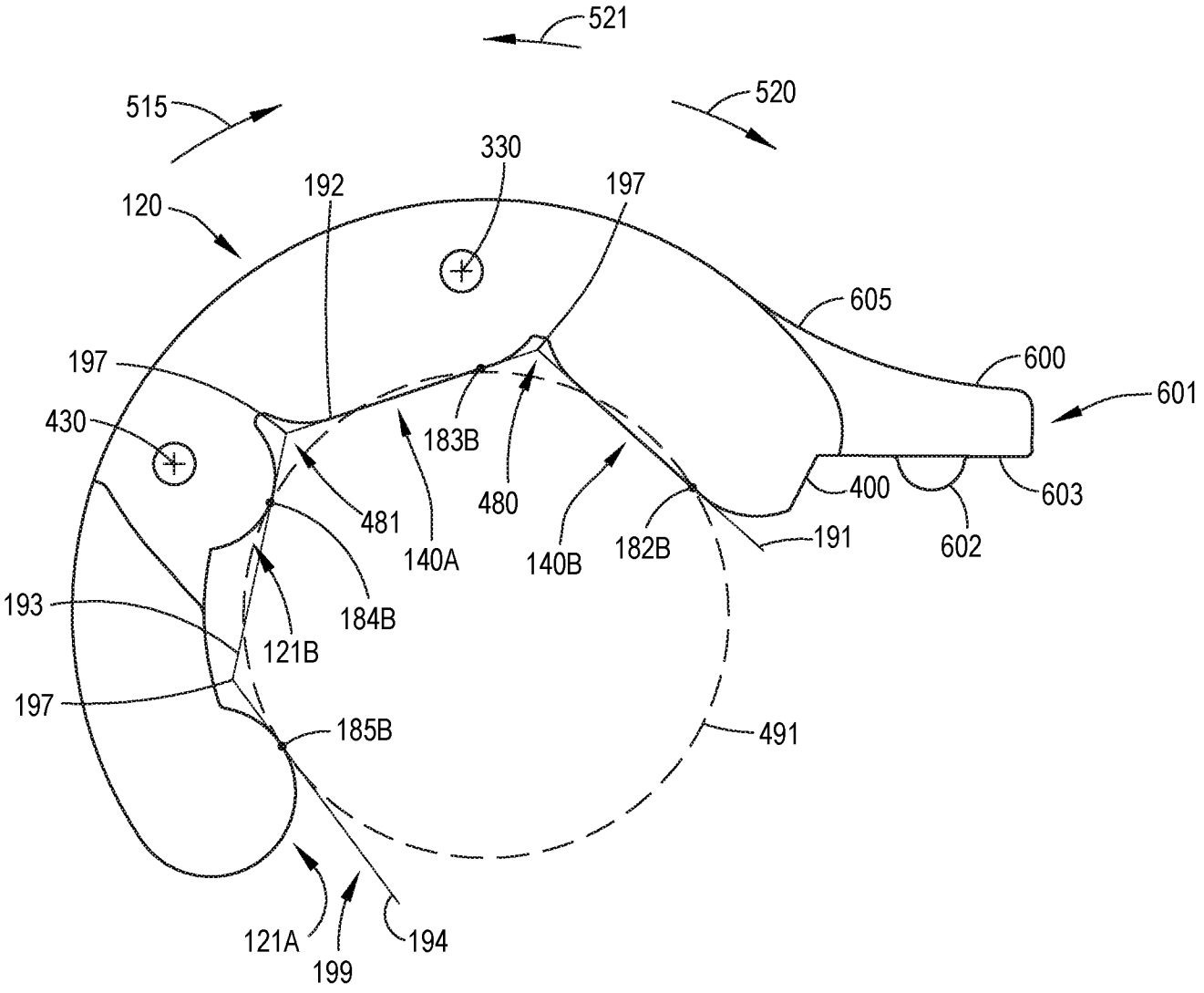
Figure 4G:
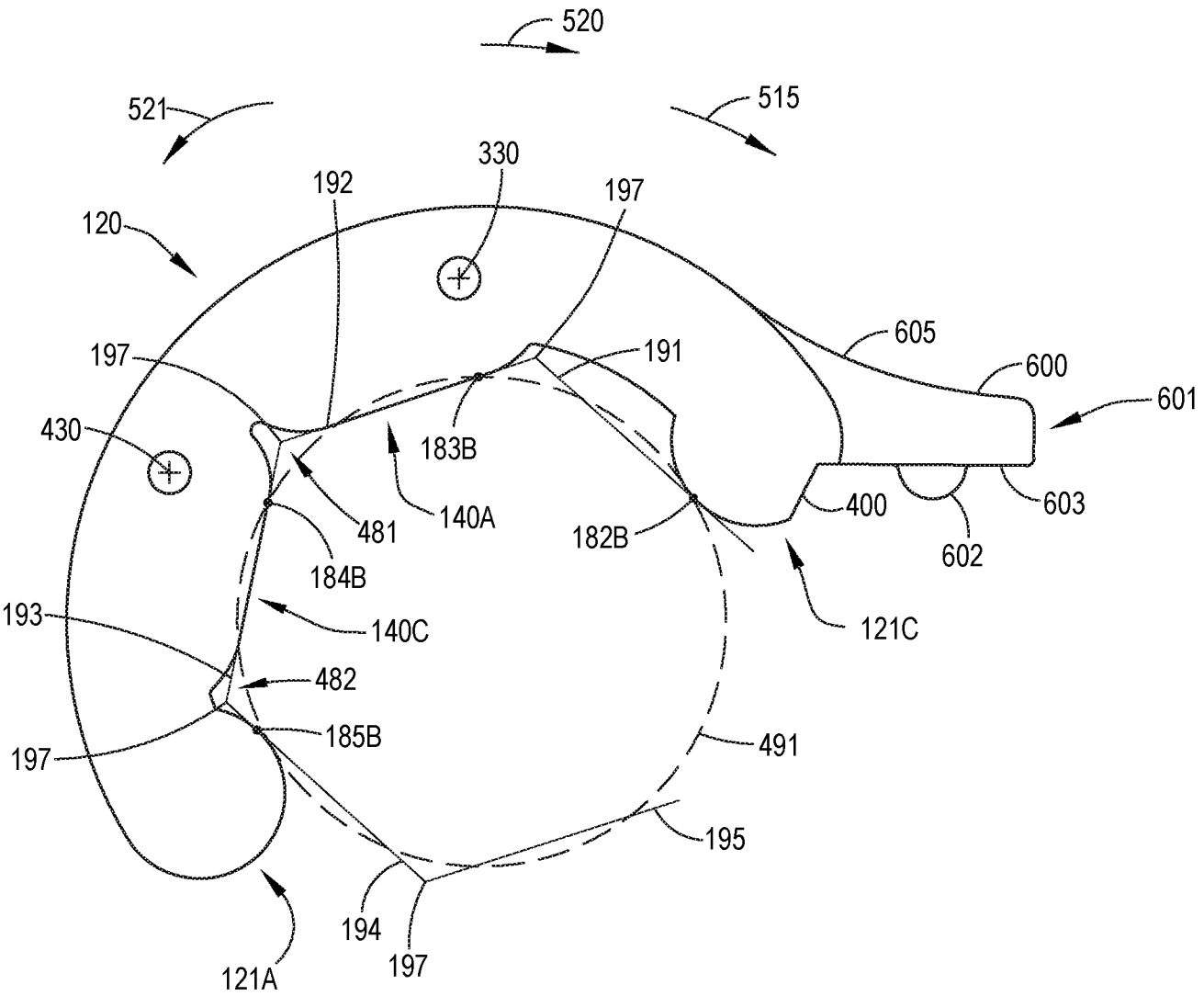
Figure 4H:
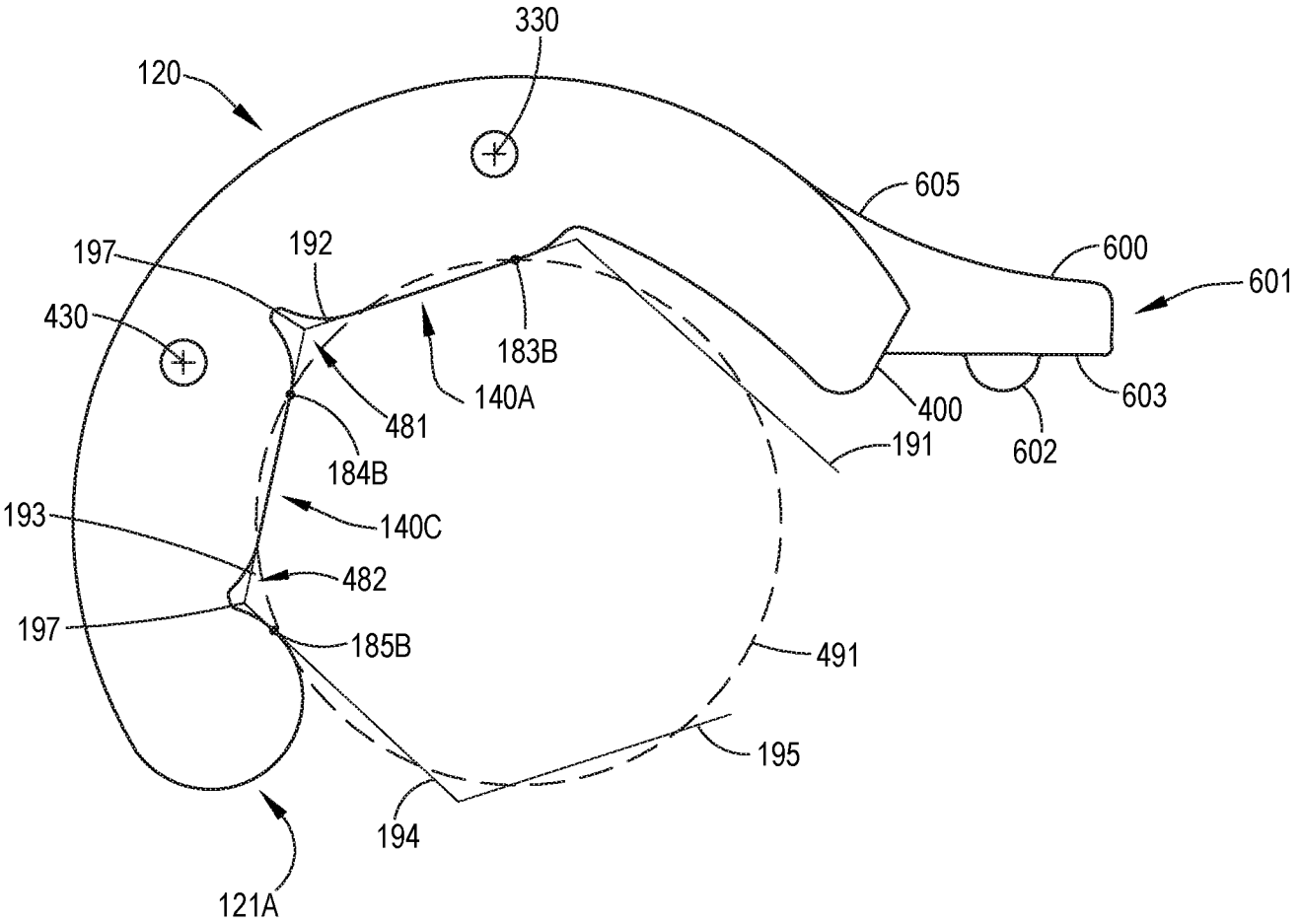
Figure 4I:
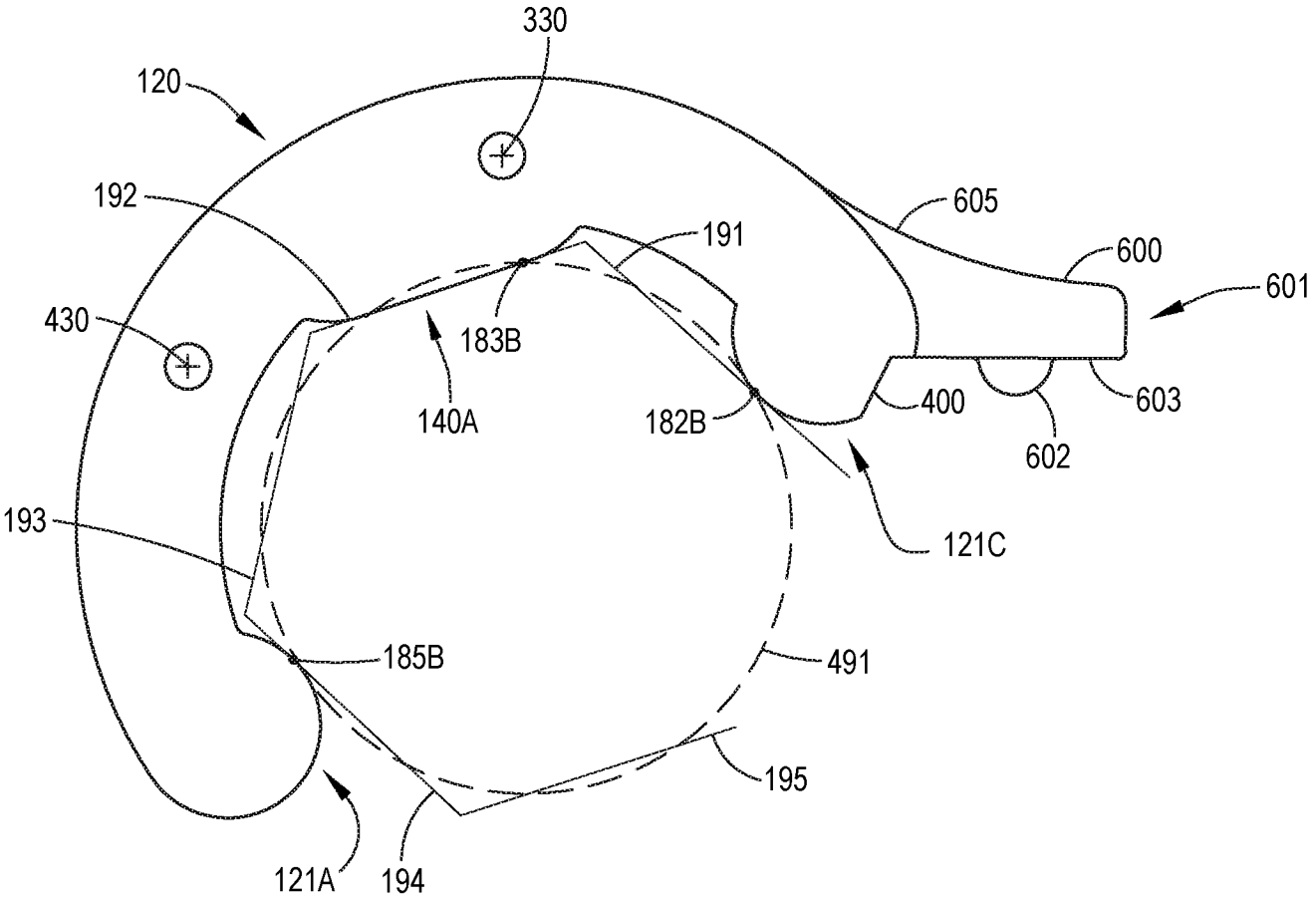
Figure 5A:
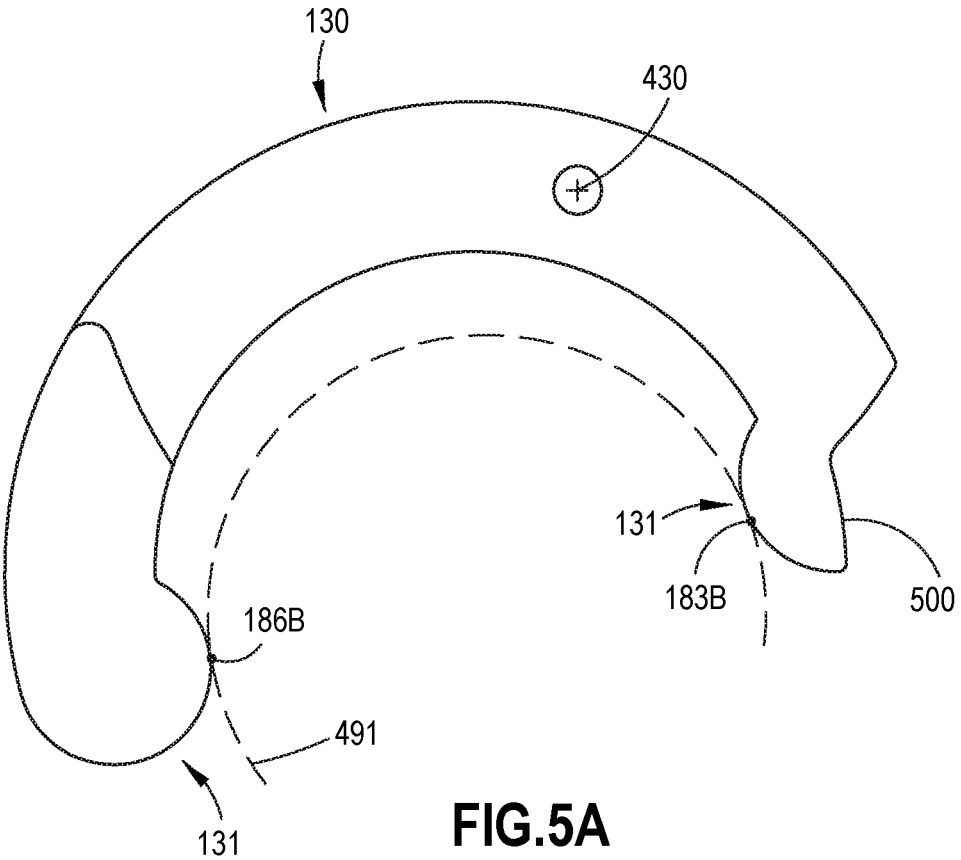
Figure 5B:
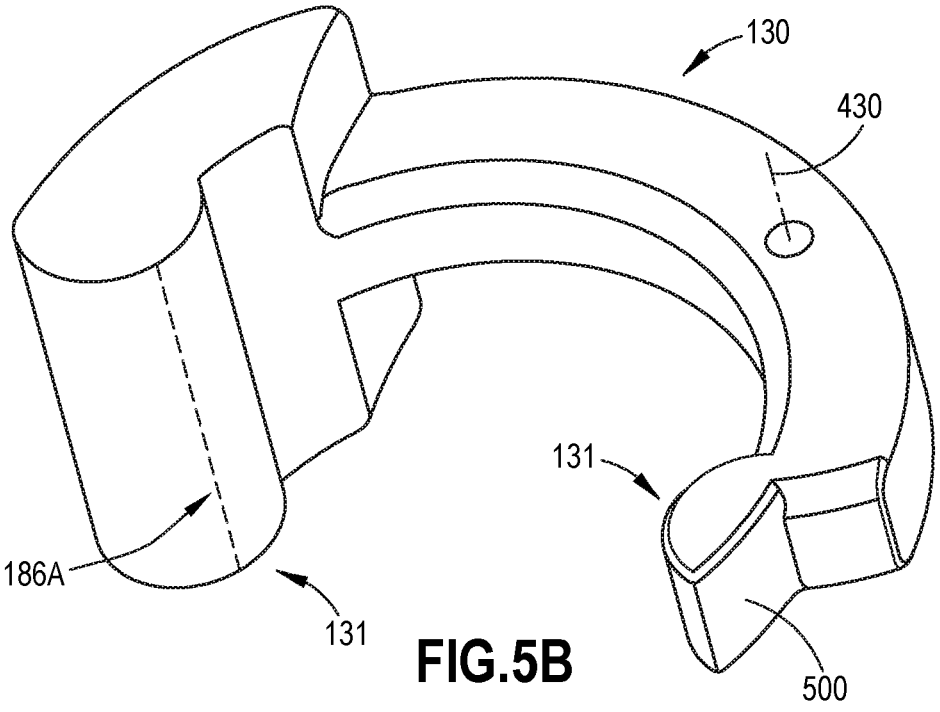
Figure 6:
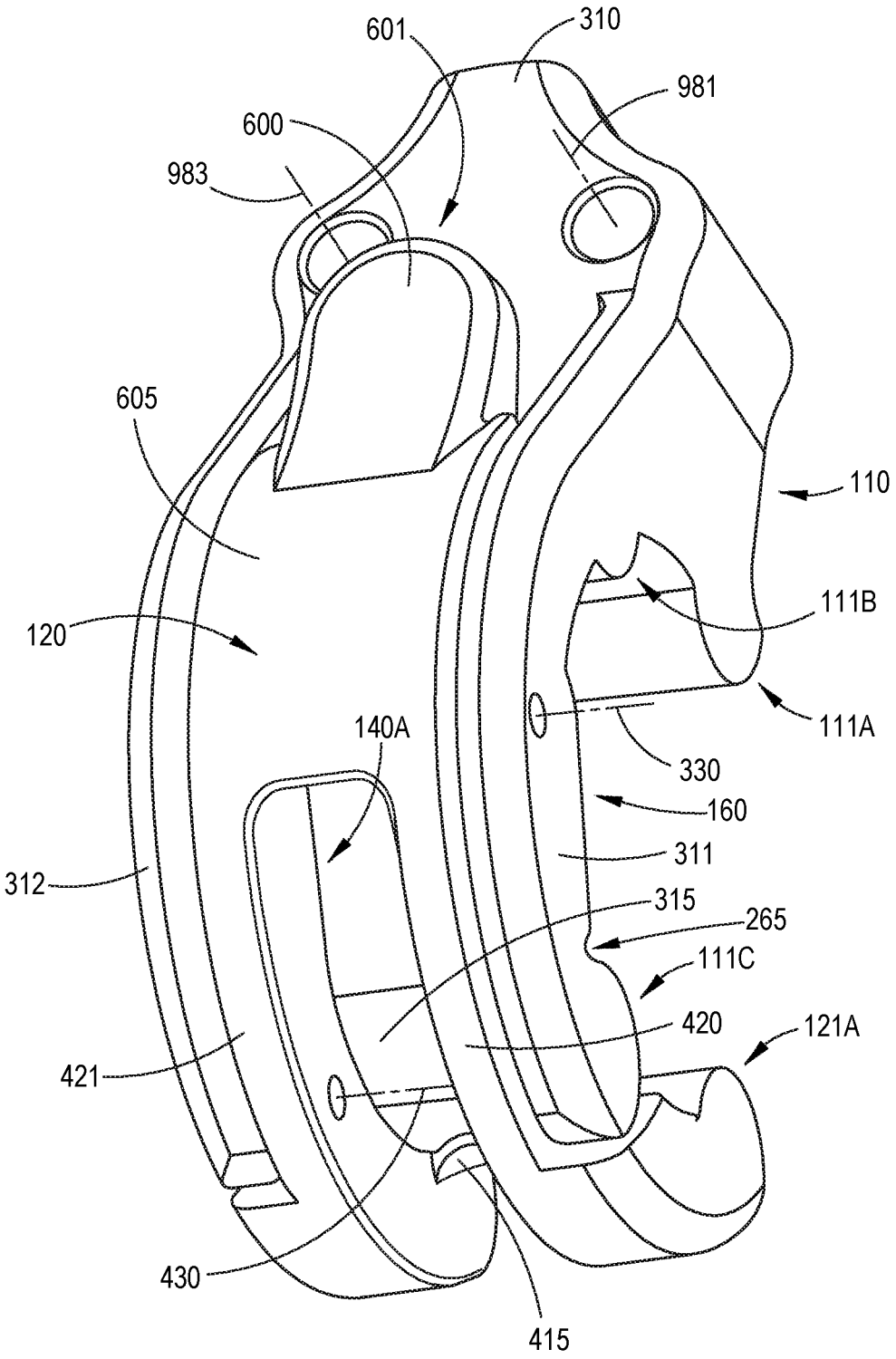
Figure 7:
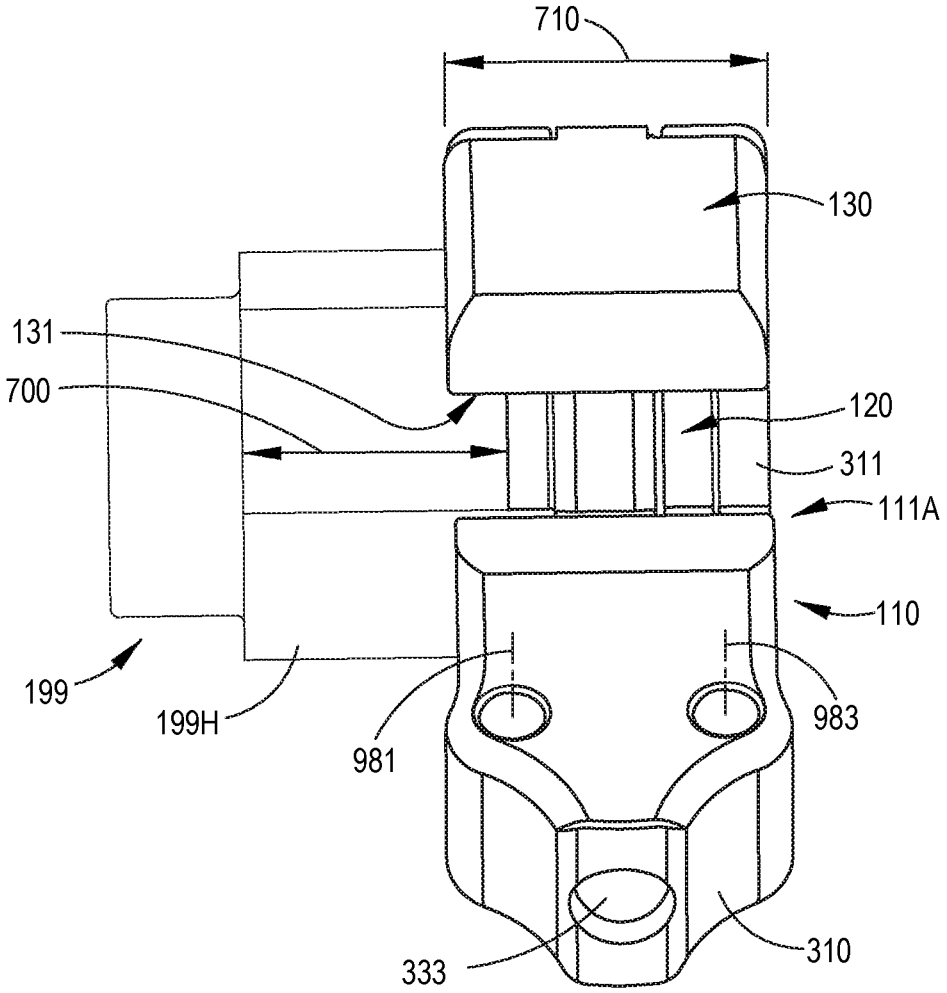
Figure 8:
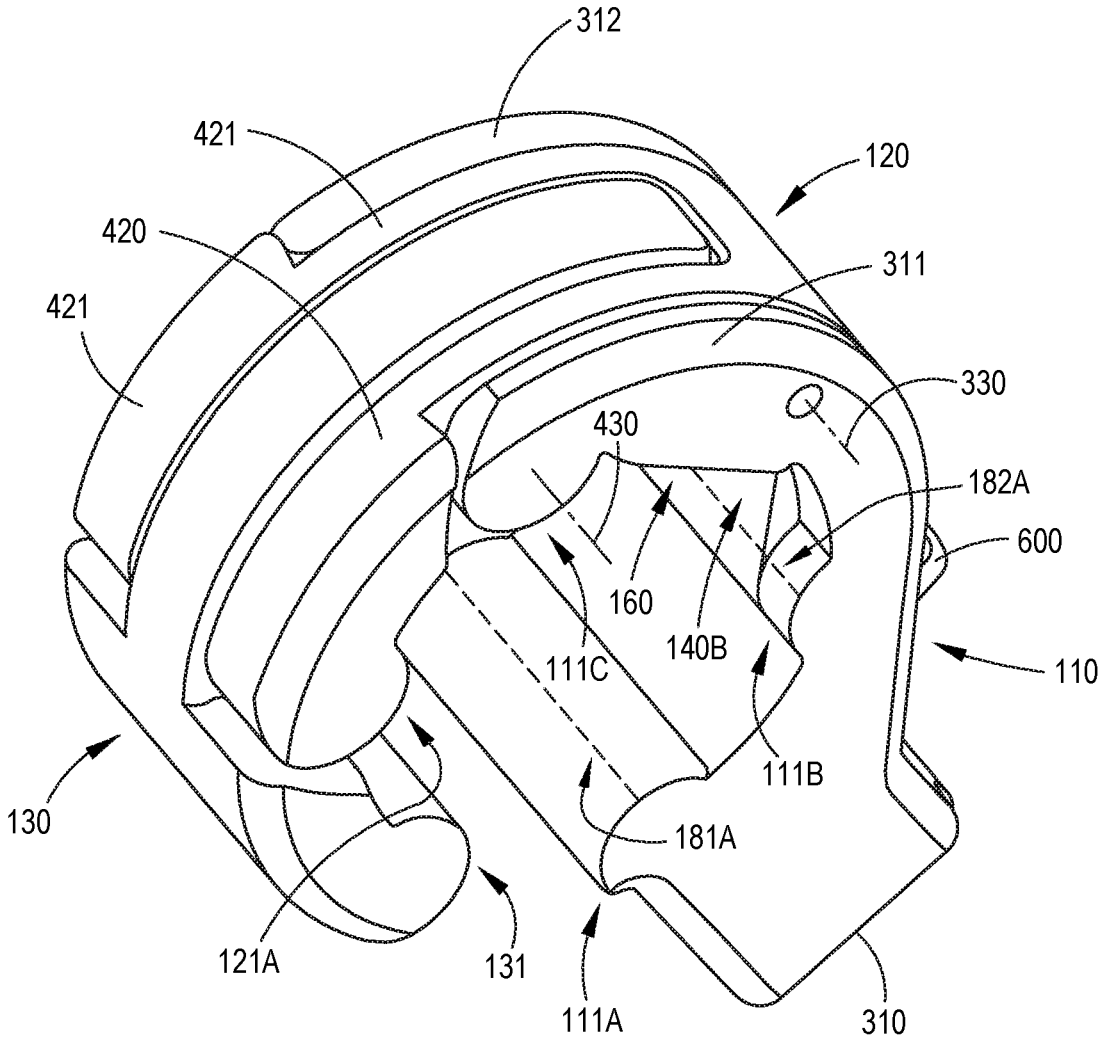
Figure 9A:
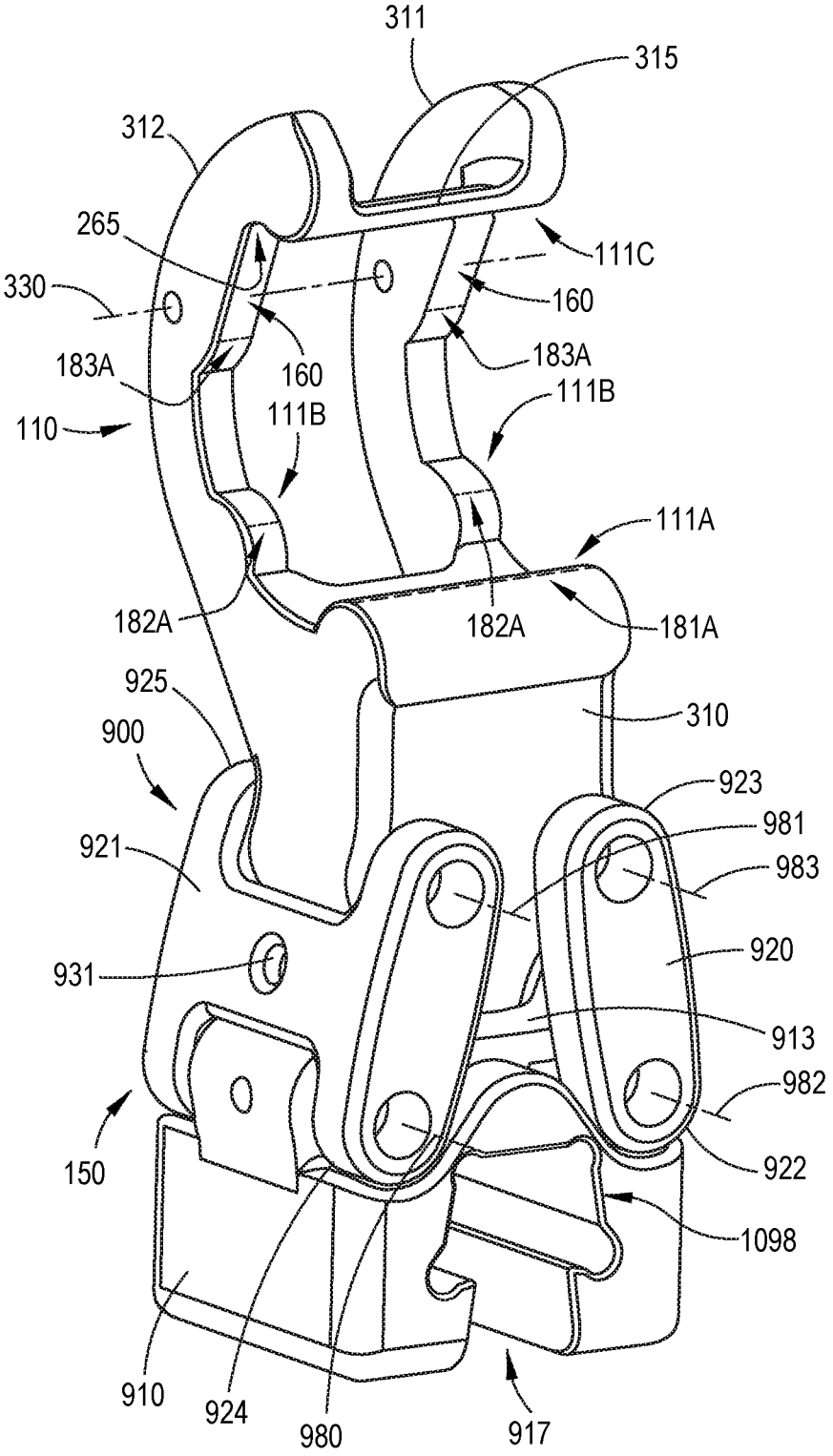
Figure 9B:
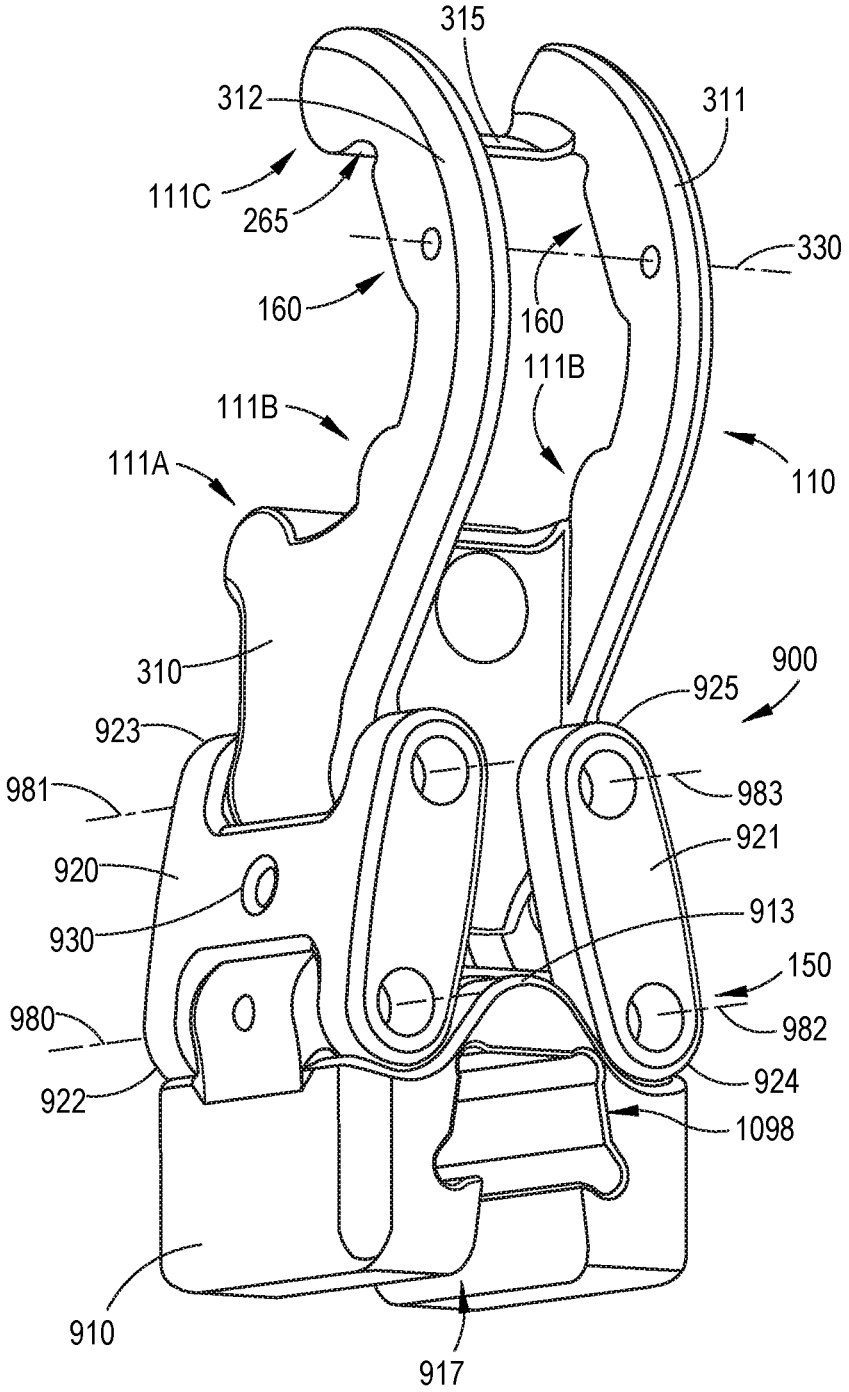
Figure 9C:
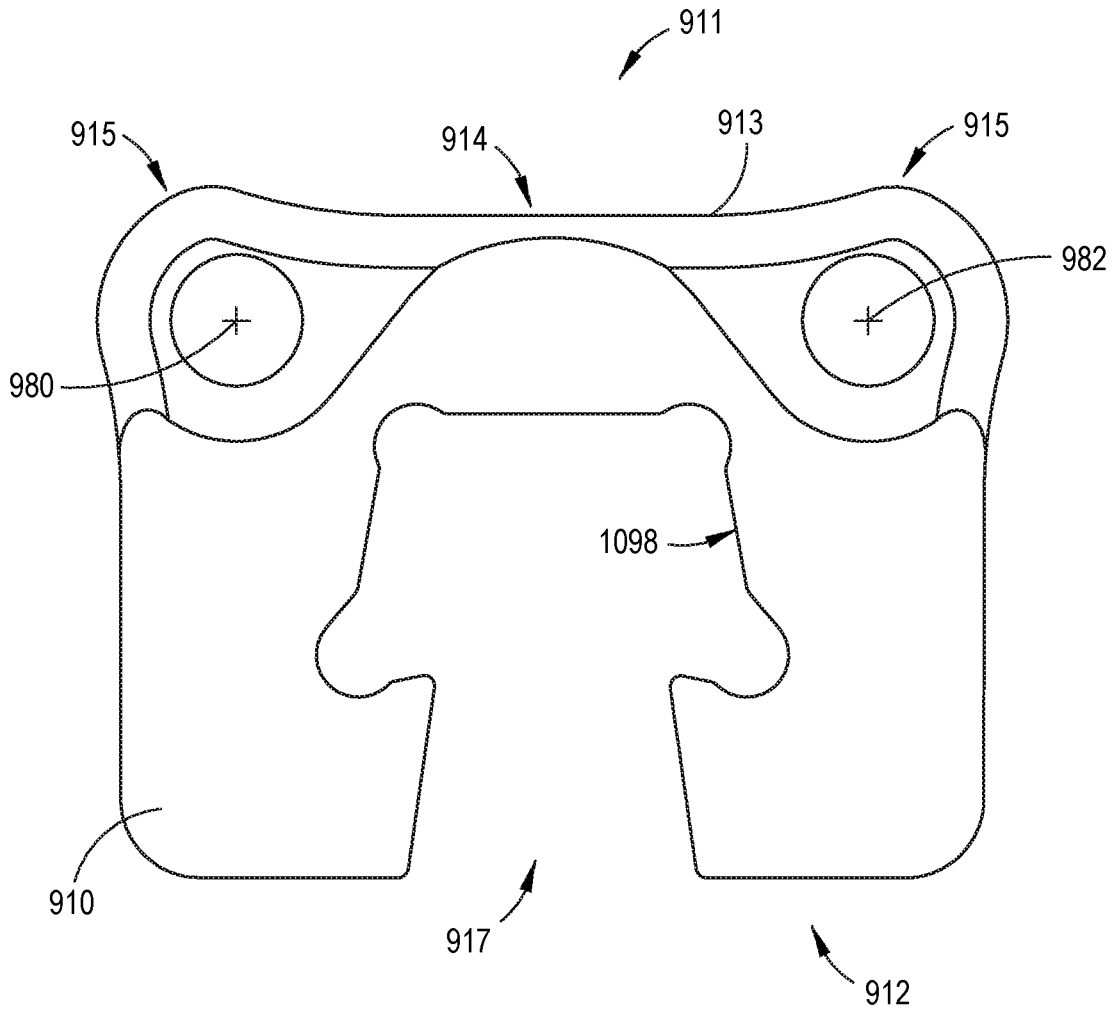
Figure 9D:
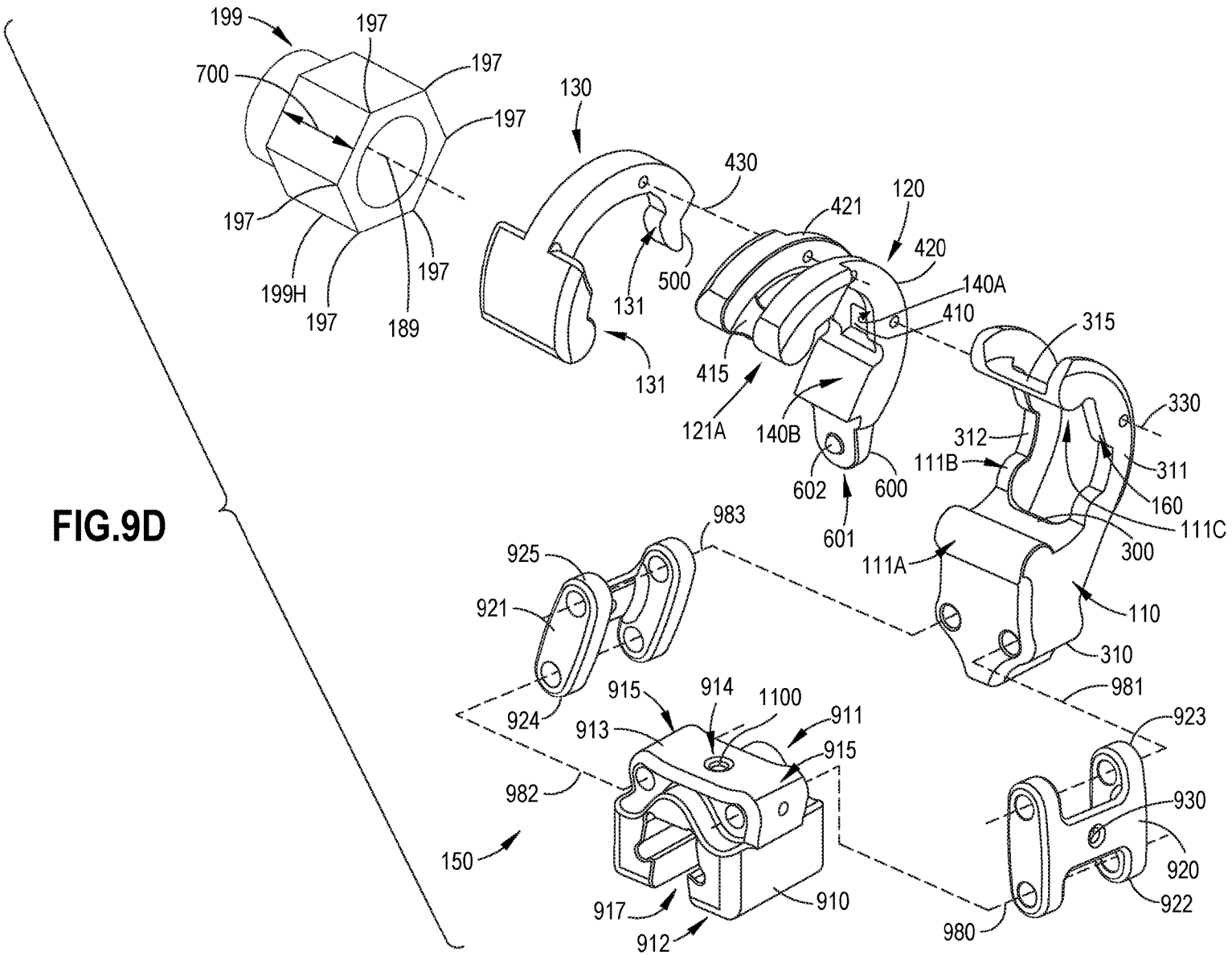
Figure 9E:
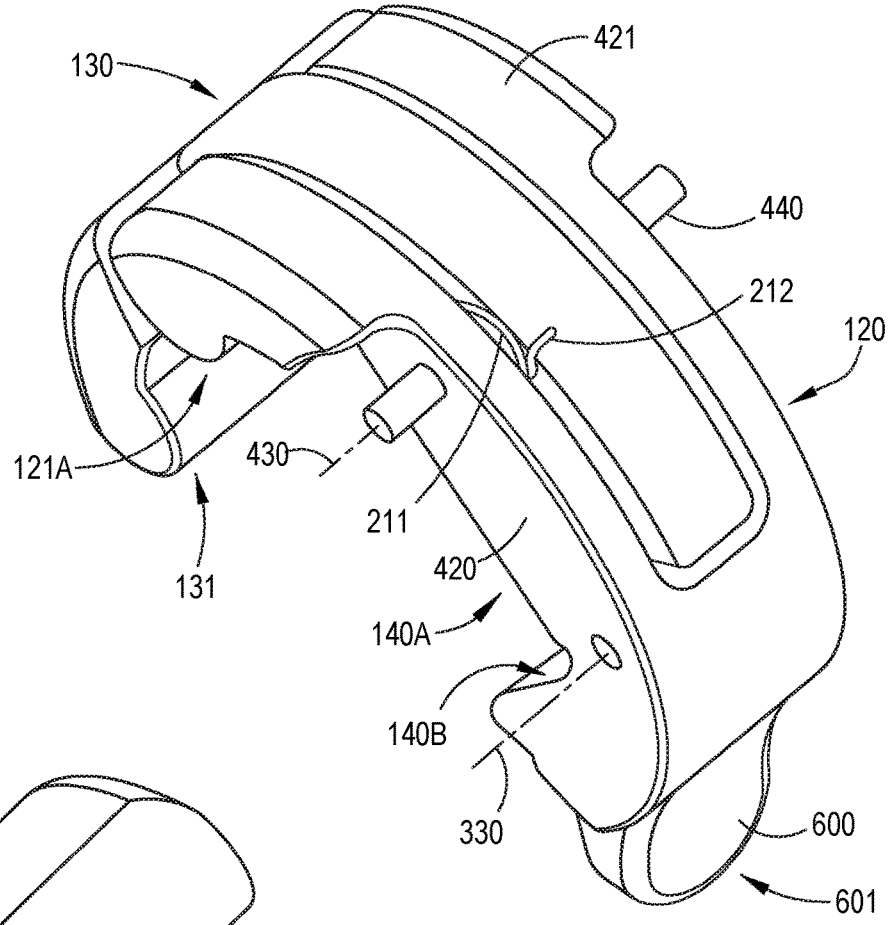
Figure 9F:
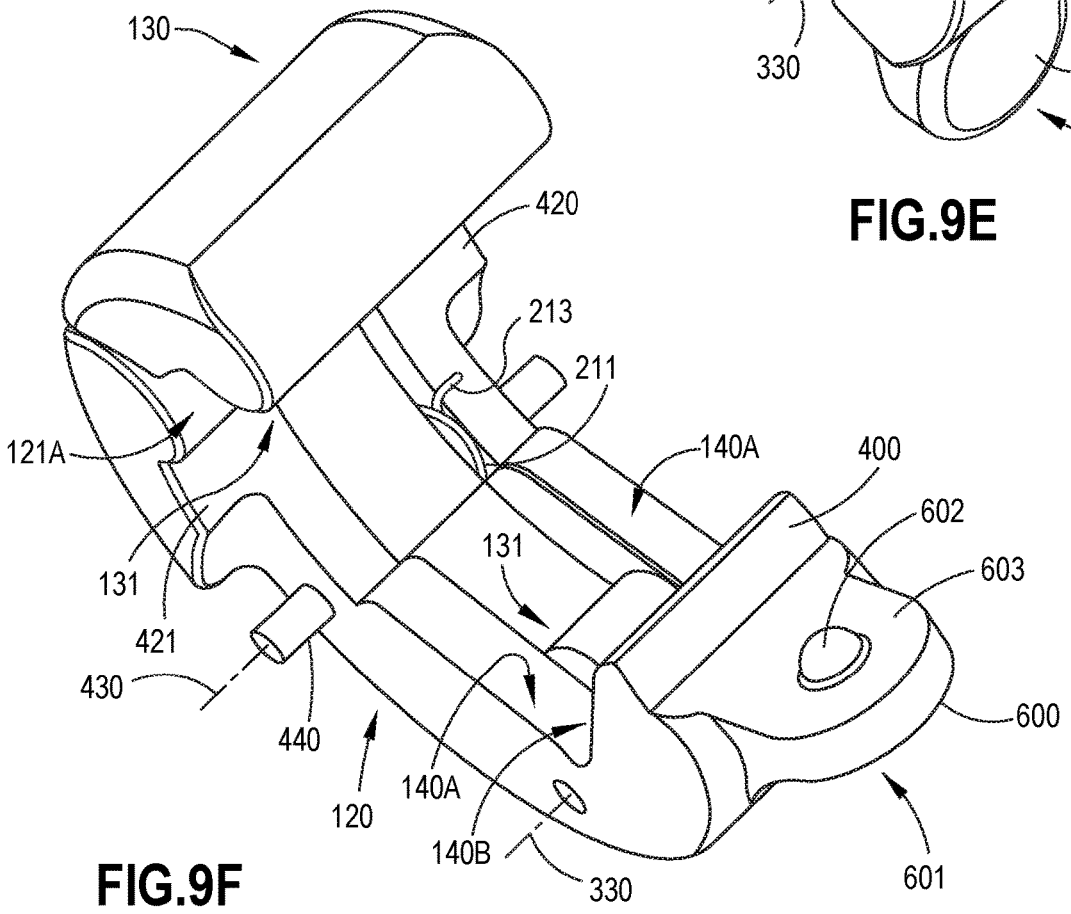
Figure 10A:
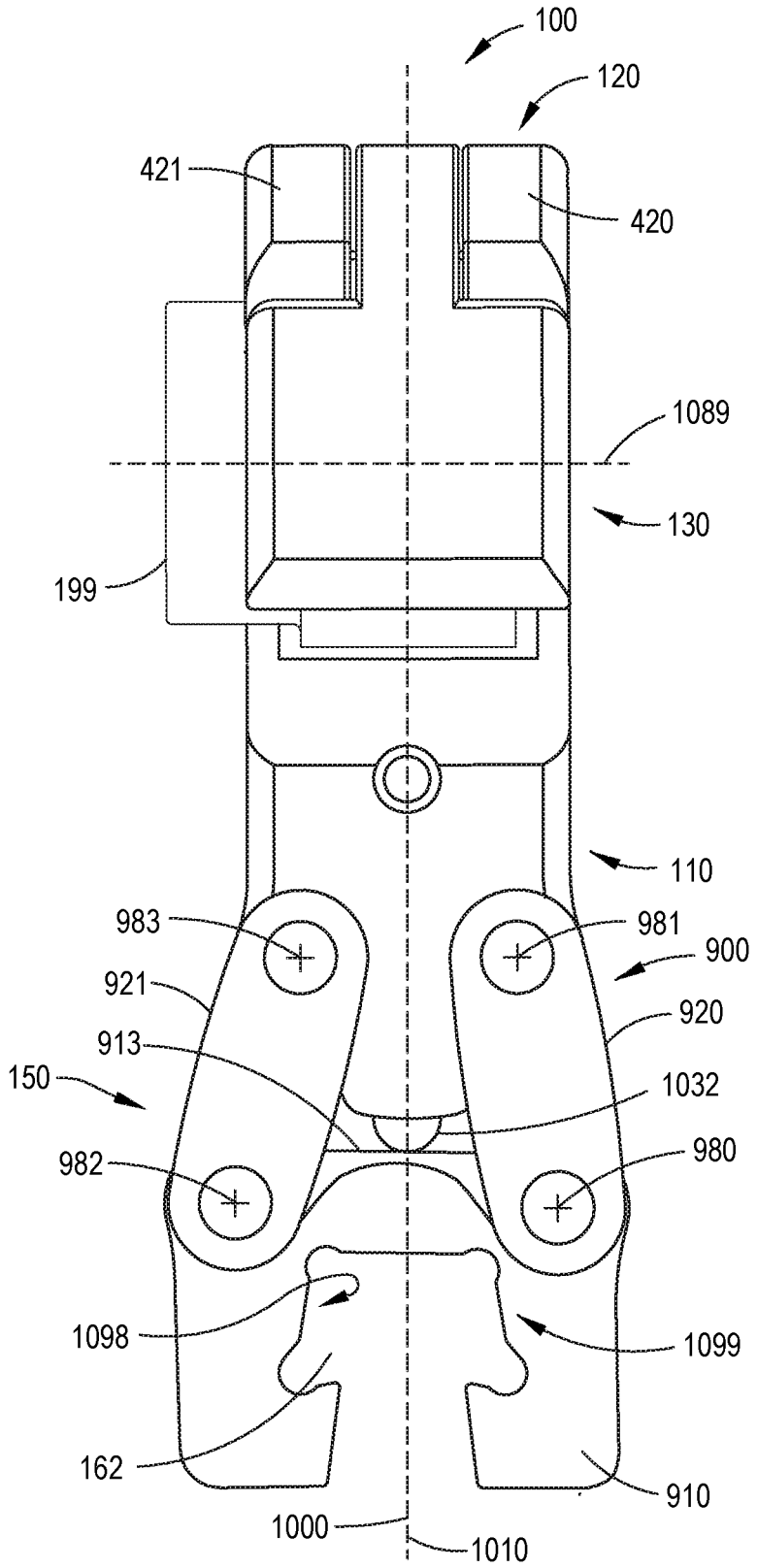
Figure 10B:
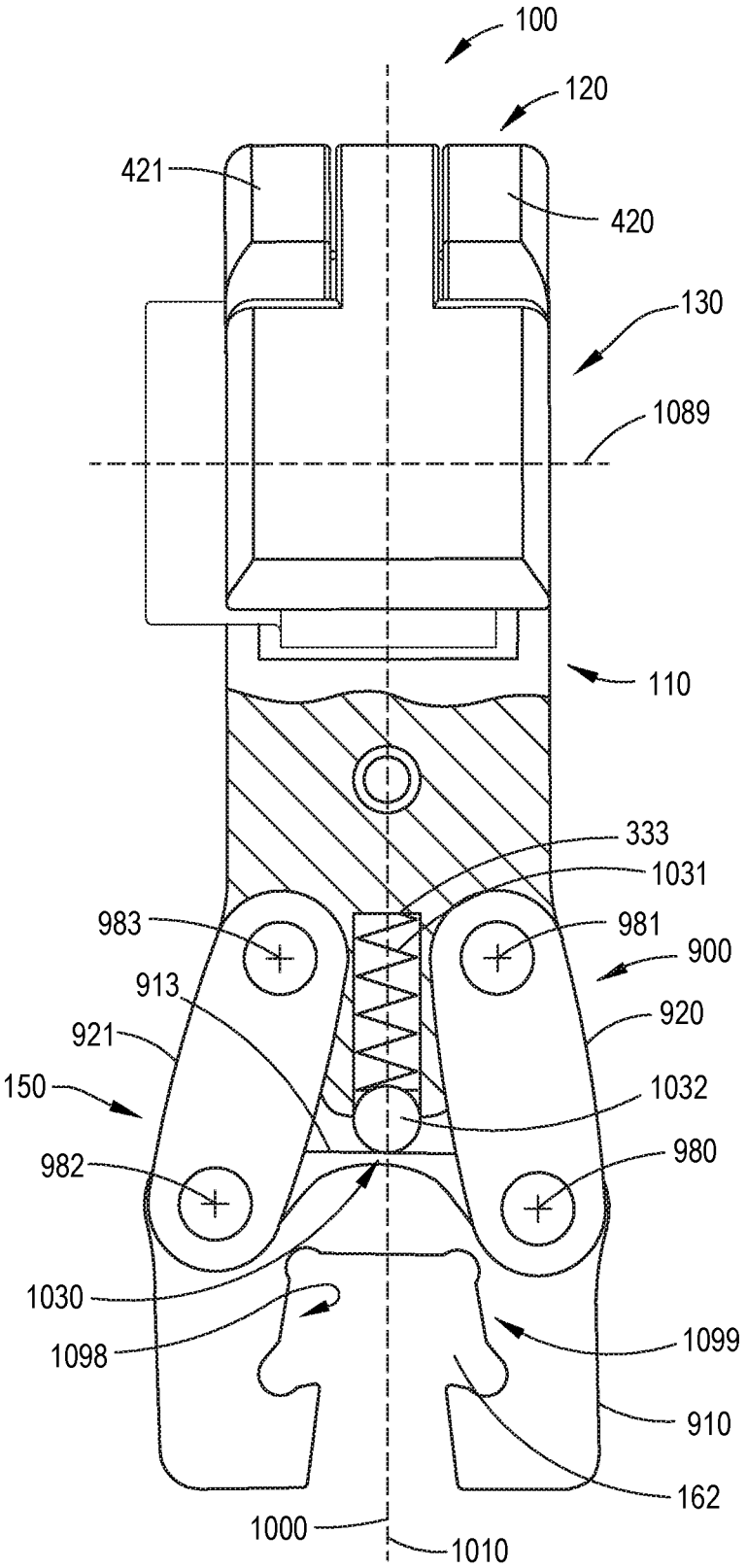
Figure 10C:
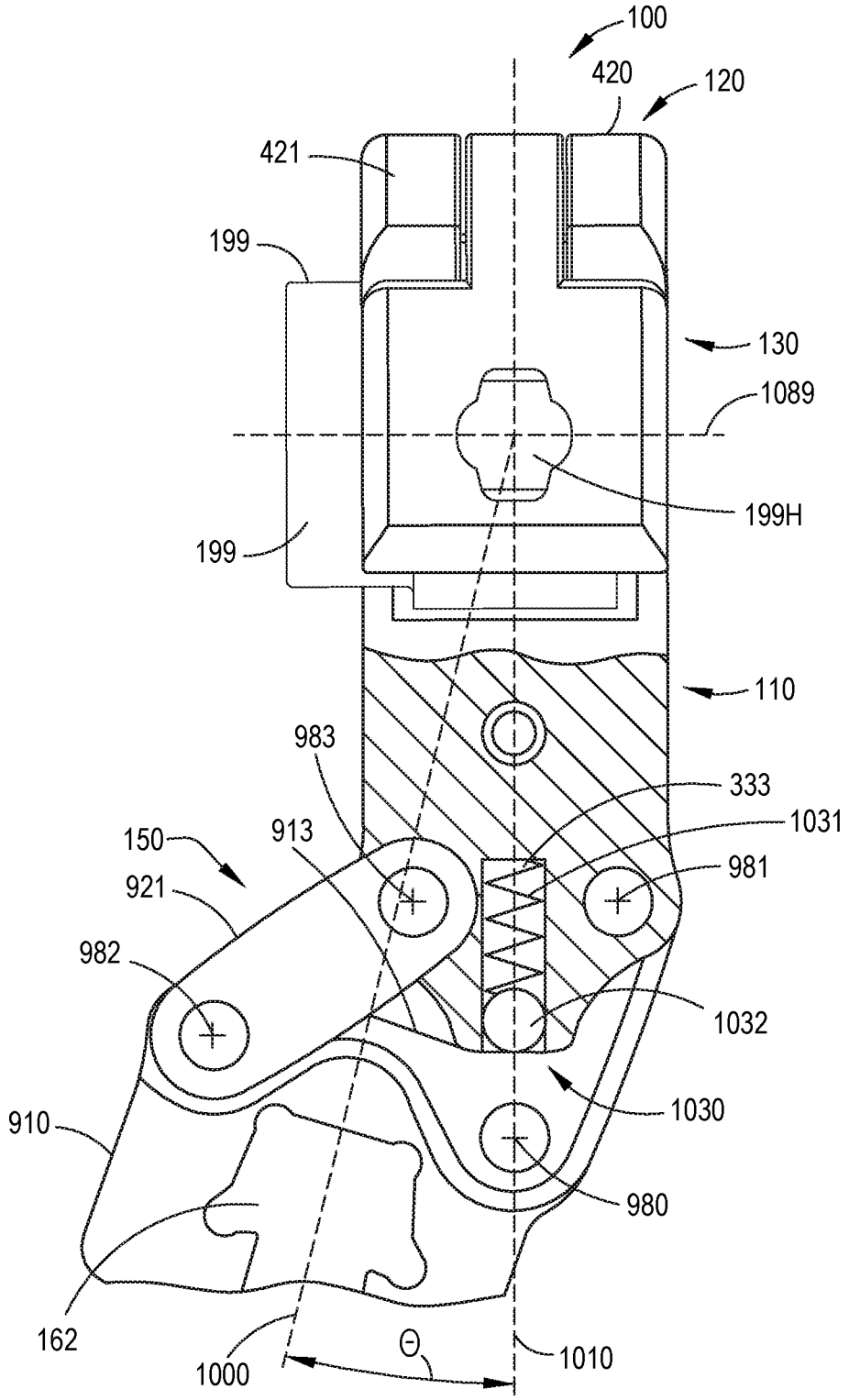
Figure 11A:
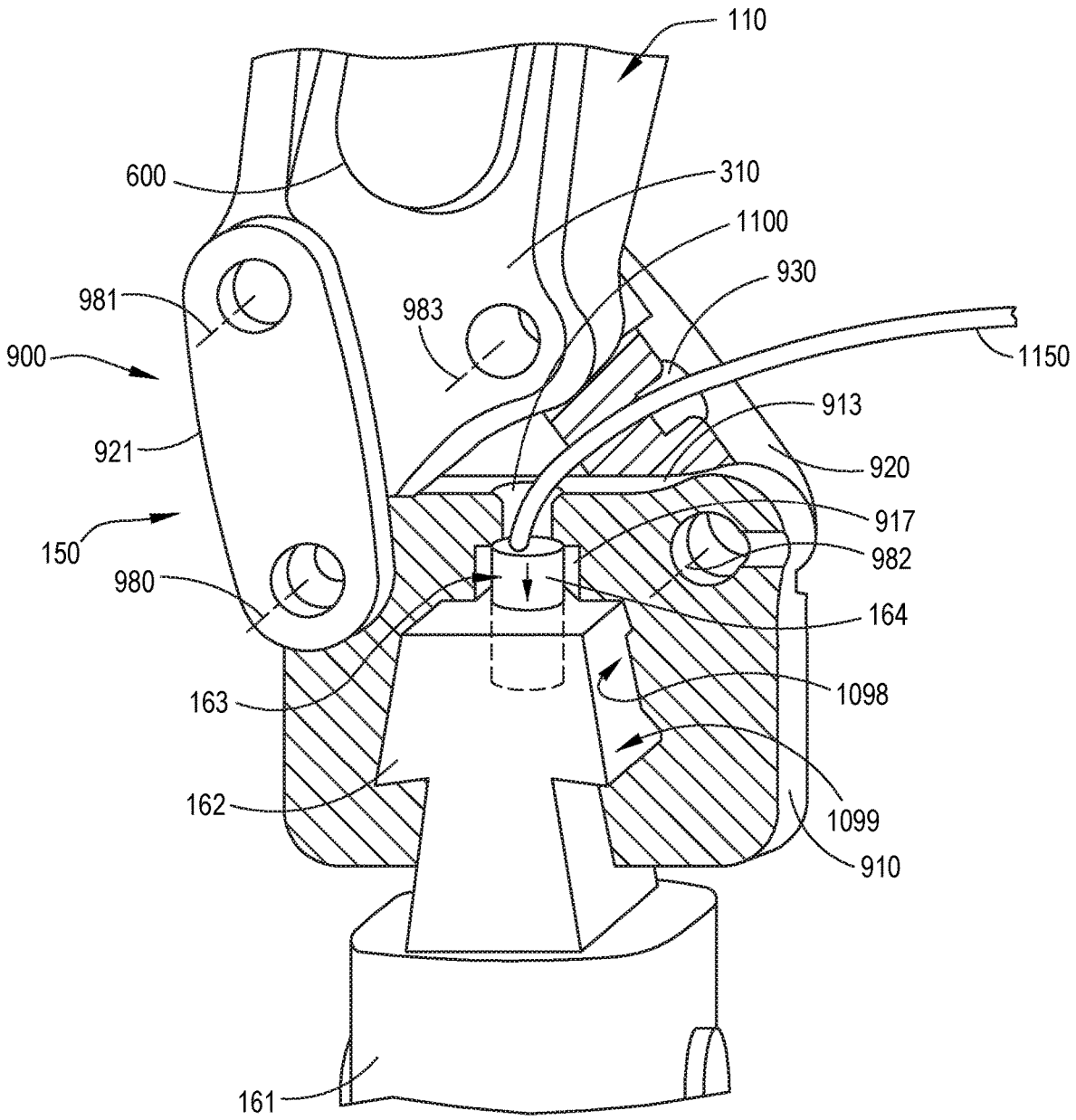
Figure 11B:
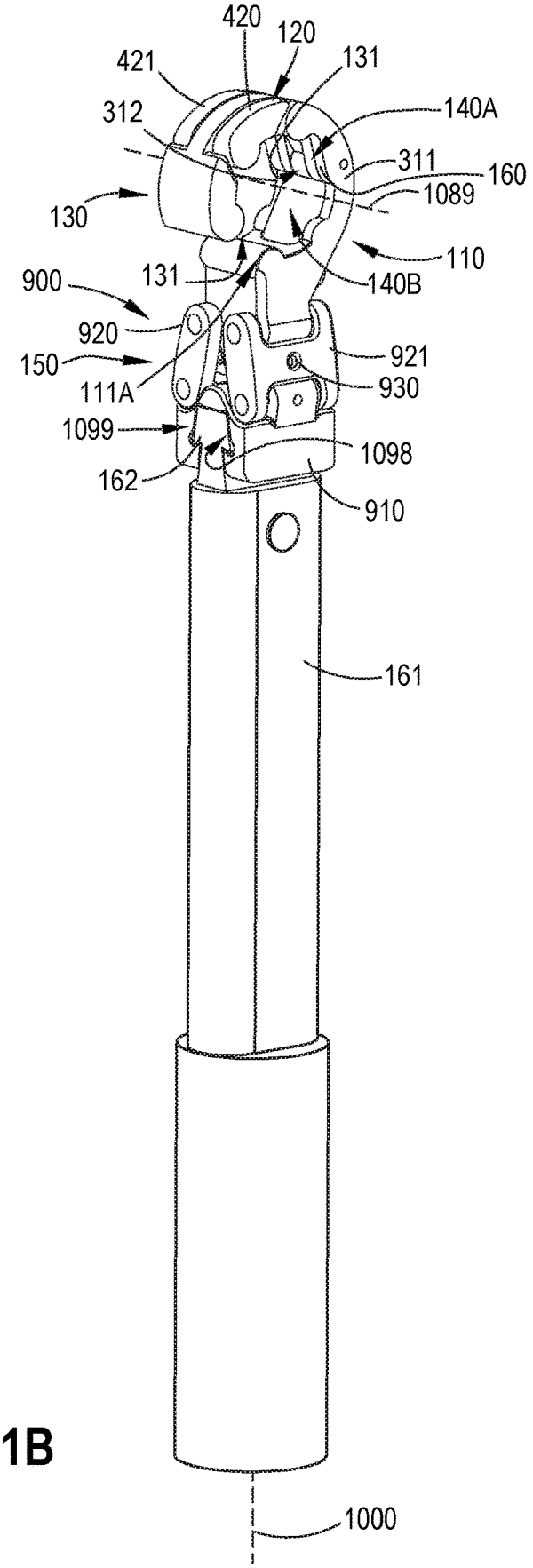
Figure 13:
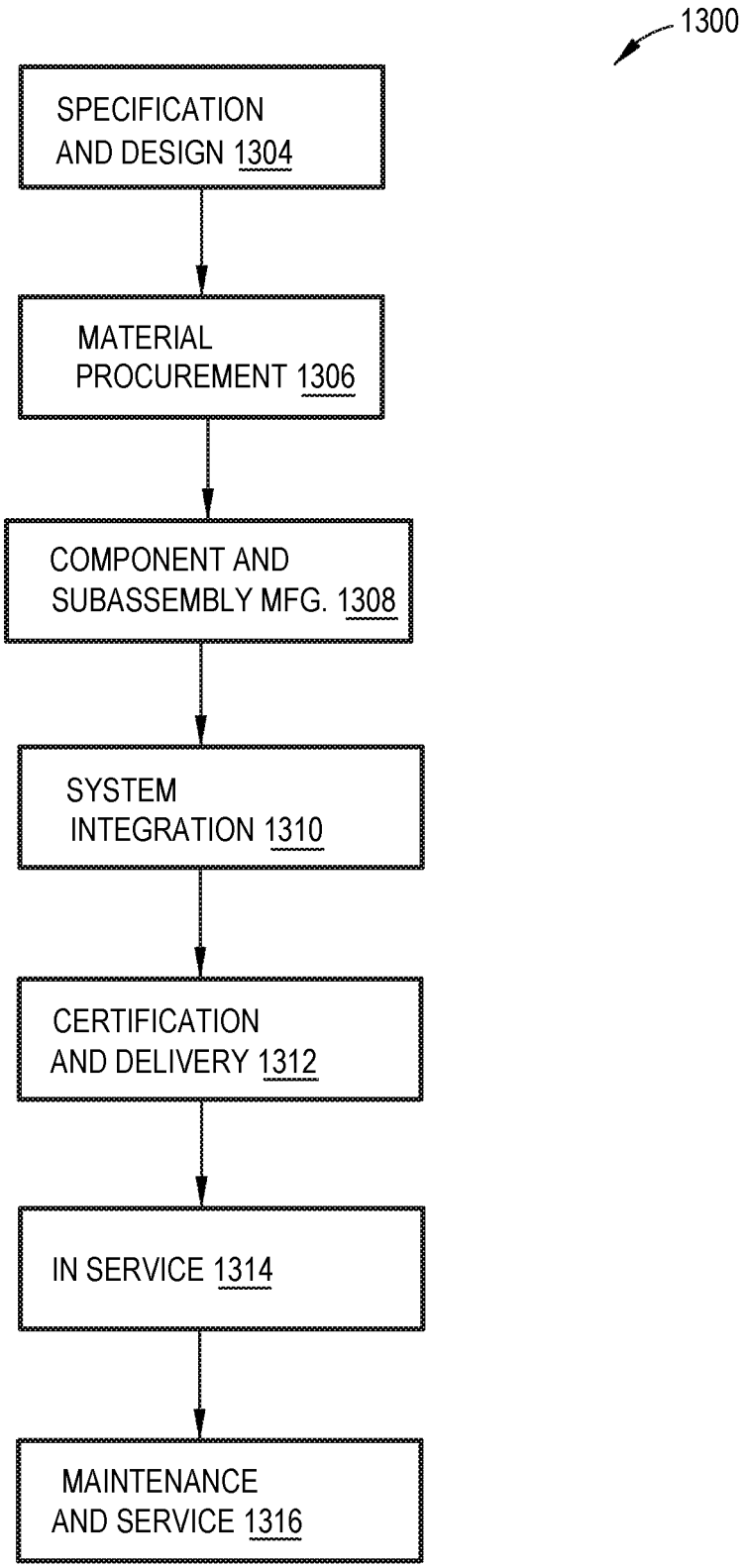
Figure 14:
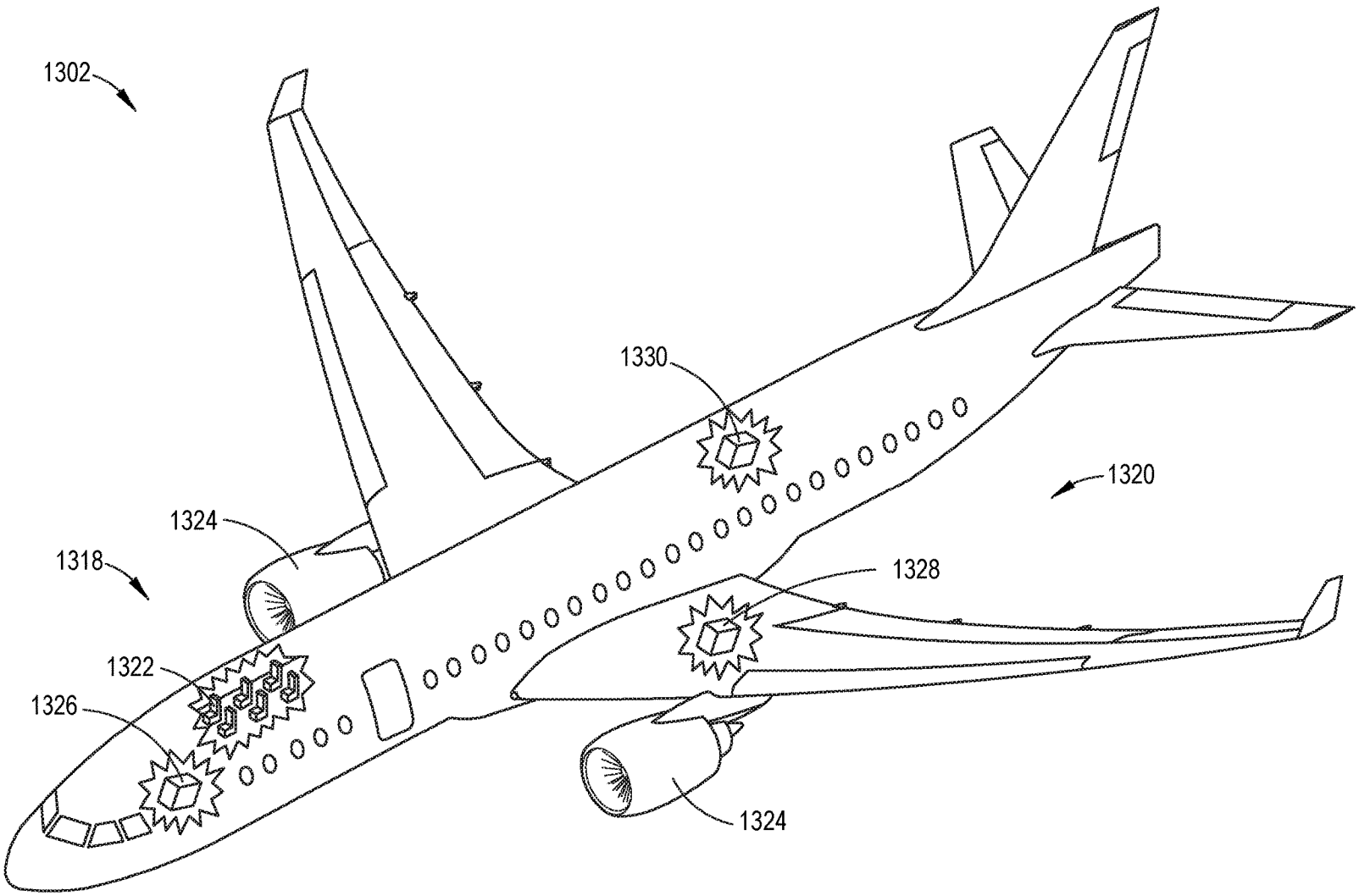

1A-1, 1A-2, 1B, 1C, 1E, and 1F in an open orientation, according to one or more examples of the subject matter, disclosed herein;

FIG. 2H is a schematic, perspective view of the first jaw, the second jaw, and the third jaw of the wrench head of FIGS. 1A-1, 1A-2, 1B, 1C, 1E, and 1F in a closed orientation, according to one or more examples of the subject matter, disclosed herein;

FIG. 2I is a schematic, perspective view of the first jaw, the second jaw, and the third jaw of the wrench head of FIGS. 1A-1, 1A-2, 1B, 1C, 1E, and 1F in an open orientation, according to one or more examples of the subject matter, disclosed herein;

FIG. 2J is a schematic, plan, partial cut-away view of the first jaw, the second jaw, and the third jaw of the wrench head 1A-1, 1A-2, 1B, 1C, 1E, and 1F in an open orientation, according to one or more examples of the subject matter, disclosed herein;

FIG. 2K is a schematic, plan, partial cut-away view of the first jaw, the second jaw, and the third jaw of the wrench head 1A-1, 1A-2, 1B, 1C, 1E, and 1F in an open orientation, according to one or more examples of the subject matter, disclosed herein;

FIG. 2L is a schematic, plan, partial cut-away view of the first jaw, the second jaw, and the third jaw of the wrench head 1A-1, 1A-2, 1B, 1C, 1E, and 1F in a closed orientation, according to one or more examples of the subject matter, disclosed herein;

FIG. 3A is a schematic, plan view of a first jaw of the wrench head of FIGS. 1A-1, 1A-2, 1B, 1C, 1E, and 1F, according to one or more examples of the subject matter, disclosed herein;

FIG. 3B is a schematic, perspective view of the first jaw of the wrench head of FIGS. 1A-1, 1A-2, 1B, 1C, 1E, and 1F, according to one or more examples of the subject matter, disclosed herein;

FIG. 3C is a schematic, perspective view of the first jaw of the wrench head of FIGS. 1A-1, 1A-2, 1B, 1C, 1E, and 1F, according to one or more examples of the subject matter, disclosed herein;

FIG. 3D is a schematic, perspective view of the first jaw of the wrench head of FIGS. 1A-1, 1A-2, 1B, 1C, 1E, and 1F, according to one or more examples of the subject matter, disclosed herein;

FIG. 4A is a schematic, plan view of the second jaw of the wrench head of FIGS. 1A-1, 1A-2, 1B, 1C, 1E, and 1F, according to one or more examples of the subject matter, disclosed herein;

FIG. 4B is a schematic, perspective view of the second jaw of the wrench head of FIGS. 1A-1, 1A-2, 1B, and 1C, according to one or more examples of the subject matter, disclosed herein;

FIG. 4C is a schematic, perspective view of the second jaw of the wrench head of FIGS. 1A-1, 1A-2, 1B, 1C 1E, and 1F, according to one or more examples of the subject matter, disclosed herein;

FIG. 4D is a schematic, perspective view of the second jaw of the wrench head of FIGS. 1A-1, 1A-2, 1B, 1C, 1E, and 1F, according to one or more examples of the subject matter, disclosed herein;

FIG. 4E is a schematic, perspective view of the second jaw of the wrench head of FIGS. 1A-1, 1A-2, 1B, 1C, 1E, and 1F, according to one or more examples of the subject matter, disclosed herein;

FIG. 4F is a schematic, plan view of the second jaw of the wrench head of FIGS. 1A-1, 1A-2, 1B, 1C, 1E, and 1F, according to one or more examples of the subject matter, disclosed herein;

FIG. 4G is a schematic, plan view of the second jaw of the wrench head of FIGS. 1A-1, 1A-2, 1B, 1C, 1E, and 1F, according to one or more examples of the subject matter, disclosed herein;

FIG. 4H is a schematic, plan view of the second jaw of the wrench head of FIGS. 1A-1, 1A-2, 1B, 1C, 1E, and 1F, according to one or more examples of the subject matter, disclosed herein;

FIG. 4I is a schematic, plan view of the second jaw of the wrench head of FIGS. 1A-1, 1A-2, 1B, 1C, 1E, and 1F, according to one or more examples of the subject matter, disclosed herein;

FIG. 5A is a schematic, plan view of the third jaw of the wrench head of FIGS. 1A-1, 1A-2, 1B, 1C, 1E, and 1F, according to one or more examples of the subject matter, disclosed herein;

FIG. 5B is a schematic, perspective view of the third jaw of the wrench head of FIG. 5A, according to one or more examples of the subject matter, disclosed herein;

FIG. 6 is a schematic, perspective view of a portion of the wrench head of FIGS. 1A-1, 1A-2, 1B, 1C, 1E, and 1F, according to one or more examples of the subject matter, disclosed herein;

FIG. 7 is a schematic, side view of a portion of the wrench head of FIGS. 1A-1, 1A-2, 1B, 1C, 1E, and 1F, according to one or more examples of the subject matter, disclosed herein, with the fastener of FIG. 1D;

FIG. 8 is a schematic, perspective view of a portion of the wrench head of FIGS. 1A-1, 1A-2, 1B, 1C, 1E, and 1F, according to one or more examples of the subject matter, disclosed herein;

FIG. 9A is a schematic, perspective view of a portion of the wrench head and a wrench coupler of FIGS. 1A-1, 1A-2, 1B, 1C, 1E, and 1F, according to one or more examples of the subject matter, disclosed herein;

FIG. 9B is a schematic, perspective view of the wrench head of FIGS. 1A-1, 1A-2, 1B, 1C, 1E, and 1F, according to one or more examples of the subject matter, disclosed herein;

FIG. 9C is a schematic, plan view of a pivot base of a wrench coupler of the wrench head of FIGS. 1A-1, 1A-2, 1B, 1C, 1E, and 1F, according to one or more examples of the subject matter, disclosed herein;

FIG. 9D is a schematic, perspective, exploded view of the wrench head of FIGS. 1A-1, 1A-2, 1B, 1C, 1E, and 1F, according to one or more examples of the subject matter, disclosed herein, with the fastener of FIG. 1D;

FIG. 9E is a schematic, perspective view of the second jaw and the third jaw of the wrench head of FIGS. 1A-1, 1A-2, 1B, 1C, 1E, and 1F, according to one or more examples of the subject matter, disclosed herein;

FIG. 9F is a schematic, perspective view of the second jaw and the third jaw of the wrench head of FIGS. 1A-1, 1A-2, 1B, 1C, 1E, and 1F, according to one or more examples of the subject matter, disclosed herein;

FIG. 10A is a schematic, side view of the wrench head of FIGS. 1A-1, 1A-2, 1B, 1C, 1E, and 1F, according to one or more examples of the subject matter, disclosed herein, with the fastener of FIG. 1D;

FIG. 10B is a schematic, side, partial cut-away view of the wrench head of FIGS. 1A1-1, 1A-2, 1B, 1C, 1E, and 1F, according to one or more examples of the subject matter, disclosed herein, with the fastener of FIG. 1D;

FIG. 10C is a schematic, side, partial cut-away view of the wrench head of FIGS. 1A-1, 1A-2, 1B, 1C, 1E, and 1F, according to one or more examples of the subject matter, disclosed herein, with the fastener of FIG. 1D;

FIG. 11A is a schematic, perspective, partial cut-away view of a portion of the wrench head and the wrench of FIGS. 1A-1, 1A-2, 1B, 1C, 1E, and 1F with a release tool, according to one or more examples of the subject matter, disclosed herein;

FIG. 11B is a schematic, perspective view of the wrench head and the wrench of FIGS. 1A-1, 1A-2, 1B, 1C, 1E, and 1F, according to one or more examples of the subject matter, disclosed herein;

FIGS. 12A, 12B, 12C, and 12D, collectively, illustrate a sequence of placement of the wrench head and the wrench of FIGS. 1A-1, 1A-2, 1B, 1C, 1E, and 1F, according to one or more examples of the subject matter, disclosed herein, over/around a fastener;

FIG. 13 is a block diagram of aircraft production and service methodology; and FIG. 14 is a schematic illustration of an aircraft.

DETAILED DESCRIPTION

In FIGS. 1A-1, 1A-2, 1B, 1C, 1D, 1E, and 1F, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the subject matter, disclosed herein. Likewise, elements and/or components, if any, represented with dashed lines, indicate alternative examples of the subject matter, disclosed herein. One or more elements shown in solid and/or dashed lines may be omitted from a particular example without departing from the scope of the subject matter, disclosed herein. Environmental elements, if any, are represented with dotted lines. Virtual (imaginary) elements may also be shown for clarity. Those skilled in the art will appreciate that some of the features illustrated in FIGS. 1A-1, 1A-2, 1B, 1C, 1D, 1E, and 1F may be combined in various ways without the need to include other features described in FIGS. 1A-1, 1A-2, 1B, 1C, 1D, 1E, and 1F, other drawing figures, and/or the accompanying disclosure, even though such combination or combinations are not explicitly illustrated herein. Similarly, additional features not limited to the examples presented, may be combined with some or all of the features shown and described herein.

In FIG. 13, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIG. 13 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one or more examples" means that one or more feature, structure, or characteristic described in connection with the example is included in at least one implementation. The phrase "one or more examples" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter, disclosed herein, are provided below.

Referring generally to FIGS. 1A-1, 1A-2, 1B, 1C, 1D, 1E, 1F, 9D, 10A-10C, 11B, and 12A-12D and particularly to, e.g., FIGS. 2A-2L, 3A-3D, 4A-4I, and 5A-5H for illustrative purposes only and not by way of limitation, wrench head 100 is disclosed. Wrench head 100 comprises working axis 1089, first jaw 110, second jaw 120, and third jaw 130. First jaw 110, comprises first-jaw arcuate convex contact surface 111A, second first-jaw arcuate convex contact surface 111B, third first-jaw arcuate convex contact surface 111C, and first-jaw planar contact surface 160, located between second first-jaw arcuate convex contact surface 111B and third first-jaw arcuate convex contact surface 111C. Second jaw 120 is coupled with first jaw 110, is pivotable relative to first jaw 110, and comprises second-jaw arcuate convex contact surface 121A and second-jaw planar contact surface 140A. Third jaw 130 is coupled with second jaw 120, is pivotable relative to second jaw 120, and comprises third-jaw arcuate convex contact surfaces 131. First-jaw virtual circle 391 is perpendicular to first-jaw arcuate convex contact surface 111A, to second first-jaw arcuate convex contact surface 111B, and to third first-jaw arcuate convex contact surface 111C, has a single point contact with each one of first-jaw arcuate convex contact surface 111A, second first-jaw arcuate convex contact surface 111B, and third first-jaw arcuate convex contact surface 111C, is centered about working axis 1089, and is perpendicular to working axis 1089. When second jaw 120 is in a closed second-jaw orientation relative to first jaw 110, first-jaw virtual circle 391 is perpendicular to second-jaw arcuate convex contact surface 121A and to second-jaw planar contact surface 140A, has a single point contact with second-jaw arcuate convex contact surface 121A, and intersects second-jaw planar contact surface 140A at only two points. When second jaw 120 is in the closed second-jaw orientation relative to first jaw 110, and third jaw 130 is in a closed third-jaw orientation relative to second jaw 120, first-jaw virtual circle 391 is perpendicular to third-jaw arcuate convex contact surfaces 131 and has a single point contact with each of third-jaw arcuate convex contact surfaces 131. The preceding portion of this paragraph characterizes example 1 of the subject matter, disclosed herein.

Serial coupling of first jaw 110, second jaw 120, and third jaw 130 provide for placement of wrench head 100 over head 199H of fastener 199, e.g., a hexagonal fastener, from direction 1298 relative to the rotational axis of the hexagonal fastener. First-jaw arcuate convex contact surface 111A, second first-jaw arcuate convex contact surface 111B, third first-jaw arcuate convex contact surface 111C, first-jaw planar contact surface 160, second-jaw arcuate convex contact surface 121A, second-jaw planar contact surface 140A, and third-jaw arcuate convex contact surfaces 131 provide regions of contact 181A-186A with fastener 199. Regions of contact 181A-186A correspond with points of contact 181-186 between first-jaw virtual circle and each of first jaw 110, second jaw 120, and third jaw 130. Second-jaw planar contact surface 140A prevents, through contact with fastener 199, closing of wrench head 100 during a ratcheting motion of wrench head 100. Regions of contact 181A-186A are lines of contact or small areas of surface contact or, for first-jaw planar contact surface 160 substantial planar surface contact along at least a portion of first-jaw planar contact surface 160 (see also second-jaw planar contact surface 140A, second second-jaw planar contact surface 140B, and second second-jaw planar contact surface 140C). Referring to FIG. 3A for exemplary purposes, first-jaw planar contact surface 160 is formed by tangent line 586 between adjacent virtual circles 584, 585 where tangent line 586 has non-intersecting contact with each of virtual circles 584, 585 at respective tangent points (e.g., a point on virtual circle 585 coincident with point of contact 183, and point 583 on virtual circle 584). Virtual circles 584, 585 being located on first jaw 110 so that first-jaw planar contact surface 160 contacts head 199H of fastener 199 substantially along a length of one of external flats 190-195 of head 199H. Other planar contact surfaces (such as, but not limited to, second-jaw planar contact surface 140A) described herein, in one or more examples, are formed in a manner, similar to that of first-jaw planar contact surface 160.

Fastener 199 is illustrated as a hexagonal nut for exemplary purposes, but in one or more examples, fastener 199 is a nut, a bolt, or a screw, where the nut, the bolt head, or the screw head of the fastener has external flats 190-195 that are six in number. Head 199H of fastener 199 is defined as an area of fastener 199 that is configured to engage wrench head 100.

Second jaw 120 is pivotally coupled to first jaw 110 about axis of rotation 330 by first hinge pin 320. Third jaw 130 is pivotally coupled to second jaw 120 about axis of rotation 430 by second hinge pin 440.

As used herein, the expression "single point contact" means a non-intersecting tangential contact between two lines, which may or may not be straight. As used herein, the term "pivotable" means capable of turning about a pin, a rod, or a shaft, coaxial with a pivot axis that passes through an element that pivots, but does not necessarily pass through the center of mass of that element. Further, the term "arcuate", as used herein, means curved and does not necessarily mean an arc of a circle.

Referring generally to FIGS. 1A-1, 1A-2, 1B, 1C, 1D, 1E, 1F, 9D, 10A-10C, 11B, and 12A-12D and particularly to, e.g., FIGS. 2G, 2J, and 4A-4I for illustrative purposes only and not by way of limitation, when second jaw 120 is in an open second-jaw orientation relative to first jaw 110, first-jaw virtual circle 391 is perpendicular to second-jaw arcuate convex contact surface 121A and to second-jaw planar contact surface 140A, is not in contact with second-jaw arcuate convex contact surface 121A, intersects second-jaw planar contact surface 140A, and does not intersect second-jaw arcuate convex contact surface 121A. The preceding portion of this paragraph characterizes example 2 of the subject matter, disclosed herein, where example 2 also encompasses example 1, above.

Figure 12A:
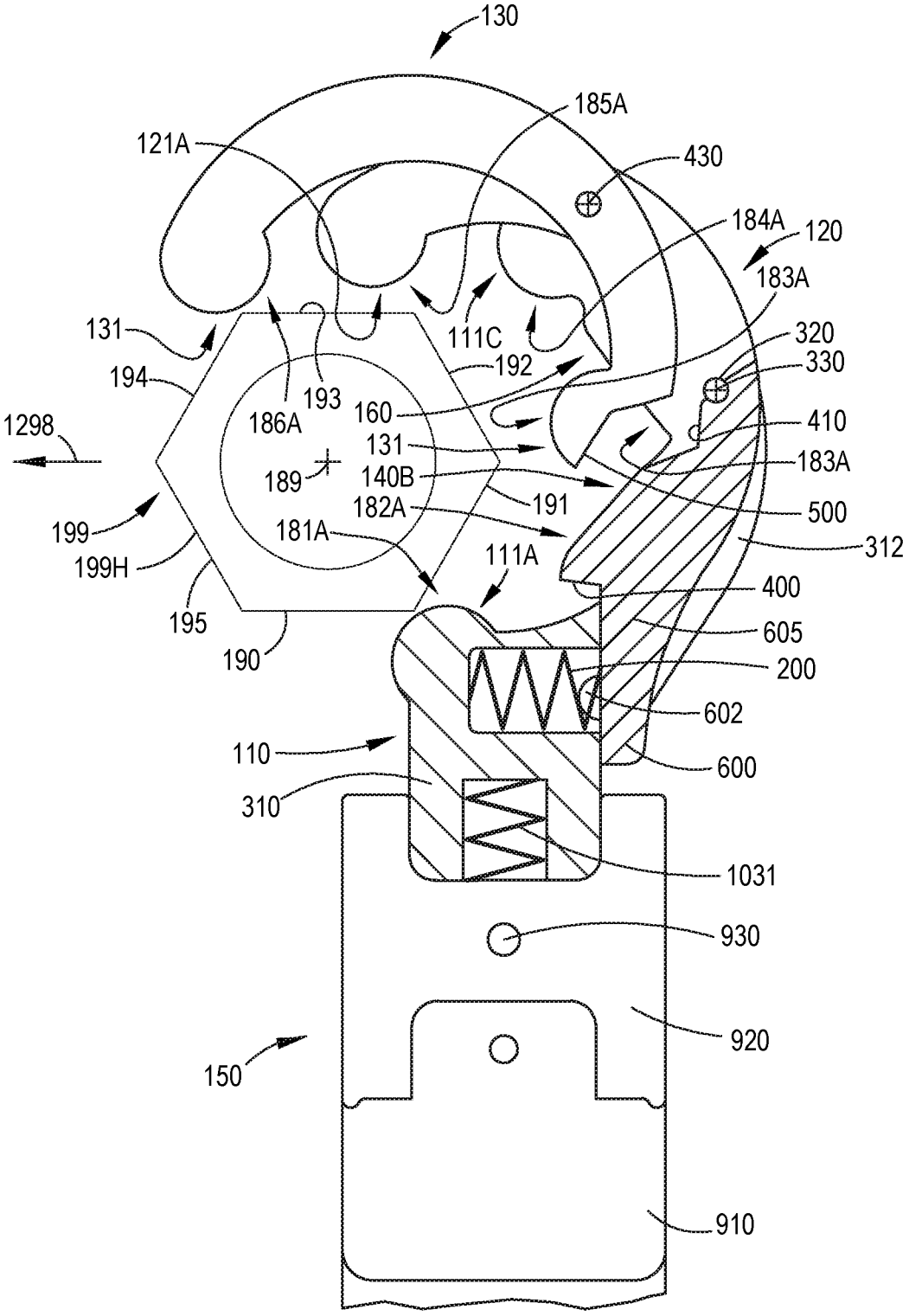

Opening second jaw 120 so that first-jaw virtual circle 391 is perpendicular to second-jaw arcuate convex contact surface 121A and to second-jaw planar contact surface 140A, is not in contact with second-jaw arcuate convex contact surface 121A, intersects second-jaw planar contact surface 140A, and does not intersect second-jaw arcuate convex contact surface 121A provides for placement of wrench head 100 over head 199H of fastener 199, such as by moving wrench head 100 in direction 1298 (see FIGS. 2B and 12A).

First-jaw arcuate convex contact surface 111A, second first-jaw arcuate convex contact surface 111B, third first-jaw arcuate convex contact surface 111C, and first-jaw planar contact surface 160 contact fewer than all external flats 190-195 of head 199H of fastener 199 to enable opening of first jaw 110, second jaw 120, and third jaw 130 for placement of wrench head 100 around external flats 190-195 of head 199H and closing of first jaw 110, second jaw 120, and third jaw 130 for engaging of external flats 190-195 of head 199H such as when torque is applied to wrench head 100 about working axis 1089. Second-jaw arcuate convex contact surface 121A and second-jaw planar contact surface 140A are configured to engage fewer than all external flats 190-195 of head 199H of fastener 199, where head 199H has six external flats 190. Second-jaw arcuate convex contact surface 121A and second-jaw planar contact surface 140A contacting fewer than all external flats 190-195 of head 199H of fastener 199 enables opening of first jaw 110, second jaw 120, and third jaw 130 for placement of wrench head 100 around external flats 190-195 of head 199H and closing of first jaw 110, second jaw 120, and third jaw 130 for engaging external flats 190-195 of head 199H such as when torque is applied to wrench head 100 about working axis 1089. Third-jaw arcuate convex contact surfaces 131 contact fewer than all external flats 190-195 of head 199H of fastener 199 to enable opening of first jaw 110, second jaw 120, and third jaw 130 for placement of wrench head 100 around external flats 190-195 of head 199H and closing of first jaw 110, second jaw 120, and third jaw 130 for engaging of external flats 190-195 of head 199H such as when torque is applied to wrench head 100 about working axis 1089.

Referring generally to FIGS. 1A-1, 1A-2, 1B, 1C, 1D, 1E, 1F, 9D, 10A-10C, 11B, and 12A-12D and particularly to, e.g., FIGS. 2J-2L and 4A-4H for illustrative purposes only and not by way of limitation, second jaw 120 further comprises second second-jaw planar contact surface 140B, 140C. When second jaw 120 is in the closed second-jaw orientation relative to first jaw 110, first-jaw virtual circle 391 is perpendicular to second-jaw arcuate convex contact surface 121A, to second-jaw planar contact surface 140A, and to second second-jaw planar contact surface 140B, 140C, has single point contact with second-jaw arcuate convex contact surface 121A, and intersects each of second-jaw planar contact surface 140A and second second-jaw planar contact surface 140B, 140C at only two points. The preceding portion of this paragraph characterizes example 3 of the subject matter, disclosed herein, where example 3 also encompasses example 2, above.

Second second-jaw planar contact surface 140B, 140C provides region of contact 182A, 184A between second jaw 120 and head 199H of fastener 199 so as to apply torque to head 199H during a torqueing rotation of wrench head 100. Second second-jaw planar contact surface 140B, 140C prevents, through contact with fastener 199, closing of wrench head 100 during a ratcheting motion of wrench head 100.

Referring generally to FIGS. 1A-1, 1A-2, 1B, 1C, 1D, 1E, 1F, 9D, 10A-10C, 11B, and 12A-12D and particularly to, e.g., FIGS. 2J, 4F, and 4G for illustrative purposes only and not by way of limitation, when second jaw 120 is in the open second-jaw orientation relative to first jaw 110, first-jaw virtual circle 391 is perpendicular to second-jaw arcuate convex contact surface 121A, to second-jaw planar contact surface 140A, and to second second-jaw planar contact surface 140B, 140C, is not in contact with any one of second-jaw arcuate convex contact surface 121A or second second-jaw planar contact surface 140B, 140C, and does not intersect any one of second-jaw arcuate convex contact surface 121A, second-jaw planar contact surface 140A, or second second-jaw planar contact surface 140B, 140C. The preceding portion of this paragraph characterizes example 4 of the subject matter, disclosed herein, where example 4 also encompasses example 3, above.

Opening second jaw 120 so that first-jaw virtual circle 391 is not in contact with any one of second-jaw arcuate convex contact surface 121A or second second-jaw planar contact surface 140B, 140C, and does not intersect any one of second-jaw arcuate convex contact surface 121A, second-jaw planar contact surface 140A, or second second-jaw planar contact surface 140B, 140C provides for placement of wrench head 100 over head 199H of fastener 199, such as by moving wrench head 100 in direction 1298 (see FIGS. 2B and 12A).

Angularly separating second-jaw arcuate convex contact surface 121A, second-jaw planar contact surface 140A, and second second-jaw planar contact surface 140B, 140C such that second-jaw arcuate convex contact surface 121A, second-jaw planar contact surface 140A, and second second-jaw planar contact surface 140B, 140C contact fewer than all external flats 190-195 of head 199H of fastener 199 prevents rounding off of corners 197 of head 199H when wrench head 100 tightens fastener 199 and enables opening of first jaw 110, second jaw 120, and third jaw 130 for placement of wrench head 100 around external flats 190-195 of head 199H and closing of first jaw 110, second jaw 120, and third jaw 130 to engage external flats 190-195 of head 199H, such as when torque is applied to wrench head 100 about working axis 1089.

Second second-jaw planar contact surface 140B, 140C is angularly separated from second-jaw planar contact surface 140A so as to be adjacent second-jaw planar contact surface 140A. One of corners 197 of fastener 199, such as between external flats 192, 193 of external flats 190-195 in FIG. 4G or such as between external flats 191, 192 of external flats 190-195 in FIGS. 4A and 4F, is temporarily captured between second-jaw planar contact surface 140A and second second-jaw planar contact surface 140B, 140C during a non-torqueing rotation of wrench head 100 in direction 521 relative to fastener 199. Temporarily capturing one of corners 197 in combination with the non-torqueing rotation of wrench head 100, opens first jaw 110, second jaw 120, and third jaw 130 relative to each other to enable a ratcheting action of wrench head 100. Second second-jaw planar contact surface 140B, 140C prevents, through contact with fastener 199, closing of wrench head 100 during a ratcheting motion of wrench head 100.

Referring to FIG. 4A, when a ratcheting motion of wrench head 100 is provided, one of corners 197, such as between external flats 191, 192, is temporarily captured in first second-jaw space 480 between second-jaw planar contact surface 140A and second second-jaw planar contact surface 140B. Captured one of corners 197 rides along second second-jaw planar contact surface 140B in direction 515. Corner 197 between external flats 191, 192 causes second jaw 120 to pivot about axis of rotation 330 to open wrench head 100 until corner 197 between external flats 191, 192 moves past region of contact 182A so that corner 197 between external flats 192, 193 slides along second second-jaw planar contact surface 140B and moves into first second-jaw space 480 between second-jaw planar contact surface 140A and second second-jaw planar contact surface 140B. Movement of corner 197 between external flats 192, 193 into first second-jaw space 480 between second-jaw planar contact surface 140A and second second-jaw planar contact surface 140B closes wrench head 100 so that a torqueing rotation of wrench head 100 in direction 520 is applied to fastener 199. Similar operations of wrench head 100 are provided with second jaw 120 illustrated in FIGS. 4F, 4G, and 4H as well as with third jaw 130 illustrated in FIGS. 5C-5H.

Referring generally to FIGS. 1A-1, 1A-2, 1B, 1C, 1D, 1E, 1F, 9D, 10A-10C, 11B, and 12A-12D, and particularly to, e.g., FIGS. 4A-4F for illustrative purposes only and not by way of limitation, second-jaw planar contact surface 140A is located between second second-jaw planar contact surface 140B and second-jaw arcuate convex contact surface 121A. The preceding portion of this paragraph characterizes example 5 of the subject matter, disclosed herein, where example 5 also encompasses example 3 or 4, above.

Locating second-jaw planar contact surface 140A between second second-jaw planar contact surface 140B and second-jaw arcuate convex contact surface 121A provides for first second-jaw space 480, in which one of corners 197 of head 199H of fastener 199 is located.

Locating second-jaw planar contact surface 140A between second second-jaw planar contact surface 140B and second-jaw arcuate convex contact surface 121A provides for second second-jaw space 481 and third second-jaw space 482 in which adjacent ones of corners 197 of head 199H of fastener 199 are located.

Referring generally to FIGS. 1A-1, 1A-2, 1B, 1C, 1D, 1E, 1F, 9D, 10A-10C, 11B, and 12A-12D and particularly to, e.g., FIGS. 2A-2I and 4G for illustrative purposes only and not by way of limitation, second jaw 120 further comprises second second-jaw arcuate convex contact surface 121C. Second-jaw planar contact surface 140A and second second-jaw planar contact surface 140C are located between second-jaw arcuate convex contact surface 121A and second second-jaw arcuate convex contact surface 121C. The preceding portion of this paragraph characterizes example 6 of the subject matter, disclosed herein, where example 6 also encompasses example 3 or 4, above.

Second-jaw planar contact surface 140A and second second-jaw planar contact surface 140C are angularly disposed between second-jaw arcuate convex contact surface 121A and second second-jaw arcuate convex contact surface 121C so that one of corners 197 of fastener 199, such as between external flats 193, 194, is temporarily captured in third second-jaw space 482 between second-jaw arcuate convex contact surface 121A and second second-jaw planar contact surface 140C, and so that corner 197 between external flats 192, 193 is temporarily captured in second second-jaw space 481 between second-jaw planar contact surface 140A and second second-jaw planar contact surface 140B during a non-torqueing rotation of wrench head 100 in direction 521 relative to fastener 199. Temporarily capturing corner 197 between external flats 193, 194 and corner 197 between external flats 192, 193 in combination with the non-torqueing rotation of wrench head 100, opens first jaw 110, second jaw 120, and third jaw 130 relative to each other to enable a ratcheting action of wrench head 100.

Corner 197 between external flats 192, 193 is temporarily captured in second second-jaw space 481 between second-jaw planar contact surface 140A and second second-jaw planar contact surface 140C and corner 197 between external flats 192, 193 rides along second-jaw planar contact surface 140A in direction 515. Corner 197 between external flats 193, 194 is temporarily captured in third second-jaw space 482 between second-jaw arcuate convex contact surface 121A and second second-jaw planar contact surface 140C and corner 197 between external flats 193, 194 rides along second second-jaw planar contact surface 140C in direction 515. The captured one of corners 197 causes second jaw 120 to pivot about axis of rotation 330 to open wrench head 100 until corner 197 between external flats 192, 193 moves past region of contact 183A and corner 197 between external flats 193, 194 moves into second second-jaw space 481 between second-jaw arcuate convex contact surface 121A and second second-jaw planar contact surface 140C. Movement of corner 197 between external flats 192, 193 past region of contact 183A and movement of corner 197 between external flats 193, 194 into second second-jaw space 481 closes wrench head 100 so that a torqueing rotation of wrench head 100 in direction 520 is applied to fastener 199. Here, corner 197 between external flats 194, 195 moves into third second-jaw space 482 between second-jaw arcuate convex contact surface 121A and second second-jaw planar contact surface 140C so as to be temporarily captured, with corner 197 between external flats 193, 194 captured in second second-jaw space 481, as described above, in a next non-torqueing rotation of wrench head 100 to provide wrench head 100 with a ratcheting action.

Referring generally to FIGS. 1A-1, 1A-2, 1B, 1C, 1D, 1E, 1F, 9D, 10A-10C, 11B, and 12A-12D and particularly to, e.g., FIGS. 2C, 2D, and 2H for illustrative purposes only and not by way of limitation, wrench head 100 further comprises compression spring 200, located between first jaw 110 and second jaw 120. Compression spring 200 biases second jaw 120 relative to first jaw 110 from the open second-jaw orientation to the closed second-jaw orientation. The preceding portion of this paragraph characterizes example 7 of the subject matter, disclosed herein, where example 7 also encompasses any one of examples 2 to 6, above.

Disposing compression spring 200 between first jaw 110 and second jaw 120 biases second jaw 120 relative to first jaw 110 so that second jaw 120 closes around head 199H of fastener 199 relative to first jaw 110, as shown in FIGS. 2A, 2C, and 12A-12D.

Referring generally to FIGS. 1A-1, 1A-2, 1B, 1C, 1D, 1E, 1F, 9D, 10A-10C, 11B, and 12A-12D and particularly to, e.g., FIGS. 2C, 2D, 2F, and 4A-4E for illustrative purposes only and not by way of limitation, second jaw 120 further comprises first first-jaw interface surface 603. First jaw 110 further comprises first second-jaw interface surface 203. First second-jaw interface surface 203 is configured to contact first first-jaw interface surface 603 when second jaw 120 is in the open second-jaw orientation. The preceding portion of this paragraph characterizes example 8 of the subject matter, disclosed herein, where example 8 also encompasses example 7, above.

Contact between first first-jaw interface surface 603 and first second-jaw interface surface 203 delimits the open second-jaw orientation, and first first-jaw interface surface 603 and first second-jaw interface surface 203 are not in contact when second jaw 120 is in the closed second-jaw orientation i.e., first first-jaw interface surface 603 and first second-jaw interface surface 203 are separated from each other at an angle. First first-jaw interface surface 603 also engages compression spring 200, where compression spring 200 biases second jaw 120 relative to first jaw 110 from closed second-jaw orientation to open second-jaw orientation.

Second jaw comprises second-jaw base 605 at end 601 of second jaw 120. First first-jaw interface surface 603 is located on second-jaw base 605. Wrench head 100 further comprises manipulation surface 600 located on second-jaw base 605 at end 601 of second jaw 120 adjacent compression spring 200. When depressed toward first jaw 110, manipulation surface 600 causes second jaw 120 and third jaw 130 to pivot about axis of rotation 330, as illustrated in FIG. 2B, to assist with placement of wrench head 100 over head 199H of fastener 199 from direction 1298 (see FIGS. 2B and 12A) relative to axis of rotation 189 of fastener 199. A sequence of placement of wrench head 100 over head 199H of fastener 199 from direction 1298 relative to axis of rotation 189 of fastener 199 is illustrated in FIGS. 12A-12D.

Referring generally to FIGS. 1A-1, 1A-2, 1B, 1C, 1D, 1E, 1F, 9D, 10A-10C, 11B, and 12A-12D and particularly to, e.g., FIGS. 2C and 2D for illustrative purposes only and not by way of limitation, each of first first-jaw interface surface 603 and first second-jaw interface surface 203 is planar. The preceding portion of this paragraph characterizes example 9 of the subject matter, disclosed herein, where example 9 also encompasses example 8, above.

First first-jaw interface surface 603 and first second-jaw interface surface 203 being planar provides for ease of manufacture of first first-jaw interface surface 603 and first second-jaw interface surface 203.

Referring generally to FIGS. 1A-1, 1A-2, 1B, 1C, 1D, 1E, 1F, 9D, 10A-10C, 11B, and 12A-12D and particularly to, e.g., FIGS. 2C and 2D for illustrative purposes only and not by way of limitation, first jaw 110 further comprises recess 222 that receives compression spring 200. The preceding portion of this paragraph characterizes example 10 of the subject matter, disclosed herein, where example 10 also encompasses example 8 or 9, above.

Recess 222 retains a position of compression spring 200 relative to first jaw 110.

Recess 222 is a blind hole, formed in first-jaw base 310. Recess 222 has any suitable cross sectional shape and extends into first jaw 110 any suitable distance so as to retain and at least partially guide movement of compression spring 200.

Referring generally to FIGS. 1A-1, 1A-2, 1B, 1C, 1D, 1E, 1F, 9D, 10A-10C, 11B, and 12A-12D and particularly to, e.g., FIGS. 2A, 2C, 2D, 4A-4E for illustrative purposes only and not by way of limitation, second jaw 120 further comprises protuberance 602. Compression spring 200 is captured between recess 222 and protuberance 602. The preceding portion of this paragraph characterizes example 11 of the subject matter, disclosed herein, where example 11 also encompasses example 10, above.

Protuberance 602 retains a position of compression spring 200 relative to second jaw 120.

Protuberance 602 has any suitable cross sectional shape and extends from first first-jaw interface surface 603 any suitable distance so as to retain compression spring 200 on first first-jaw interface surface 603.

Referring generally to FIGS. 1A-1, 1A-2, 1B, 1C, 1D, 1E, 1F, 9D, 10A-10C, 11B, and 12A-12D and particularly to, e.g., FIGS. 2C and 2D for illustrative purposes only and not by way of limitation, recess 222 has depth 223. Compression spring 200 has a free length, which exceeds depth 223 of recess 222. The preceding portion of this paragraph characterizes example 12 of the subject matter, disclosed herein, where example 12 also encompasses example 11, above.

Depth 223 is adjusted, either during manufacture of recess 222 or by adding suitable spacers to bottom of recess 222, to correspondingly adjust a biasing force of compression spring 200 between first jaw 110 and second jaw 120 for compression spring 200 having a given free length.

Referring generally to FIGS. 1A-1, 1A-2, 1B, 1C, 1D, 1E, 9D, 10A-10C, 11B, and 12A-12D and particularly to, e.g., FIGS. 2C, 3B, 3C, and 4A-4D for illustrative purposes only and not by way of limitation, second jaw 120 further comprises second first-jaw interface surface 400. First jaw 110 further comprises second second-jaw interface surface 300, configured to contact second first-jaw interface surface 400 when second jaw 120 is in the closed second-jaw orientation. The preceding portion of this paragraph characterizes example 13 of the subject matter, disclosed herein, where example 13 also encompasses any one of examples 8 to 12, above.

Second second-jaw interface surface 300 of first jaw 110 contacts second first-jaw interface surface 400 of second jaw 120 to arrest a closing rotation of second jaw 120 relative to first jaw 110 against bias of compression spring 200.

Referring generally to FIGS. 1A-1, 1A-2, 1B, 1C, 1D, 1E, 9D, 10A-10C, 11B, and 12A-12D and particularly to, e.g., FIGS. 2G and 2J for illustrative purposes only and not by way of limitation, when second jaw 120 is in the open second-jaw orientation relative to first jaw 110, and third jaw 130 is in an open third-jaw orientation relative to second jaw 120, first-jaw virtual circle 391 is perpendicular to third-jaw arcuate convex contact surfaces 131, is not in contact with any of third-jaw arcuate convex contact surfaces 131, and does not intersect any of third-jaw arcuate convex contact surfaces 131. The preceding portion of this paragraph characterizes example 14 of the subject matter, disclosed herein, where example 14 also encompasses example 2, above.

Opening third jaw 130 so that first-jaw virtual circle 391 is not in contact with any of third-jaw arcuate convex contact surfaces 131, and does not intersect any of third-jaw arcuate convex contact surfaces 131 provides for placement of wrench head 100 over head 199H of fastener 199, such as by moving wrench head 100 in direction 1298 (see FIGS. 2B and 12A).

Referring generally to FIGS. 1A-1, 1A-2, 1B, 1C, 1D, 1E, 1F, 9D, 10A-10C, 11B, and 12A-12D and particularly to, e.g., FIGS. 2A, 2B, 2E, 2F, 2G, 2K, 2L, 4F, 4G, 4I, 9E, and 9F for illustrative purposes only and not by way of limitation, wrench head 100 further comprises torsion spring 211, located between second jaw 120 and third jaw 130. Torsion spring 211 biases third jaw 130 relative to second jaw 120 from the open third-jaw orientation to the closed third-jaw orientation. Second jaw 120 further comprises second second-jaw arcuate convex contact surface 121B, 121C. Second-jaw virtual circle 491 is perpendicular to second-jaw arcuate convex contact surface 121A, to second-jaw planar contact surface 140A, and to second second-jaw arcuate convex contact surface 121B, 121C, has single point contact with each of second-jaw arcuate convex contact surface 121A and second second-jaw arcuate convex contact surface 121B, 121C, and intersects second-jaw planar contact surface 140A at only two points. When third jaw 130 is in the closed third-jaw orientation relative to second jaw 120, second-jaw virtual circle 491 is perpendicular to third-jaw arcuate convex contact surfaces 131 and has single point contact with third-jaw arcuate convex contact surfaces 131. The preceding portion of this paragraph characterizes example 15 of the subject matter, disclosed herein, where example 15 also encompasses example 14, above.

Disposing torsion spring 211 between second jaw 120 and third jaw 130 biases third jaw 130 relative to first jaw 110 so that third jaw 130 closes around head 199H of fastener 199 relative to second jaw 120, as shown in FIGS. 2C and 2D as well as FIGS. 12A-12D. Second second-jaw arcuate convex contact surface 121B, 121C provides region of contact 184A, 182A between second jaw 120 and head 199H of fastener 199 so as to apply torque to head 199H during a torqueing rotation of wrench head 100.

Second-jaw virtual circle 491 has points of contact 181B-186B (see FIGS. 1A-2 and 2A). Points of contact 182B, 183B, 185B of second-jaw virtual circle 491 have single point contact with second-jaw arcuate convex contact surface 121A and second-jaw planar contact surface 140A (see FIGS. 2A, 2E, 2F, and 4A). Point of contact 183B of second-jaw virtual circle 491 has single point contact with one of third-jaw arcuate convex contact surfaces 131 when third jaw 130 is in the closed third-jaw orientation. Point of contact 186B of second-jaw virtual circle 491 has single point contact with one of third-jaw arcuate convex contact surfaces 131 when third jaw 130 is in the closed third-jaw orientation (see FIGS. 2E and 2F). Points of contact 181B-184B of second-jaw virtual circle 491 have single point contact with first-jaw arcuate convex contact surface 111A, second first-jaw arcuate convex contact surface 111B, and third first-jaw arcuate convex contact surface 111C when second jaw 120 is in the closed second-jaw orientation (see FIGS. 2E and 2F). Each one of regions of contact 181A-186A (see, e.g., FIG. 2A) encompasses a respective one of points of contact 181B-186B (see, e.g., FIG. 2A) of second-jaw virtual circle 491 (see FIG. 2A), such that placement of points of contact 182B, 183B, 185B of second-jaw virtual circle 491 at respective external flats 191, 192, 194 of head 199H also enables placement of regions of contact 182A, 183A, 185A at respective external flats 191, 192, 194.

Torsion spring 211 is captured between second jaw 120 and third jaw 130 by second hinge pin 440. While one torsion spring 211 is illustrated as being held captive on second hinge pin 440 in one or more examples, another torsion spring, substantially similar to torsion spring 211, is held captive by second hinge pin 440 on the opposite side of third jaw 130 relative to torsion spring 211. In one or more examples, second second-jaw arcuate convex contact surface 121B forms second second-jaw space 481 with second-jaw planar contact surface 140A. Second second-jaw space 481 temporarily captures one of corners 197 of head 199H causing second jaw 120 to pivot about axis of rotation 330 to open wrench head 100 as described herein to provide wrench head 100 with a ratcheting action.

Referring generally to FIGS. 1A-1, 1A-2, 1B, 1C, 1D, 1E, 1F, 9D, 10A-10C, 11B, and 12A-12D and particularly to, e.g., FIG. 2K for illustrative purposes only and not by way of limitation, when third jaw 130 is in the open third-jaw orientation relative to second jaw 120, second-jaw virtual circle 491 is perpendicular to third-jaw arcuate convex contact surfaces 131, is not in contact with any of third-jaw arcuate convex contact surfaces 131, and does not intersect any of third-jaw arcuate convex contact surfaces 131. The preceding portion of this paragraph characterizes example 16 of the subject matter, disclosed herein, where example 16 also encompasses example 15, above.

Opening third jaw 130 so that second-jaw virtual circle 491 is not in contact with any of third-jaw arcuate convex contact surfaces 131, and does not intersect any of third-jaw arcuate convex contact surfaces 131 provides for placement of wrench head 100 over head 199H of fastener 199, such as by moving wrench head 100 in direction 1298 (see FIGS. 2B and 12A).

Referring generally to FIGS. 1A-1, 1A-2, 1B, 1C, 1D, 1E, 1F, 9D, 10A-10C, 11B, and 12A-12D and particularly to, e.g., FIGS. 9E and 9F for illustrative purposes only and not by way of limitation, torsion spring 211 has first leg 212, engaging third jaw 130, and second leg 213, engaging second jaw 120. The preceding portion of this paragraph characterizes example 17 of the subject matter, disclosed herein, where example 17 also encompasses example 15, above.

Torsion spring 211 provides for a compact spring that is located between second jaw 120 and third jaw 130 and produces a torsional biasing force that biases third jaw 130 from closed third-jaw orientation to open third-jaw orientation.

Referring generally to FIGS. 1A-1, 1A-2, 1B, 1C, 1D, 1E, 1F, 9D, 10A-10C, 11B, and 12A-12D and particularly to, e.g., FIGS. 2C, 2D, 4C-4E, and 5A-5H for illustrative purposes only and not by way of limitation, third jaw 130 further comprises third second-jaw interface surface 500. Second jaw 120 further comprises third-jaw interface surface 410. Third-jaw interface surface 410 is configured to contact third second-jaw interface surface 500 when third jaw 130 is in the closed third-jaw orientation. The preceding portion of this paragraph characterizes example 18 of the subject matter, disclosed herein, where example 18 also encompasses any one of examples 15 to 17, above.

Third-jaw interface surface 410 of second jaw 120 contacts third second-jaw interface surface 500 of third jaw 130 to arrest a closing rotation of third jaw 130 relative to second jaw 120 against bias force of torsion spring 211. Contact between third-jaw interface surface 410 and third second-jaw interface surface 500 places third-jaw arcuate convex contact surfaces 131 in point contact (see points of contact 183B, 186B in FIGS. 2E and 2F) with second-jaw virtual circle 491.

Referring generally to FIGS. 1A-1, 1A-2, 1B, 1C, 1D, 1E, 1F, 9D, 10A-10C, 11B, and 12A-12D and particularly to, e.g., FIGS. 2C and 2D for illustrative purposes only and not by way of limitation, when third jaw 130 is in the closed third-jaw orientation, third second-jaw interface surface 500 is parallel with third-jaw interface surface 410. When third jaw 130 is in the open third-jaw orientation, third second-jaw interface surface 500 and third-jaw interface surface 410 are oblique to each other. The preceding portion of this paragraph characterizes example 19 of the subject matter, disclosed herein, where example 19 also encompasses example 18, above.

Third second-jaw interface surface 500 being parallel with third-jaw interface surface 410 when third jaw 130 is in closed third-jaw orientation and being oblique to third-jaw interface surface 410 when third jaw 130 is in open third-jaw orientation provides for freedom of movement of third jaw 130, relative to second jaw 120, between closed third-jaw orientation and open third-jaw orientation while providing substantial planar contact between third second-jaw interface surface 500 and third-jaw interface surface 410.

Referring generally to FIGS. 1A-1, 1A-2, 1B, 1C, 1D, 1E, 1F, 9D, 10A-10C, 11B, and 12A-12D and particularly to, e.g., FIGS. 2A-2G, 2L, 4A-4H, 4F, 9E, and 9F for illustrative purposes only and not by way of limitation, wrench head 100 further comprises torsion spring 211, located between second jaw 120 and third jaw 130 and biasing third jaw 130 relative to second jaw 120 from the open third-jaw orientation to the closed third-jaw orientation. Second jaw 120 further comprises second second-jaw planar contact surface 140B, 140C. Second-jaw virtual circle 491 is perpendicular to second-jaw arcuate convex contact surface 121A, to second-jaw planar contact surface 140A, and to second second-jaw planar contact surface 140B, 140C, has single point contact with second-jaw arcuate convex contact surface 121A, and intersects each of second-jaw planar contact surface 140A and second second-jaw planar contact surface 140B, 140C at only two points. When third jaw 130 is in the closed third-jaw orientation relative to second jaw 120, second-jaw virtual circle 491 is perpendicular to third-jaw arcuate convex contact surfaces 131 and has single point contact with each of third-jaw arcuate convex contact surfaces 131. The preceding portion of this paragraph characterizes example 20 of the subject matter, disclosed herein, where example 20 also encompasses example 14, above.

Disposing torsion spring 211 between second jaw 120 and third jaw 130 biases third jaw 130 relative to first jaw 110 so that third jaw 130 closes around head 199H of fastener 199 relative to second jaw 120, as shown in FIGS. 2C and 2D as well as FIGS. 12A-12D. Second second-jaw planar contact surface 140B, 140C provides region of contact 184A, 182A between second jaw 120 and head 199H of fastener 199 so as to apply torque to head 199H during a torqueing rotation of wrench head 100. Second second-jaw planar contact surface 140B, 140C prevents, through contact with fastener 199, closing of wrench head 100 during a ratcheting motion of wrench head 100.

Torsion spring 211 is captured between second jaw 120 and third jaw 130 by second hinge pin 440. While one torsion spring 211 is illustrated as being held captive on second hinge pin 440 in one or more examples, another torsion spring, substantially similar to torsion spring 211, is held captive by second hinge pin 440 on an opposite side of third jaw 130 relative to torsion spring 211. In one or more examples, first second-jaw space 480 is formed between second-jaw planar contact surface 140A and second second-jaw planar contact surface 140B. First second-jaw space 480 temporarily captures one of corners 197 of head 199H causing second jaw 120 to pivot about axis of rotation 330 to open wrench head 100 as described herein to provide wrench head 100 with a ratcheting action.

Referring generally to FIGS. 1A-1, 1A-2, 1B, 1C, 1D, 1E, 1F, 9D, 10A-10C, 11B, and 12A-12D and particularly to, e.g., FIG. 2K for illustrative purposes only and not by way of limitation, when third jaw 130 is in the open third-jaw orientation relative to second jaw 120, second-jaw virtual circle 491 is perpendicular to third-jaw arcuate convex contact surfaces 131, is not in contact with any of third-jaw arcuate convex contact surfaces 131, and does not intersect any of third-jaw arcuate convex contact surfaces 131. The preceding portion of this paragraph characterizes example 21 of the subject matter, disclosed herein, where example 21 also encompasses example 20, above.

Opening third jaw 130 so that second-jaw virtual circle 491 is not in contact with any of third-jaw arcuate convex contact surfaces 131, and does not intersect any of third-jaw arcuate convex contact surfaces 131 provides for lateral insertion of head 199H of fastener 199 into wrench head 100 in direction 1298 (see FIGS. 2B and 12A).

Referring generally to FIGS. 1A-1, 1A-2, 1B, 1C, 1D, 1E, 1F, 9D, 10A-10C, 11B, and 12A-12D and particularly to, e.g., FIGS. 9E and 9F for illustrative purposes only and not by way of limitation, torsion spring 211 has first leg 212, engaging third jaw 130, and second leg 213, engaging second jaw 120. The preceding portion of this paragraph characterizes example 22 of the subject matter, disclosed herein, where example 22 also encompasses example 20 or 21, above.

Torsion spring 211 provides for a compact spring that is located between second jaw 120 and third jaw 130 and produces a torsional biasing force that biases third jaw 130 from closed third-jaw orientation to open third-jaw orientation.

Referring generally to FIGS. 1A-1, 1A-2, 1B, 1C, 1D, 1E, 1F, 9D, 10A-10C, 11B, and 12A-12D and particularly to, e.g., FIGS. 2C, 2D, 4C-4E, and 5A-5H for illustrative purposes only and not by way of limitation, third jaw 130 further comprises third second-jaw interface surface 500. Second jaw 120 further comprises third-jaw interface surface 410. Third-jaw interface surface 410 is configured to contact third second-jaw interface surface 500 when third jaw 130 is in the closed third-jaw orientation. The preceding portion of this paragraph characterizes example 23 of the subject matter, disclosed herein, where example 23 also encompasses any one of examples 20 to 22, above.

Third-jaw interface surface 410 of second jaw 120 contacts third second-jaw interface surface 500 of third jaw 130 to arrest a closing rotation of third jaw 130 relative to second jaw 120 against bias force of torsion spring 211. Contact between third-jaw interface surface 410 and third second-jaw interface surface 500 places third-jaw arcuate convex contact surfaces 131 in point contact (see, e.g., points of contact 183B, 186B in FIGS. 2E and 2F) with second-jaw virtual circle 491.

Referring generally to FIGS. 1A-1, 1A-2, 1B, 1C, 1D, 1E, 1F, 9D, 10A-10C, 11B, and 12A-12D and particularly to, e.g., FIGS. 2C and 2D for illustrative purposes only and not by way of limitation, when third jaw 130 is in the closed third-jaw orientation, third second-jaw interface surface 500 is parallel with third-jaw interface surface 410. When third jaw 130 is in the open third-jaw orientation, third second-jaw interface surface 500 and third-jaw interface surface 410 are oblique to each other. The preceding portion of this paragraph characterizes example 24 of the subject matter, disclosed herein, where example 24 also encompasses example 23, above.

Third second-jaw interface surface 500 being parallel with third-jaw interface surface 410 when third jaw 130 is in closed third-jaw orientation and being oblique to third-jaw interface surface 410 when third jaw 130 is in open third-jaw orientation provides for freedom of movement of third jaw 130, relative to second jaw 120, between closed third-jaw orientation and open third-jaw orientation while providing substantial planar contact between third second-jaw interface surface 500 and third-jaw interface surface 410.

Referring generally to FIGS. 1A-1, 1A-2, 1B, 1C, 1D, 1E, 1F, 9D, 10A-10C, 11B, and 12A-12D and particularly to, e.g., FIGS. 2A, 2B, 2E-2G, 2L, 4F, 4G, 9E, and 9F for illustrative purposes only and not by way of limitation, wrench head 100 further comprises torsion spring 211, located between second jaw 120 and third jaw 130. Torsion spring 211 biases third jaw 130 relative to second jaw 120 from the open third-jaw orientation to the closed third-jaw orientation. Second jaw 120 further comprises second second-jaw arcuate convex contact surface 121B, 121C and second second-jaw planar contact surface 140B, 140C. Second-jaw virtual circle 491 is perpendicular to second-jaw arcuate convex contact surface 121A, to second second-jaw arcuate convex contact surface 121B, 121C, to second-jaw planar contact surface 140A, and to second second-jaw planar contact surface 140B, 140C, has single point contact with each of second-jaw arcuate convex contact surface 121A and second second-jaw arcuate convex contact surface 121B, 121C, and intersects each of second-jaw planar contact surface 140A and second second-jaw planar contact surface 140B, 140C at only two points. When third jaw 130 is in the closed third-jaw orientation relative to second jaw 120, second-jaw virtual circle 491 is perpendicular to third-jaw arcuate convex contact surfaces 131 and has single point contact with each of third-jaw arcuate convex contact surfaces 131. The preceding portion of this paragraph characterizes example 25 of the subject matter, disclosed herein, where example 25 also encompasses example 14, above.

Disposing torsion spring 211 between second jaw 120 and third jaw 130 biases third jaw 130 relative to first jaw 110 so that third jaw 130 closes around head 199H of fastener 199 relative to second jaw 120, as shown in FIGS. 2A and 2C. Second second-jaw arcuate convex contact surface 121B, 121C provides region of contact 182A, 184A between second jaw 120 and head 199H of fastener 199, and second second-jaw planar contact surface 140B, 140C provides region of contact 182A, 184A between second jaw 120 and head 199H of fastener 199, so as to apply torque to head 199H during a torqueing rotation of wrench head 100. Second second-jaw planar contact surface 140B, 140C prevents, through contact with fastener 199, closing of wrench head 100 during a ratcheting motion of wrench head 100.

Referring generally to FIGS. 1A-1, 1A-2, 1B, 1C, 1D, 1E, 9D, 10A-10C, 11B, and 12A-12D and particularly to, e.g., FIG. 2K for illustrative purposes only and not by way of limitation, when third jaw 130 is in the open third-jaw orientation relative to second jaw 120, second-jaw virtual circle 491 is perpendicular to third-jaw arcuate convex contact surfaces 131 and is not in contact with any of third-jaw arcuate convex contact surfaces 131. The preceding portion of this paragraph characterizes example 26 of the subject matter, disclosed herein, where example 26 also encompasses example 25, above.

Opening third jaw 130 so that second-jaw virtual circle 491 is not in contact with any of third-jaw arcuate convex contact surfaces 131 provides for placement of wrench head 100 over head 199H of fastener 199, such as by moving wrench head 100 in direction 1298 (see FIGS. 2B and 12A).

Referring generally to FIGS. 1A-1, 1A-2, 1B, 1C, 1D, 1E, 1F, 9D, 10A-10C, 11B, and 12A-12D and particularly to, e.g., FIGS. 9E and 9F for illustrative purposes only and not by way of limitation, torsion spring 211 has first leg 212, engaging third jaw 130, and second leg 213, engaging second jaw 120. The preceding portion of this paragraph characterizes example 27 of the subject matter, disclosed herein, where example 27 also encompasses example 25 or 26, above.

Torsion spring 211 provides for a compact spring that is located between second jaw 120 and third jaw 130 and produces a torsional biasing force that biases third jaw 130 from the open third-jaw orientation to the second third-jaw orientation.

Referring generally to FIGS. 1A-1, 1A-2, 1B, 1C, 1D, 1E, 1F, 9D, 10A-10C, 11B, and 12A-12D and particularly to, e.g., FIGS. 2C, 2D, and 5A-5H for illustrative purposes only and not by way of limitation, third jaw 130 further comprises third second-jaw interface surface 500. Second jaw 120 further comprises third-jaw interface surface 410. Third-jaw interface surface 410 is configured to contact third second-jaw interface surface 500 when third jaw 130 is in the closed third-jaw orientation. The preceding portion of this paragraph characterizes example 28 of the subject matter, disclosed herein, where example 28 also encompasses any one of examples 25 to 27, above.

Third-jaw interface surface 410 of second jaw 120 contacts third second-jaw interface surface 500 of third jaw 130 to arrest a closing rotation of third jaw 130 relative to second jaw 120 against bias force of torsion spring 211. Contact between third-jaw interface surface 410 and third second-jaw interface surface 500 places third-jaw arcuate convex contact surfaces 131 in point contact (see, e.g., points of contact 183B, 186B in FIGS. 2E and 2F) with second-jaw virtual circle 491.

Referring generally to FIGS. 1A-1, 1A-2, 1B, 1C, 1D, 1E, 1F, 9D, 10A-10C, 11B, and 12A-12D and particularly to, e.g., FIGS. 2C and 2D for illustrative purposes only and not by way of limitation, when third jaw 130 is in the closed third-jaw orientation relative to second jaw 120, third second-jaw interface surface 500 is parallel with third-jaw interface surface 410. When third jaw 130 is in the open third-jaw orientation, third second-jaw interface surface 500 and third-jaw interface surface 410 are oblique to each other. The preceding portion of this paragraph characterizes example 29 of the subject matter, disclosed herein, where example 29 also encompasses example 28, above.

Third second-jaw interface surface 500 being parallel with third-jaw interface surface 410 when third jaw 130 is in closed third-jaw orientation and being oblique to third-jaw interface surface 410 when third jaw 130 is in open third-jaw orientation provides for freedom of movement of third jaw 130, relative to second jaw 120, between closed third-jaw orientation and open third-jaw orientation while providing substantial planar contact between third second-jaw interface surface 500 and third-jaw interface surface 410.

Referring generally to FIGS. 1A-1, 1A-2, 1B, 1C, 1D, 1E, 1F, 9D, 10A-10C, 11B, and 12A-12D and particularly to, e.g., FIGS. 2A, 2F, 2G, 2J, 3L, and 3A for illustrative purposes only and not by way of limitation, first-jaw virtual circle 391 is perpendicular to first-jaw planar contact surface 160 and intersects first-jaw planar contact surface 160 at only two points. The preceding portion of this paragraph characterizes example 30 of the subject matter, disclosed herein, where example 30 also encompasses any one of examples 1 to 29, above.

First-jaw planar contact surface 160 intersecting first-jaw virtual circle 391 at only two points locates first-jaw planar contact surface 160 relative to working axis 1089 so that corners 197 of fastener 199 slide along first-jaw planar contact surface 160 during a ratcheting motion of wrench head 100. First-jaw planar contact surface 160 intersecting first-jaw virtual circle 391 at only two points locates first-jaw planar contact surface 160 relative to working axis 1089 so that contact between fastener 199 and first-jaw planar contact surface 160 is increased compared line contact, such as between fastener 199 and each one of first-jaw arcuate convex contact surface 111A, second first-jaw arcuate convex contact surface 111B, and third first-jaw arcuate convex contact surface 111C.

Referring generally to FIGS. 1A-1, 1A-2, 1B, 1C, 1D, 1E, 9D, 10A-10C, 11B, and 12A-12D and particularly to, e.g., FIGS. 1F, 2A, 2B, 2G-2I, and 3A-3D for illustrative purposes only and not by way of limitation, first jaw 110 further comprises first-jaw notch 265, located between first-jaw planar contact surface 160 and third first-jaw arcuate convex contact surface 111C. The preceding portion of this paragraph characterizes example 31 of the subject matter, disclosed herein, where example 31 also encompasses any one of examples 1 to 30, above.

First-jaw notch 265, disposed between and formed by first-jaw planar contact surface 160 and third first-jaw arcuate convex contact surface 111C, temporarily captures corner 197 of fastener 199 (such as between external flats 192, 193) during a non-torqueing rotation of wrench head 100 in direction 521 relative to fastener 199. Temporarily capturing corner 197 in combination with the non-torqueing rotation of wrench head 100, pivots first jaw 110 so that first-jaw arcuate convex contact surface 111A and second first-jaw arcuate convex contact surface 111B disengage fastener 199 to enable a ratcheting action of wrench head 100.

Corner 197 such as between external flats 192, 193 is temporarily captured within first-jaw notch 265 and rides along first-jaw planar contact surface 160 in direction 516 (see FIG. 2A). Captured corner 197 causes first jaw 110 to pivot about captured corner 197 to disengage first-jaw arcuate convex contact surface 111A and second first-jaw arcuate convex contact surface 111B from fastener 199 until corner 197 moves out of first-jaw notch 265 onto first-jaw planar contact surface 160 so that corner 197 between external flats 192, 193 slides along first-jaw planar contact surface 160 and until corner 197 between external flats 193, 194 moves into or enters first-jaw notch 265. Movement of corner 197 between external flats 193, 194 into first-jaw notch 265 closes wrench head 100 and re-engages first-jaw arcuate convex contact surface 111A and second first-jaw arcuate convex contact surface 111B with fastener 199 so that a torqueing rotation of wrench head 100 about working axis 1089 in direction 520 may be applied to fastener 199.

Referring generally to FIGS. 1A-1, 1A-2, 1B, 1C, 1D, 1E, 1F, 9D, 10A-10C, 11B, and 12A-12D and particularly to, e.g., FIG. 4F for illustrative purposes only and not by way of limitation, second jaw 120 further comprises second second-jaw arcuate convex contact surface 121B. Second second-jaw arcuate convex contact surface 121B is located between second-jaw arcuate convex contact surface 121A and second-jaw planar contact surface 140A. The preceding portion of this paragraph characterizes example 32 of the subject matter, disclosed herein, where example 32 also encompasses any one of examples 1 to 5, 14, 30, and 31, above.

Second second-jaw arcuate convex contact surface 121B is angularly separated from second-jaw planar contact surface 140A so that one of corners 197 of fastener 199, such as between external flats 192, 193, is temporarily captured in second second-jaw space 481 between second second-jaw arcuate convex contact surface 121B and second-jaw planar contact surface 140A during a non-torqueing rotation of wrench head 100 in direction 521 relative to fastener 199. Temporarily capturing one of corners 197 in combination with the non-torqueing rotation of wrench head 100, opens first jaw 110, second jaw 120, and third jaw 130 relative to each other to enable a ratcheting action of wrench head 100.

One of corners 197, such as between external flats 192, 193, is temporarily captured in second second-jaw space 481 between second-jaw planar contact surface 140A and second second-jaw arcuate convex contact surface 121B and corner 197 between external flats 192, 193 rides along second-jaw planar contact surface 140A in direction 515. The captured one of corners 197 between external flats 192, 193 causes second jaw 120 to pivot about axis of rotation 330 to open wrench head 100 until corner 197 between external flats 193, 194 moves past region of contact 183A so that corner 197 between external flats 192, 193 moves into first second-jaw space 480 between second second-jaw planar contact surface 140B and second-jaw planar contact surface 140A, and so that corner 197 between external flats 193, 194 moves into second second-jaw space 481 between second second-jaw arcuate convex contact surface 121B and second-jaw planar contact surface 140A. Movement of corner 197 between external flats 192, 193 into first second-jaw space 480 and movement of corner 197 between external flats 193, 194 into second second-jaw space 481 closes wrench head 100 so that a torqueing rotation of wrench head 100 in direction 520 is applied to fastener 199. Here, corner 197 between external flats 192, 193 and corner 197 between external flats 193, 194 are temporarily captured, as described above, in the next non-torqueing rotation of wrench head 100 to provide wrench head 100 with a ratcheting action.

Referring generally to FIGS. 1A-1, 1A-2, 1B, 1C, 1D, 1E, 1F, 9D, 10A-10C, 11B, and 12A-12D and particularly to, e.g., FIGS. 4G and 4I for illustrative purposes only and not by way of limitation, second jaw 120 further comprises second second-jaw arcuate convex contact surface 121C. Second-jaw planar contact surface 140A is located between second-jaw arcuate convex contact surface 121A and second second-jaw arcuate convex contact surface 121C. The preceding portion of this paragraph characterizes example 33 of the subject matter, disclosed herein, where example 33 also encompasses any one of examples 1 to 4, 14, 30, and 31, above.

Angularly locating second-jaw planar contact surface 140A about working axis 1089 between second-jaw arcuate convex contact surface 121A and second second-jaw arcuate convex contact surface 121C prevents rounding off of corners 197 of head 199H when wrench head 100 tightens fastener 199.

Referring generally to FIGS. 1A-1, 1A-2, 1B, 1C, 1D, 1E, 1F, 9D, 10A-10C, 11B, and 12A-12D and particularly to, e.g., FIGS. 5A and 5B for illustrative purposes only and not by way of limitation, third-jaw arcuate convex contact surfaces 131 are two in number. The preceding portion of this paragraph characterizes example 34 of the subject matter, disclosed herein, where example 34 also encompasses any one of examples 1 to 33, above.

Third-jaw arcuate convex contact surfaces 131, being two in number, are configured to engage two of external flats 190-195 of head 199H of fastener 199 that are not adjacent to each other. Third-jaw arcuate convex contact surfaces 131, being two in number, contact fewer than all external flats 190-195 of head 199H of fastener 199 to enable opening of first jaw 110, second jaw 120, and third jaw 130 for placement of wrench head 100 around external flats 190-195 of head 199H (as illustrated in FIG. 12A) and closing of first jaw 110, second jaw 120, and third jaw 130 for engaging of external flats 190-195 of head 199H (as illustrated in FIG. 12D), such as when torque is applied to wrench head 100 about working axis 1089.

Referring to FIGS. 2A-5B, the different combinations of first-jaw arcuate convex contact surface 111A, second first-jaw arcuate convex contact surface 111B, third first-jaw arcuate convex contact surface 111C, first-jaw planar contact surface 160, second-jaw arcuate convex contact surface 121A, second second-jaw arcuate convex contact surface 121B, second-jaw planar contact surface 140A, second second-jaw planar contact surface 140B, and third-jaw arcuate convex contact surfaces 131, described with respect to FIGS. 2A-5B, collectively engage all six of external flats 190-195 of head 199H of fastener 199. Collective engagement of all external flats 190-195 of head 199H of fastener 199 produces substantially the same amount of torque on each external flat 190-195 to substantially prevent deformation of head 199H and rounding off of corners 197 of head 199H when wrench head 100 tightens fastener 199.

In one or more examples, referring to FIGS. 2A-2I and 3A-4I, first jaw 110 and second jaw 120 are configured to commonly engage at least two external flats 191, 192 of head 199H of fastener 199. First jaw 110, in combination with second jaw 120, commonly engaging at least two external flats, e.g., external flats 191, 192, of head 199H of fastener 199 (e.g., the same external flats are engaged by both first jaw 110 and second jaw 120) increases the size (e.g., length and/or width) of regions of contact 182A, 183A of regions of contact 181A-186A with fastener 199. First jaw 110 and second jaw 120 engaging external flats 191, 192 enables opening and closing of wrench head 100 when placing wrench head 100 around or removing wrench head 100 from head 199H of fastener 199.

In one or more examples, referring to FIGS. 2A-2I and 5A-5B, first-jaw planar contact surface 160 and one of third-jaw arcuate convex contact surfaces 131 commonly engage external flat 192 of head 199H of fastener 199. One of the third-jaw arcuate convex contact surfaces 131 commonly engaging, in combination with first-jaw planar contact surface 160, external flat 192 of head 199H of fastener 199 increases the size (e.g., length and/or width) of region of contact 183A of regions of contact 181A-186A with fastener 199. First-jaw planar contact surface 160 and one of third-jaw arcuate convex contact surface 131 engaging external flat 192 enables opening and closing of wrench head 100 when placing wrench head 100 around or removing wrench head 100 from head 199H of fastener 199.

In one or more examples, referring to FIGS. 2A-2I, 4A-4E, and 5A-5B, third jaw 130 and one or more of second second-jaw arcuate convex contact surface 121B and second-jaw planar contact surface 140A commonly engage external flat 192 of head 199H of fastener 199. One of third-jaw arcuate convex contact surfaces 131 and second-jaw planar contact surface 140A commonly engaging external flat 192 of head 199H of fastener 199 (e.g., the same external flats are engaged by both second jaw 120 and third jaw 130) increases the size (e.g., length and/or width) of region of contact 183A of regions of contact 181A-186A with fastener 199. Third-jaw arcuate convex contact surfaces 131 and second-jaw planar contact surface 140A engaging external flat 192 enables opening and closing of wrench head 100 when placing wrench head 100 around or removing wrench head 100 from head 199H of fastener 199.

In one or more examples, referring to FIGS. 2A-2I, 3A-4E, and 5A-5B, one or more of first jaw 110, second jaw 120, and third jaw 130 commonly engage external flats 191, 192, 193 of head 199H of fastener 199. First jaw 110, second jaw 120, and third jaw 130 engaging, in combination, external flats 191, 192, 193 of head 199H of fastener 199 (e.g., the same ones of external flats 191, 192, 193 are engaged by first jaw 110, second jaw 120, and third jaw 130) increases the size (e.g., length and/or width) of regions of contact 182A, 183A, 184A of regions of contact 181A-186A with fastener 199. First jaw 110, second jaw 120, and third jaw 130 engaging external flats 191, 192, and 193 enables opening and closing of wrench head 100 when placing wrench head 100 around or removing wrench head 100 from head 199H of fastener 199.

Referring generally to FIGS. 1A-1, 1A-2, 1B, 1C, 1D, 1E, 1F, 9D, 10A-10C, 11B, and 12A-12D and particularly to, e.g., FIGS. 3B, 3C, 3D, 6, 8, 9A, and 9B for illustrative purposes only and not by way of limitation, first jaw 110 further comprises first first-jaw tine 311 and second first-jaw tine 312. Second first-jaw tine 312 extends parallel to first first-jaw tine 311. Second jaw 120 is coupled to first jaw 110 between first first-jaw tine 311 and second first-jaw tine 312. Second jaw 120 is configured to pivot relative to first jaw 110. The preceding portion of this paragraph characterizes example 35 of the subject matter, disclosed herein, where example 35 also encompasses any one of examples 1 to 34, above.

Second jaw 120 being disposed between first first-jaw tine 311 and second first-jaw tine 312 provides for alignment of first-jaw arcuate convex contact surface 111A, second first-jaw arcuate convex contact surface 111B, third first-jaw arcuate convex contact surface 111C, first-jaw planar contact surface 160, second-jaw arcuate convex contact surface 121A, and second-jaw planar contact surface 140A so that wrench head 100 has width 710, as shown in FIG. 7, substantially equal to width 700 of head 199H of fastener 199.

In one or more examples, width 710 is greater than or less than width 700 of head 199H. First first-jaw tine 311 and second first-jaw tine 312 extend from first-jaw base 310.

Referring generally to FIGS. 1A-1, 1A-2, 1B, 1C, 1D, 1E, 1F, 9D, 10A-10C, 11B, and 12A-12D and particularly to, e.g., FIGS. 3B, 3D, 9A, and 9B for illustrative purposes only and not by way of limitation, first jaw 110 further comprises first-jaw bridge 315, interconnecting first first-jaw tine 311 and second first-jaw tine 312. The preceding portion of this paragraph characterizes example 36 of the subject matter, disclosed herein, where example 36 also encompasses example 35, above.

First-jaw bridge 315 substantially prevents spreading of or increasing a distance between first first-jaw tine 311 and second first-jaw tine 312 such as when applying torque to fastener 199. First-jaw bridge 315 forms a portion of region of contact 184A as shown in FIG. 3D.

In one or more examples, first-jaw bridge 315 is omitted, as shown in FIG. 3C, where clips 321 are employed on first hinge pin 320 to substantially prevent spreading of or increasing a distance between first first-jaw tine 311 and second first-jaw tine 312 such as when applying torque to fastener 199. Clips 321 are, for example, C-clips that snap into respective grooves of first hinge pin 320 so as to prevent spreading of first first-jaw tine 311 relative to second first-jaw tine 312. In one or more examples, first hinge pin 320 is press/friction fit to one of first jaw 110 and second jaw 120 and has a clearance fit with another of first jaw 110 and second jaw 120. Where first hinge pin 320 is press/friction fit to first jaw 110, friction between first hinge pin 320 and first jaw 110 substantially prevents spreading of or increasing the distance between first first-jaw tine 311 and second first-jaw tine 312 such as when applying torque to fastener 199.

Referring generally to FIGS. 1A-1, 1A-2, 1B, 1C, 1D, 1E, 1F, 9D, 10A-10C, 11B, and 12A-12D and particularly to, e.g., FIGS. 4B, 4C, 4D, 4E, 6, 8, 9E, and 9F for illustrative purposes only and not by way of limitation, second jaw 120 further comprises first second-jaw tine 420 and second second-jaw tine 421. Second second-jaw tine 421 extends parallel to first second-jaw tine 420. Third jaw 130 is coupled to second jaw 120 between first second-jaw tine 420 and second second-jaw tine 421. Third jaw 130 is configured to pivot relative to second jaw 120. The preceding portion of this paragraph characterizes example 37 of the subject matter, disclosed herein, where example 37 also encompasses any one of examples 1 to 36, above.

Third jaw 130 being disposed between first second-jaw tine 420 and second second-jaw tine 421 provides for alignment of first-jaw arcuate convex contact surface 111A, second first-jaw arcuate convex contact surface 111B, third first-jaw arcuate convex contact surface 111C, first-jaw planar contact surface 160, second-jaw arcuate convex contact surface 121A, second-jaw planar contact surface 140A, and third-jaw arcuate convex contact surfaces 131 so that wrench head 100 has width 710, as shown in FIG. 7, substantially equal to width 700 of head 199H of fastener 199.

In one or more examples, width 710 is greater than or less than width 700 of head 199H. First second-jaw tine 420 and second second-jaw tine 421 extend from second-jaw base 605.

Referring generally to FIGS. 1A-1, 1A-2, 1B, 1C, 1D, 1E, 1F, 9D, 10A-10C, 11B, and 12A-12D and particularly to, e.g., FIGS. 4B, 4C, 4D, and 6 for illustrative purposes only and not by way of limitation, second jaw 120 further comprises second-jaw bridge 415, interconnecting first second-jaw tine 420 and second second-jaw tine 421. The preceding portion of this paragraph characterizes example 38 of the subject matter, disclosed herein, where example 38 also encompasses example 37, above.

Second-jaw bridge 415 substantially prevents spreading of or increasing a distance between first second-jaw tine 420 and second second-jaw tine 421 such as when applying torque to fastener 199. Second-jaw bridge 415 forms a portion of region of contact 185A as shown in FIG. 4B.

In one or more examples, second-jaw bridge 415 is omitted, as shown in FIG. 4E, where clips 441 are employed on second hinge pin 440. Clips 441 are, for example, C-clips that snap into respective grooves of second hinge pin 440 so as to substantially prevent spreading of or increasing a distance between first second-jaw tine 420 relative to second second-jaw tine 421, such as when applying torque to fastener 199. In one or more examples, second hinge pin 440 is press/friction fit to one of second jaw 120 and third jaw 130 and has a clearance fit with another of second jaw 120 and third jaw 130. Where second hinge pin 440 is press/friction fit to second jaw 120, friction between second hinge pin 440 and second jaw 120 substantially prevents spreading of or increasing the distance between first second-jaw tine 420 and second second-jaw tine 421, such as when applying torque to fastener 199.

Referring generally to FIGS. 1A-1, 1A-2, 1B, 1C, 1D, 1E, 1F, and 2G and particularly to, e.g., FIGS. 9A, 9B, 9D, 10A-10C, 11A, 11B, and 12A-12D for illustrative purposes only and not by way of limitation, wrench head 100 further comprises wrench coupler 150, which is coupled to first jaw 110 and is movable relative to first jaw 110. The preceding portion of this paragraph characterizes example 39 of the subject matter, disclosed herein, where example 39 also encompasses any one of examples 1 to 38, above.

Wrench coupler 150 provides for predetermined amount of rotation θ (see FIG. 10C) of wrench head 100 relative to longitudinal axis 1000 (see FIGS. 10A-10C and 11B) of handle 161 (see FIG. 11B). Predetermined amount of rotation θ provides for inserting fastener 199 into wrench head 100 where wrench head 100 is rotated relative to handle 161 so that handle 161 clears obstructions that would otherwise prevent insertion of fastener 199 into wrench head 100 if longitudinal axis 1010 of wrench head 100 were in-line with longitudinal axis 1000 of handle 161

Wrench coupler 150 couples first-jaw base 310 to handle coupling 162 of handle 161 of wrench 169. Predetermined amount of rotation θ is centered at about working axis 1089 and rotates about ±15° from longitudinal axis 1010 of wrench head 100. Working axis 1089 being defined by first jaw 110, second jaw 120 and third jaw 130 in the closed orientations, as shown in FIG. 2F. Closed orientations of first jaw 110, second jaw 120 and third jaw 130 being when points of contact 182-185 of first-jaw virtual circle 391 are in single point contact with second jaw 120 and points of contact 183, 186 of first-jaw virtual circle 391 are in single point contact with third jaw are in point contact with first-jaw virtual circle 391 as shown in FIG. 2F. In contrast, the open orientations of first jaw 110, second jaw 120 and third jaw 130 being when points of contact 182-185 of first-jaw virtual circle 391 are not in single point contact with second jaw 120 and points of contact 183, 186 of first-jaw virtual circle 391 are not in single point contact with third jaw 130 as shown in FIG. 2G.

Referring generally to FIGS. 1A-1, 1A-2, 1B, 1C, 1D, 1E, 1F, 11B, and 12A-12D and particularly to, e.g., FIGS. 9A-9D, 10A-10C, and 11A for illustrative purposes only and not by way of limitation, wrench coupler 150 comprises detent-interface surface 913. First jaw 110 further comprises biased detent 1030, which extends toward and contacts detent-interface surface 913. The preceding portion of this paragraph characterizes example 40 of the subject matter, disclosed herein, where example 40 also encompasses example 39, above.

Contact between biased detent 1030 and detent-interface surface 913 of pivot base 910 biases longitudinal axis 1010 of wrench head 100 so as to be in-line with longitudinal axis 1000 of handle 161 of wrench 169.

Wrench coupler 150 comprises pivot base 910 that is configured for coupling with handle coupling 162 of handle 161 of wrench 169. Pivot base 910 comprises first pivot-base end 911. Detent-interface surface 913 is formed on first pivot-base end 911 and handle 161 is coupled to pivot base 910 adjacent second pivot-base end 912. First-jaw base 310 comprises biased detent 1030. In one or more examples, detent-interface surface 913 is concave so as to influence biased detent 1030 towards longitudinal axis 1010 of wrench head 100.

Referring generally to FIGS. 1A-1, 1A-2, 1B, 1C, 1D, 1E, 1F, 11B, and 12A-12D and particularly to, e.g., FIGS. 3D, 7, 9C, 9D, and 10A-10C for illustrative purposes only and not by way of limitation, first jaw 110 further comprises second recess 333. Detent-interface surface 913 of wrench coupler 150 comprises crests 915 and trough 914, which is located between crests 915. Biased detent 1030 of first jaw 110 engages detent-interface surface 913 of wrench coupler 150. Biased detent 1030 comprises second compression spring 1031 and ball 1032. Second compression spring 1031 and ball 1032 are located within second recess 333 of first jaw 110. The preceding portion of this paragraph characterizes example 41 of the subject matter, disclosed herein, where example 41 also encompasses example 40, above.

Second compression spring 1031 biases ball 1032 away from crests 915 of detent-interface surface 913 and into trough 914 of detent-interface surface 913 so as to substantially align longitudinal axis 1010 of wrench head 100 with longitudinal axis 1000 of handle 161. Second recess 333 is formed in first-jaw base 310 adjacent detent-interface surface 913.

Referring generally to FIGS. 1A-1, 1A-2, 1B, 1C, 1D, 1E, 1F, 11B, and 12A-12D and particularly to, e.g., FIGS. 9A-9D, 10A-10C, and 11A for illustrative purposes only and not by way of limitation, wrench coupler 150 further comprises channel 917. Channel 917 comprises a cross-sectional shape that is circumferentially open in a direction away from detent-interface surface 913 of wrench coupler 150. The preceding portion of this paragraph characterizes example 42 of the subject matter, disclosed herein, where example 42 also encompasses example 40 or 41, above.

Channel 917 of pivot base 910 provides for coupling wrench head 100 to handle 161 of wrench 169. Wrench coupler 150 comprises pivot base 910, configured to be coupled with handle coupling 162 of handle 161 of wrench 169. Pivot base 910 comprises second pivot-base end 912 in which channel 917 is formed. Channel 917 is configured to receive handle coupling 162 of handle 161 of wrench 169.

Referring generally to FIGS. 1A-1, 1A-2, 1B, 1C, 1D, 1E, 1F, 9D, 10A-10C, 11B, and 12A-12D and particularly to, e.g., FIGS. 9A-9C, 10A, 10B, and 11A for illustrative purposes only and not by way of limitation, cross-sectional shape of channel 917 is dovetail contour 1098. The preceding portion of this paragraph characterizes example 43 of the subject matter, disclosed herein, where example 43 also encompasses example 42, above.

Dovetail contour 1098 mates with mating dovetail contour 1099 of handle coupling 162 to securely couple pivot base 910 to handle coupling 162 so as to eliminate relative movement between pivot base 910 and handle coupling 162.

Referring generally to FIGS. 1A-1, 1A-2, 1B, 1C, 1D, 1E, 1F, 9D, 10A-10C, 11B, and 12A-12D and particularly to, e.g., FIGS. 9D and 11A for illustrative purposes only and not by way of limitation, wrench coupler 150 further comprises pivot base 910, which contains aperture 1100 that extends into channel 917. The preceding portion of this paragraph characterizes example 44 of the subject matter, disclosed herein, where example 44 also encompasses example 42 or 43, above.

Aperture 1100 forms detent recess into which ball 1032 of biased detent 1030 of first jaw 110 is at least partially inserted when longitudinal axis 1010 is substantially aligned with longitudinal axis 1000. Aperture 1100 provides access to detent 163 of handle coupling 162 so that protrusion 164 of detent 163 can be depressed to disengage protrusion 164 from aperture 1100 and to release pivot base 910 from handle coupling 162. Pivot base 910 comprises detent-interface surface 913 and aperture 1100 extends through detent-interface surface 913 into channel 917.

Referring generally to FIGS. 1A-1, 1A-2, 1B, 1C, 1D, 1E, 1F, 9D, 10A-10C, and 12A-12D and particularly to, e.g., FIGS. 9A, 9B, 9D, 10A-10C, 11A, and 11B for illustrative purposes only and not by way of limitation, wrench coupler 150 further comprises first link 920 and second link 921. First link 920 is pivotally coupled to each of pivot base 910 and first jaw 110. Second link 921 is pivotally coupled to each of pivot base 910 and first jaw 110. First link 920 comprises first-link decoupling aperture 930 to provide access to aperture 1100 of pivot base 910. Second link 921 comprises second-link decoupling aperture 931 to provide access to aperture 1100 of pivot base 910. The preceding portion of this paragraph characterizes example 45 of the subject matter, disclosed herein, where example 45 also encompasses example 44, above.

First-link decoupling aperture 930 and second-link decoupling aperture 931 provide access to aperture 1100 of pivot base 910 so that release tool 1150 can be inserted so as to extend through both first-link decoupling aperture 930 of first link 920 and through aperture 1100, or extend through both second-link decoupling aperture 931 of second link 921 and through aperture 1100. Extension of release tool 1150 through both first-link decoupling aperture 930 of first link 920 and through aperture 1100, or through both second-link decoupling aperture 931 of second link 921 and through aperture 1100, provides for depression of protrusion 164 to release pivot base 910 from handle coupling 162.

First link 920 comprises first-link first end 922 and first-link second end 923. First link 920 is pivotally coupled to pivot base 910 about axis of rotation 980 at first-link first end 922 and pivotally coupled about axis of rotation 981 to first-jaw base 310 of first jaw 110 at first-link second end 923. Second link 921 comprises second-link first end 924 and second-link second end 925. Second link 921 is pivotally coupled about axis of rotation 982 to pivot base 910 at second-link first end 924 and pivotally coupled at axis of rotation 983 to first-jaw base 310 of first jaw 110 at second-link second end 925.

Referring generally to FIGS. 1A-1, 1A-2, 1B, 1C, 1D, 1E, 1F, 9D, 10A-10C, 11B, and 12A-12D and particularly to, e.g., FIGS. 9A, 9B, 10A, 10B, 11A, and 11B for illustrative purposes only and not by way of limitation, first jaw 110, pivot base 910 of wrench coupler 150, first link 920 of wrench coupler 150, and second link 921 of wrench coupler 150 collectively form four-bar linkage 900. The preceding portion of this paragraph characterizes example 46 of the subject matter, disclosed herein, where example 46 also encompasses example 45, above.

Four-bar linkage provides for pivoting of wrench head 100 relative to handle 161 of wrench 169 where alignment of longitudinal axis 1000 of handle 161 of wrench 169 is substantially maintained with working axis 1089 of wrench head 100.

Referring generally to FIGS. 1A-1, 1A-2, 1B, 1C, 1D, 1E, 1F, 9D, 10A-10C, 11B, and 12A-12D and particularly to, e.g., FIGS. 2A-5B for illustrative purposes only and not by way of limitation, each of first-jaw arcuate convex contact surface 111A, second first-jaw arcuate convex contact surface 111B, and third first-jaw arcuate convex contact surface 111C corresponds to a portion of a circle when viewed along working axis 1089. Second-jaw arcuate convex contact surface 121A corresponds to a portion of a circle when viewed along working axis 1089. Each of third-jaw arcuate convex contact surfaces 131 corresponds to a portion of a circle when viewed along working axis 1089. The preceding portion of this paragraph characterizes example 47 of the subject matter, disclosed herein, where example 47 also encompasses any one of examples 1 to 46, above.

The semi-circular shape of first-jaw arcuate convex contact surface 111A, second first-jaw arcuate convex contact surface 111B, and third first-jaw arcuate convex contact surface 111C, second-jaw arcuate convex contact surface 121A, and third-jaw arcuate convex contact surfaces 131 provides ramped surfaces that ride along fastener during ratcheting motion of wrench head 100.

The respective circles of first jaw 110, second jaw 120, and third jaw 130 to which first-jaw arcuate convex contact surface 111A, second first-jaw arcuate convex contact surface 111B, third first-jaw arcuate convex contact surface 111C, second-jaw arcuate convex contact surface 121A, and third-jaw arcuate convex contact surfaces 131 correspond are of the same size so as to form the ramped surfaces. In one or more examples, the circles of first jaw 110, to which first-jaw arcuate convex contact surface 111A, second first-jaw arcuate convex contact surface 111B, third first-jaw arcuate convex contact surface 111C correspond, are the same size as the circles of second jaw 120, to which second-jaw arcuate convex contact surface 121A corresponds. Likewise, the circles of second jaw 120, to which second-jaw arcuate convex contact surface 121A corresponds, are the same size as the circles of third jaw 130, to which each of third-jaw arcuate convex contact surfaces 131 corresponds.

Figure 12B:
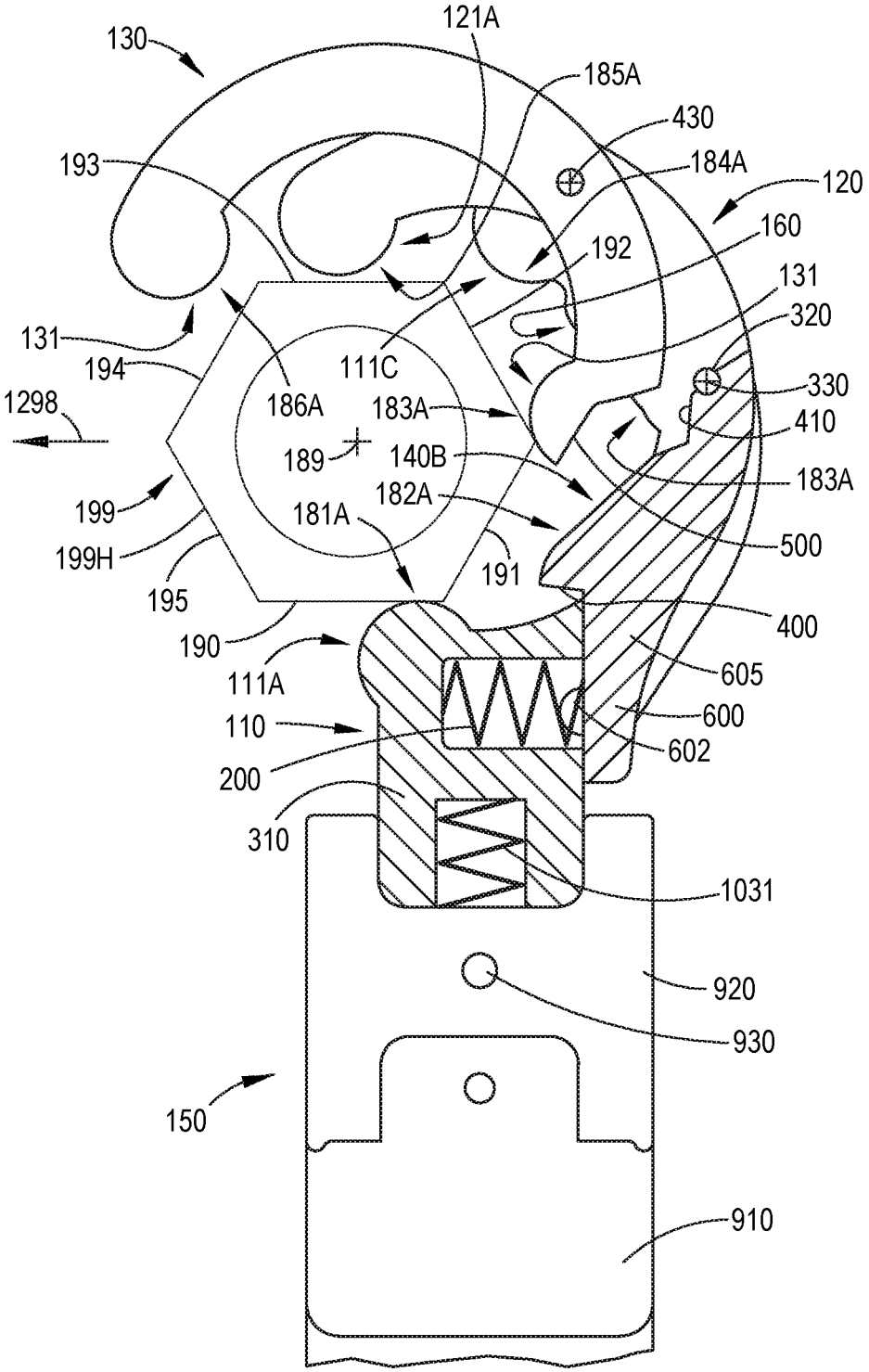
Figure 12C:
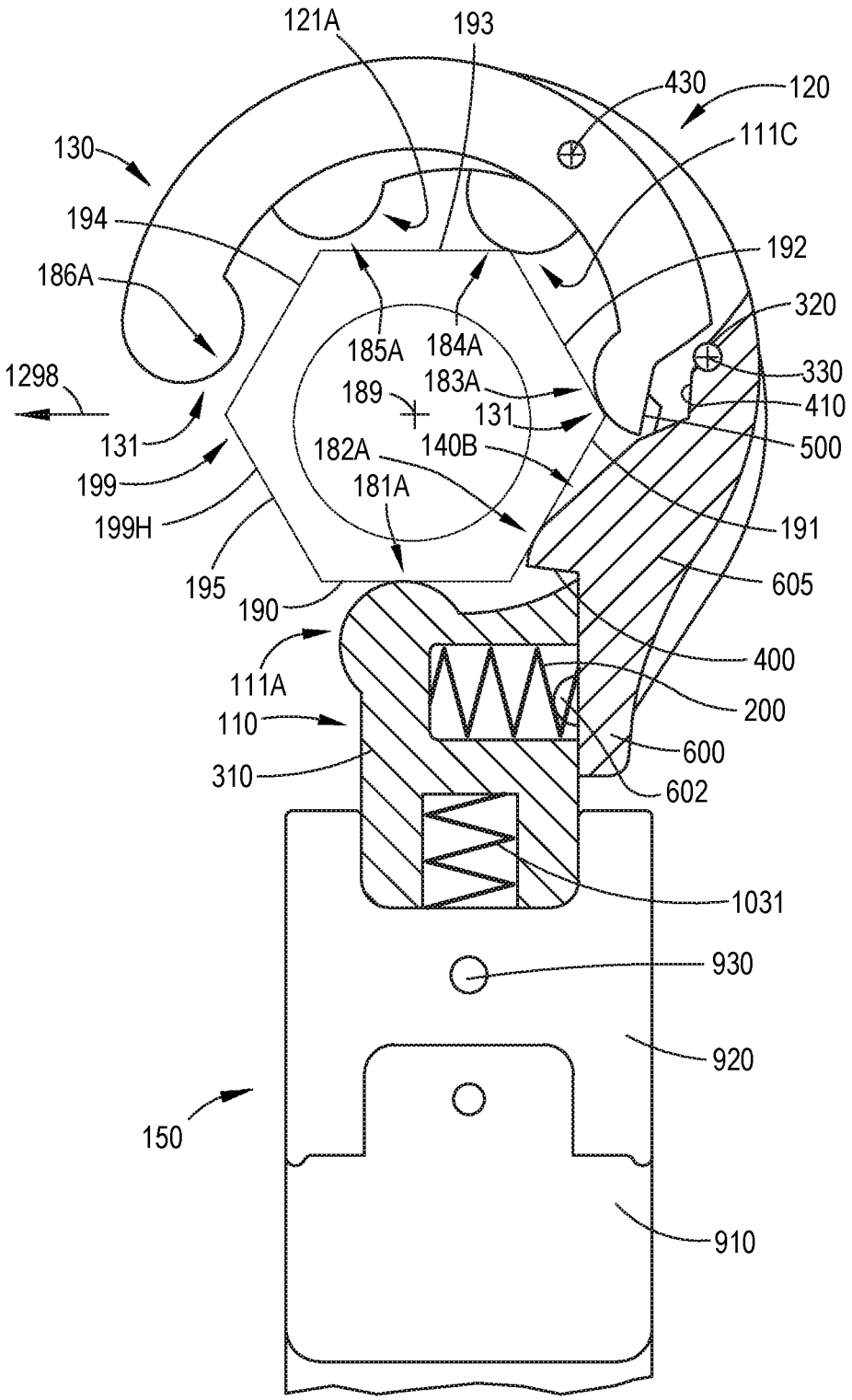
Figure 12D:
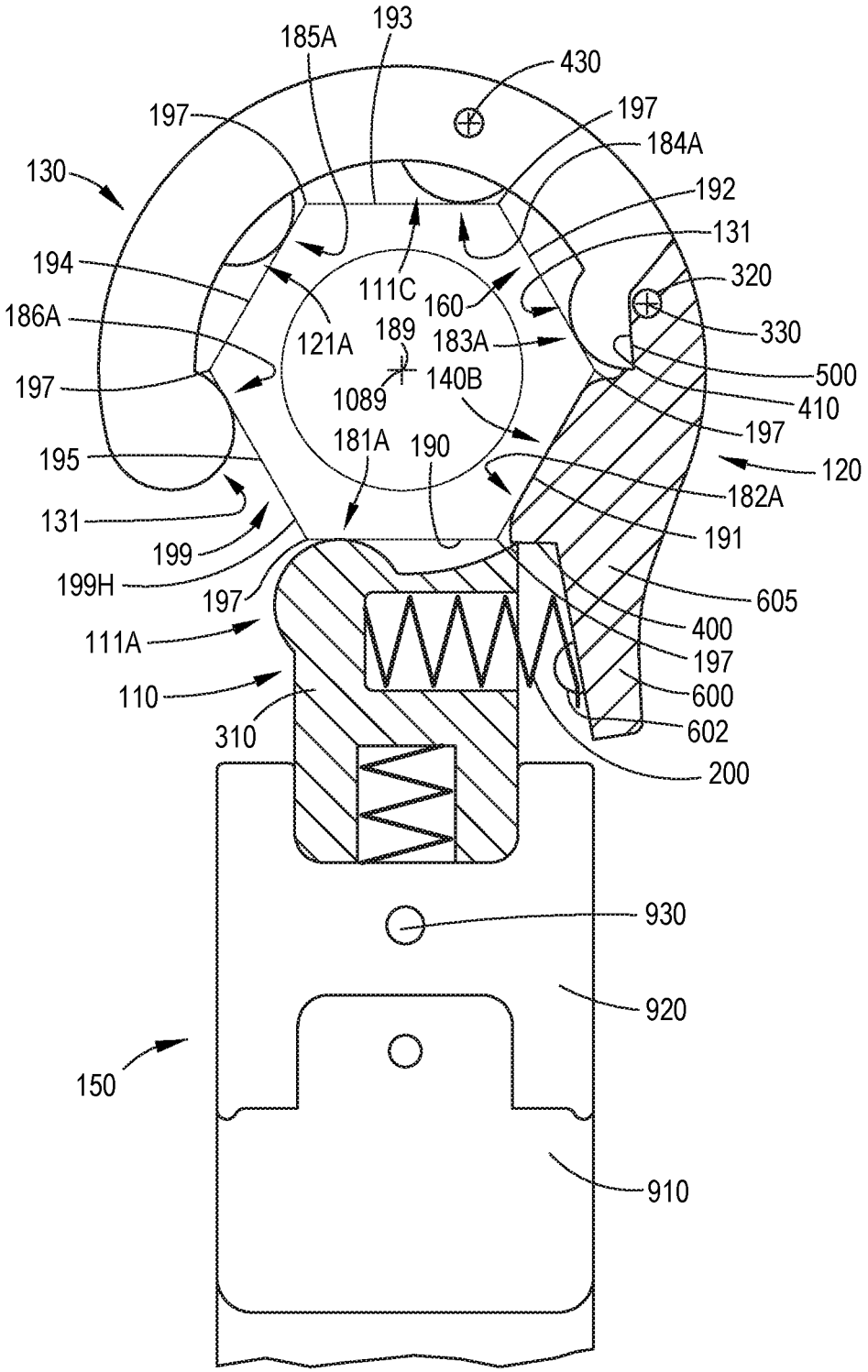

Referring generally to FIGS. 1A-1, 1A-2, 1B, 1C, 1D, 1E, 1F and particularly to, e.g., FIGS. 2A, 2C, and 12A-12D, in one or more examples, first-jaw arcuate convex contact surface 111A, second first-jaw arcuate convex contact surface 111B, third first-jaw arcuate convex contact surface 111C, and first-jaw planar contact surface 160, second-jaw arcuate convex contact surface 121A, second-jaw planar contact surface 140A, and third-jaw arcuate convex contact surfaces 131 are angularly separated so as to contact head 199H of fastener 199. As illustrated in FIG. 12C upon lateral insertion of head 199H of fastener 199 into wrench head 100 in direction 1298, head 199H contacts each of first jaw 110, second jaw 120, and third jaw 130 so as to rotate second jaw 120 and third jaw 130 relative to each other and first jaw 110 to open wrench head 100 (e.g., to move third jaw 130 to the open third-jaw orientation and to move second jaw 120 to the open second-jaw orientation). Opening of wrench head 100 through contact between head 199H of fastener 199 and first-jaw arcuate convex contact surface 111A, second first-jaw arcuate convex contact surface 111B, third first-jaw arcuate convex contact surface 111C, and first-jaw planar contact surface 160, second-jaw arcuate convex contact surface 121A, and third-jaw arcuate convex contact surfaces 131 upon lateral insertion of head 199H into wrench head 100 provides for placement of wrench head 100 over head 199H with one handed operation of wrench 169, to which wrench head 100 is coupled, in applications where fastener 199 is inaccessible from a direction in line with axis of rotation 189 of fastener 199.

In one or more examples, referring to FIGS. 1A-1D, 2A-2D, and 12A-12D, first-jaw arcuate convex contact surface 111A, second first-jaw arcuate convex contact surface 111B, third first-jaw arcuate convex contact surface 111C, and first-jaw planar contact surface 160, second-jaw arcuate convex contact surface 121A, second-jaw planar contact surface 140A, and third-jaw arcuate convex contact surfaces 131 are angularly separated so as to contact head 199H of fastener 199. Contact between head 199H with each of second jaw 120 and third jaw 130, upon application of torque to head 199H by wrench head 100, maintains a closed orientation of second jaw 120 and third jaw 130 relative to each other and relative to first jaw 110. Maintaining the closed orientation of second jaw 120 and third jaw 130 relative to each other and relative to first jaw 110 through contact of head 199H with second jaw 120 and third jaw, upon application of torque to head 199H by wrench head 100, provides for substantially uniform application of force to each of external flats 190-195 of head 199H when tightening fastener 199.

As illustrated in FIG. 12B upon further lateral insertion of head 199H in direction 1298 into wrench head 100, which is now open, contact between head 199H with third jaw 130, such as at or adjacent region of contact 183A on a respective one of third-jaw arcuate convex contact surfaces 131, rotates third jaw 130 about axis of rotation 430 from the open third-jaw orientation (see FIG. 2G) to the closed third-jaw orientation, where second-jaw virtual circle 491 has single point contact (see points of contact 183B, 186B in FIGS. 2E and 2F) with each of third-jaw arcuate convex contact surfaces 131 (see FIGS. 2E and 2G). During rotation of third jaw 130 about axis of rotation 430 to the closed third-jaw orientation, regions of contact 183A, 186A of third-jaw arcuate convex contact surfaces 131 converge on external flats 192, 195 of head 199H. Upon even further lateral insertion of head 199H into wrench head 100, as illustrated in FIG. 12C, contact between head 199H with both third jaw 130 and second jaw 120 continues to rotate third jaw 130 about axis of rotation 430 to the closed third-jaw orientation, and rotates second jaw 120 about axis of rotation 330 from the open second-jaw orientation to the closed second-jaw orientation (e.g., such that first-jaw virtual circle 391 has single point contact with each of second-jaw arcuate convex contact surface 121A and second-jaw planar contact surface 140A). As illustrated in FIG. 12D, upon full lateral insertion of head 199H into wrench head 100, second jaw 120 is in the closed second-jaw orientation, third jaw 130 is in the closed third-jaw orientation, and regions of contact 181A-186A are engaged or in contact with respective ones of external flats 190-195 of head 199H.

Contact between head 199H with second jaw 120 and third jaw 130, upon application of torque to head 199H by wrench head 100, maintains the closed orientation of second jaw 120 and third jaw 130 relative to each other and first jaw 110 (e.g., head 199H pushes against regions of contact 182A, 183A to bias or hold second jaw 120 and third jaw 130 in the respective closed orientations). Maintaining the closed orientation of second jaw 120 and the closed orientation of third jaw 130 relative to each other and first jaw 110 through contact between head 199H and each of second jaw 120 and third jaw, upon application of torque to head 199H by wrench head 100, provides for substantially uniform application of force to each of external flats 190-195 when tightening fastener 199. The serial coupling of first jaw 110, second jaw 120, and third jaw 130 provides for opening of third jaw 130 relative to either first jaw 110 and second jaw 120 and/or provides for opening second jaw 120 relative to first jaw 110 during a non-torqueing rotation of wrench head 100 relative to head 199H of fastener 199. Opening of third jaw 130 and/or second jaw 120 during non-torqueing rotation of wrench head 100 relative to head 199H provides for a ratcheting action of wrench head 100 such as when an application of torque is applied to fastener 199, following the non-torqueing rotation, head 199H pushes against regions of contact 182A, 183A to bias toward (e.g., closes) or hold second jaw 120 and third jaw 130 in the respective closed orientations for tightening fastener 199.

Examples of the subject matter, disclosed herein may be described in the context of aircraft manufacturing and service method 1300 as shown in FIG. 13 and aircraft 1302 as shown in FIG. 14. During pre-production, illustrative method 1300 may include specification and design (block 1304) of aircraft 1302 and material procurement (block 1306). During production, component and subassembly manufacturing (block 1308) and system integration (block 1310) of aircraft 1302 may take place. Thereafter, aircraft 1302 may go through certification and delivery (block 1312) to be placed in service (block 1314). While in service, aircraft 1302 may be scheduled for routine maintenance and service (block 1316). Routine maintenance and service may include modification, reconfiguration, refurbishment, etc. of one or more systems of aircraft 1302.

Each of the processes of illustrative method 1300 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 14, aircraft 1302 produced by illustrative method 1300 may include airframe 1318 with a plurality of high-level systems 1320 and interior 1322. Examples of high-level systems 1320 include one or more of propulsion system 1324, electrical system 1326, hydraulic system 1328, and environmental system 1330. Any number of other systems may be included. Although an aerospace example is shown, the principles disclosed herein may be applied to other industries, such as the automotive industry. Accordingly, in addition to aircraft 1302, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1300. For example, components or subassemblies corresponding to component and subassembly manufacturing (block 1308) may be fabricated or manufactured in a manner similar to components or subassemblies produced while aircraft 1302 is in service (block 1314). Also, one or more examples of the apparatus(es), method(s), or combination thereof may be utilized during production stages 1308 and 1310, for example, by substantially expediting assembly of or reducing the cost of aircraft 1302. Similarly, one or more examples of the apparatus or method realizations, or a combination thereof, may be utilized, for example and without limitation, while aircraft 1302 is in service (block 1314) and/or during maintenance and service (block 1316).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples, set forth herein, will come to mind to one skilled in the art, to which the present disclosure pertains, having the benefit of the teachings, presented in the foregoing descriptions and the associated drawings.

Therefore, it is to be understood that the subject matter, disclosed herein, is not to be limited to the specific examples illustrated and that modifications and other examples are intended to be included within the scope of the appended claims. Moreover, although the foregoing description and the associated drawings describe examples of the subject matter, disclosed herein, in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A wrench head, comprising:

a working axis;

a first jaw, comprising a first-jaw arcuate convex contact surface, a second first-jaw arcuate convex contact surface, a third first-jaw arcuate convex contact surface, and a first-jaw planar contact surface, located between the second first-jaw arcuate convex contact surface and the third first-jaw arcuate convex contact surface;

a second jaw, coupled with the first jaw, pivotable relative to the first jaw, and comprising a second-jaw arcuate convex contact surface and a second-jaw planar contact surface;

a third jaw, coupled with the second jaw, pivotable relative to the second jaw, and comprising a-third-jaw arcuate convex contact surfaces; and wherein:

a first-jaw virtual circle is perpendicular to the first-jaw arcuate convex contact surface, to the second first-jaw arcuate convex contact surface, and to the third first-jaw arcuate convex contact surface, has a single point contact with each one of the first-jaw arcuate convex contact surface, the second first-jaw arcuate convex contact surface, and the third first-jaw arcuate convex contact surface, is centered about the working axis, and is perpendicular to the working axis;

when the second jaw is in a closed second-jaw orientation relative to the first jaw, the first-jaw virtual circle is perpendicular to the second-jaw arcuate convex contact surface and to the second-jaw planar contact surface, has a single point contact with the second-jaw arcuate convex contact surface and intersects the second-jaw planar contact surface at only two points; and when the second jaw is in the closed second-jaw orientation relative to the first jaw, and the third jaw is in a closed third-jaw orientation relative to the second jaw, the first-jaw virtual circle is perpendicular to the third-jaw arcuate convex contact surfaces and has a single point contact with each of the third-jaw arcuate convex contact surfaces.

2. The wrench head according to claim 1, wherein, when the second jaw is in an open second-jaw orientation relative to the first jaw, the first-jaw virtual circle is perpendicular to the second-jaw arcuate convex contact surface and to the second-jaw planar contact surface, is not in contact with the second-jaw arcuate convex contact surface, intersects the second-jaw planar contact surface, and does not intersect the second-jaw arcuate convex contact surface.

3. The wrench head according to claim 2, wherein:

the second jaw further comprises a second second-jaw planar contact surface; and when the second jaw is in the closed second-jaw orientation relative to the first jaw, the first-jaw virtual circle is perpendicular to the second-jaw arcuate convex contact surface, to the second-jaw planar contact surface, and to the second second-jaw planar contact surface, has a single point contact with the second-jaw arcuate convex contact surface, and intersects each of the second-jaw planar contact surface and the second second-jaw planar contact surface at only two points.

4. The wrench head according to claim 2, wherein, when the second jaw is in the open second-jaw orientation relative to the first jaw, and the third jaw is in an open third-jaw orientation relative to the second jaw, the first-jaw virtual circle is perpendicular to the third-jaw arcuate convex contact surfaces, is not in contact with any of the third-jaw arcuate convex contact surfaces, and does not intersect any of the third-jaw arcuate convex contact surfaces.

5. The wrench head according to claim 4, further comprising:

a torsion spring, located between the second jaw and the third jaw and biasing the third jaw relative to the second jaw from the open third-jaw orientation to the closed third-jaw orientation, and wherein the second jaw further comprises:

a second second-jaw arcuate convex contact surface; and a second-jaw virtual circle is perpendicular to the second-jaw arcuate convex contact surface, to the second-jaw planar contact surface, and to the second second-jaw arcuate convex contact surface, has a single point contact with each of the second-jaw arcuate convex contact surface and the second second-jaw arcuate convex contact surface, and intersects the second-jaw planar contact surface at only two points; and when the third jaw is in the closed third-jaw orientation relative to the second jaw, the second-jaw virtual circle is perpendicular to the third-jaw arcuate convex contact surfaces and has a single point contact with each of the third-jaw arcuate convex contact surfaces.

6. The wrench head according to claim 5, wherein, when the third jaw is in the open third-jaw orientation relative to the second jaw, the second-jaw virtual circle is perpendicular to the third-jaw arcuate convex contact surfaces, is not in contact with any of the third-jaw arcuate convex contact surfaces, and does not intersect any of the third-jaw arcuate convex contact surfaces.

7. The wrench head according to claim 5, wherein:

the third jaw further comprises a third second-jaw interface surface;

the second jaw further comprises a third-jaw interface surface-; and the third-jaw interface surface is configured to contact the third second-jaw interface surface when the third jaw is in the closed third-jaw orientation.

8. The wrench head according to claim 7, wherein:

when the third jaw is in the closed third-jaw orientation, the third second-jaw interface surface is parallel with the third-jaw interface surface; and when the third jaw is in the open third-jaw orientation, the third second-jaw interface surface and the third-jaw interface surface are oblique to each other.

9. The wrench head according to claim 4, further comprising a torsion spring, located between the second jaw and the third jaw and biasing the third jaw relative to the second jaw from the open third-jaw orientation to the closed third-jaw orientation, and wherein:

the second jaw further comprises a second second-jaw planar contact surface;

a second-jaw virtual circle is perpendicular to the second-jaw arcuate convex contact surface, to the second-jaw planar contact surface, and to the second second-jaw planar contact surface, has a single point contact with the second-jaw arcuate convex contact surface, and intersects each of the second-jaw planar contact surface and the second second-jaw planar contact surface at only two points; and when the third jaw in the closed third-jaw orientation relative to the second jaw, the second-jaw virtual circle is perpendicular to the third-jaw arcuate convex contact surfaces and has a single point contact with each of the third-jaw arcuate convex contact surfaces.

10. The wrench head according to claim 9, wherein, when the third jaw is in the open third-jaw orientation relative to the second jaw, the second-jaw virtual circle is perpendicular to the third-jaw arcuate convex contact surfaces, is not in contact with any of the third-jaw arcuate convex contact surfaces, and does not intersect any of the third-jaw arcuate convex contact surfaces.

11. The wrench head according to claim 3, wherein, when the second jaw is in the open second-jaw orientation relative to the first jaw, the first-jaw virtual circle is perpendicular to the second-jaw arcuate convex contact surface, to the second-jaw planar contact surface, and to the second second-jaw planar contact surface, is not in contact with any one of the second-jaw arcuate convex contact surface or the second second-jaw planar contact surface, and does not intersect any one of the second-jaw arcuate convex contact surface, the second-jaw planar contact surface, or the second second-jaw planar contact surface.

12. The wrench head according to claim 3, wherein the second-jaw planar contact surface is located between the second second-jaw planar contact surface and the second-jaw arcuate convex contact surface.

13. The wrench head according to claim 3, wherein:

the second jaw further comprises a second second-jaw arcuate convex contact surface, and the second-jaw planar contact surface and the second second-jaw planar contact surface are located between the second-jaw arcuate convex contact surface and the second second-jaw arcuate convex contact surface.

14. The wrench head according to claim 2, further comprising a compression spring, located between the first jaw and the second jaw, and wherein the compression spring biases the second jaw relative to the first jaw from the open second-jaw orientation to the closed second-jaw orientation.

15. The wrench head according to claim 14, wherein:

the second jaw further comprises a first first-jaw interface surface; and the first jaw comprises a first second-jaw interface surface, configured to contact the first first-jaw interface surface when the second jaw is in the open second-jaw orientation.

16. The wrench head according to claim 15, wherein:

the second jaw further comprises a second first-jaw interface surface; and the first jaw further comprises a second second-jaw interface surface, configured to contact the second first-jaw interface surface when the second jaw is in the closed second-jaw orientation.

17. The wrench head according to claim 1, wherein the first-jaw virtual circle is perpendicular the first-jaw planar contact surface and intersects the first-jaw planar contact surface at only two points.

18. The wrench head according to claim 1, wherein:

the second jaw further comprises a second second-jaw arcuate convex contact surface, and the second second-jaw arcuate convex contact surface is located between the second-jaw arcuate convex contact surface and the second-jaw planar contact surface.

19. The wrench head according to claim 1, wherein:

the second jaw further comprises a second second-jaw arcuate convex contact surface, and the second-jaw planar contact surface is located between the second-jaw arcuate convex contact surface and the second second-jaw arcuate convex contact surface.

20. The wrench head according to claim 1, wherein the third-jaw arcuate convex contact surfaces are two in number.

* * * * *